US008966821B2

(12) United States Patent
Walker et al.

(10) Patent No.: US 8,966,821 B2
(45) Date of Patent: Mar. 3, 2015

(54) DUAL HINGED DOOR MECHANISM

(75) Inventors: Jonathan D. Walker, Chicago, IL (US); Lawrence A. Hillegonds, New Lenox, IL (US); Robert L. Fritz, Elwood, IL (US)

(73) Assignee: Panduit Corp., Tinley Park, IL (US)

( * ) Notice: Subject to any disclaimer, the term of this patent is extended or adjusted under 35 U.S.C. 154(b) by 8 days.

(21) Appl. No.: 13/617,338

(22) Filed: Sep. 14, 2012

(65) Prior Publication Data

US 2014/0075844 A1 Mar. 20, 2014

(51) Int. Cl.
*E05D 7/02* (2006.01)

(52) U.S. Cl.
USPC ..... 49/382; 49/193

(58) Field of Classification Search
USPC ..... 49/192, 193, 382; 292/44, 45, 49, 50, 292/54, 194, 215, 218, 195, 198
See application file for complete search history.

(56) References Cited

U.S. PATENT DOCUMENTS

| | | | | |
|---|---|---|---|---|
| 2,796,628 | A | 6/1957 | Van Meter | |
| 2,885,723 | A * | 5/1959 | Altmann | 16/232 |
| 3,048,899 | A | 8/1962 | Vincent | |
| 3,403,473 | A | 10/1968 | Navarro | |
| 3,654,112 | A | 4/1972 | Beekmans et al. | |
| 3,654,663 | A | 4/1972 | Algotssorv | |
| 4,495,673 | A | 1/1985 | Khan | |
| 4,671,015 | A | 6/1987 | Curry et al. | |
| 4,690,468 | A * | 9/1987 | Lau | 312/291 |
| 4,811,518 | A | 3/1989 | Ladisa | |
| 4,947,583 | A * | 8/1990 | Inui et al. | 49/193 |
| 5,054,163 | A | 10/1991 | Sterling et al. | |
| 5,148,629 | A | 9/1992 | Minami | |
| 5,187,836 | A * | 2/1993 | Kim et al. | 16/231 |
| 5,548,927 | A | 8/1996 | Song | |
| 5,675,934 | A * | 10/1997 | Park | 49/193 |
| 5,806,687 | A | 9/1998 | Ballesteros et al. | |
| 5,829,197 | A * | 11/1998 | Oh | 49/193 |
| 5,896,619 | A * | 4/1999 | Koopman | 16/50 |
| 5,926,916 | A | 7/1999 | Lee et al. | |
| 5,940,937 | A | 8/1999 | Churchill et al. | |
| 5,983,453 | A | 11/1999 | Miwa | |
| 6,000,771 | A | 12/1999 | Wissinger et al. | |
| 6,065,612 | A | 5/2000 | Rinderer | |
| 6,129,434 | A | 10/2000 | Melane et al. | |
| 6,225,554 | B1 | 5/2001 | Trehan et al. | |
| 6,282,838 | B1 | 9/2001 | Yoshikawa | |
| 6,407,332 | B1 | 6/2002 | Buchberger et al. | |
| 6,443,542 | B1 | 9/2002 | Lindquist et al. | |

(Continued)

FOREIGN PATENT DOCUMENTS

| | | |
|---|---|---|
| DE | 29902266 U1 | 6/1999 |
| DE | 29914844 A | 1/2000 |

(Continued)

*Primary Examiner* — Katherine Mitchell
*Assistant Examiner* — Catherine A Kelly
(74) *Attorney, Agent, or Firm* — Christopher S. Clancy; James H. Williams

(57) ABSTRACT

An interlocking assembly for a dual hinged door, includes a first latch and second latch each rotatably secured to opposing sides of the door. Each Latch is linked to a first and second interference member respectively, such that positioning the first latch in an open position rotates first interference member in a path of rotation of the second interference member. In that configuration, second interference member is not permitted to rotate and prevents the second latch from opening.

19 Claims, 41 Drawing Sheets

(56) References Cited

U.S. PATENT DOCUMENTS

| | | | | |
|---|---|---|---|---|
| 6,467,640 | B1 | 10/2002 | Hung | |
| 6,489,565 | B1 | 12/2002 | Krietzman et al. | |
| 6,490,895 | B1 | 12/2002 | Weinerman et al. | |
| 6,600,107 | B1 | 7/2003 | Wright et al. | |
| 6,605,782 | B1 | 8/2003 | Krietzman et al. | |
| 6,688,657 | B2 | 2/2004 | Peacock et al. | |
| 6,766,093 | B2 | 7/2004 | McGrath et al. | |
| 6,785,459 | B2 | 8/2004 | Schmidt et al. | |
| 6,814,244 | B1 | 11/2004 | Hathcock | |
| 6,877,827 | B2 | 4/2005 | Holighaus et al. | |
| 6,883,841 | B2 | 4/2005 | Kawabata et al. | |
| 6,884,942 | B2 | 4/2005 | McGrath et al. | |
| 6,893,299 | B2 | 5/2005 | Baker et al. | |
| 6,910,665 | B2 * | 6/2005 | Avendano et al. | 248/188.2 |
| 6,945,616 | B2 | 9/2005 | Webster et al. | |
| 6,946,605 | B2 | 9/2005 | Levesque et al. | |
| 7,516,515 | B2 | 4/2009 | Leimkuehler et al. | |
| 7,913,355 | B2 * | 3/2011 | Choi | 16/230 |
| 2004/0173545 | A1 | 9/2004 | Canty et al. | |
| 2004/0226900 | A1 | 11/2004 | Canty et al. | |
| 2005/0186858 | A1 | 8/2005 | Baker et al. | |
| 2005/0247650 | A1 | 11/2005 | Vogel et al. | |
| 2005/0286235 | A1 | 12/2005 | Randall et al. | |
| 2009/0008949 | A1 | 1/2009 | Lin | |

FOREIGN PATENT DOCUMENTS

| | | | |
|---|---|---|---|
| DE | 29914844 | U | 1/2000 |
| EP | 0762819 | A1 | 3/1997 |
| EP | 0844709 | A2 | 5/1998 |
| EP | 1202416 | A2 | 5/2002 |
| WO | 9511362 | A1 | 4/1995 |
| WO | 2004057141 | A2 | 7/2004 |
| WO | 2007018395 | A1 | 2/2007 |

* cited by examiner

DUAL HINGED DOOR MECHANISM

FIELD OF THE INVENTION

This invention relates to a hinged door and more particularly to a door lifting and support, latch locking and handle assemblies.

SUMMARY

An example of an interlocking assembly for a dual hinged door includes a first latch rotatably secured to the door at a first side of the door. The first latch is rotatable between a closed position and an open position. A second latch is rotatably secured to the door at a second side of the door, opposite the first side. The second latch is rotatable between a closed position and an open position. A first interference member is rotatably secured to the door and a second interference member is rotatably secured to the door, wherein the first interference and the second interference members are positioned adjacent one another. It further includes, a first latch linkage arm rotatably connected to the first latch at a first portion of the first latch linkage arm and rotatably connected to the first interference member at a second portion of the first latch linkage arm spaced apart from the first portion, such that rotation of the first latch from the closed position to the open position moves the first latch linkage arm and causes the first interference member to rotate. Additionally, a second latch linkage arm is rotatably connected to the second latch at a first portion of the second latch linkage arm and rotatably connected to the second interference member at a second portion of the second latch linkage arm spaced apart from the first portion, such that rotation of the second latch from the closed position to the open position moves the second latch linkage arm and causes the second interference member to rotate. The first interference member is positioned in a path of rotation of the second interference member, blocking rotation of the second interference member, with the first latch in the open position and the second latch in the closed position.

An example of an assembly for lifting and supporting a door relative to a frame includes a first upper hinge pin connected to a top portion of the frame and a first lower hinge pin connected to a bottom portion of the frame. A lift pin is connected to the door and positioned to extend in a direction forming an angular relationship with a plane formed by the door with the door hinged about the first upper and first lower hinge pins and the door in an opened position. A lift pin support member is secured to the frame and positioned to engage the lift pin such that the support member provides vertical support of the door and positions the door into a predetermined elevation relative to the frame, with the door in a closed position. Additionally, a door support structure is associated with the first lower hinge pin, wherein the door support structure extends away from and in angular relationship to a longitudinal axis of the first lower hinge pin and wherein the support structure provides support to the door with the door hinged about the first upper and first lower hinge pins and with the door in an open position.

An example of handle assembly for a door includes a handle rotatable about an axis of rotation of the handle assembly, a drive member connected to the handle and rotatable about the axis of rotation and a drive pin member connected to the drive member and extending radially from the drive member. Also provided is a drive receiving member rotatably engaged with the drive member and rotatable about the axis of rotation and the drive receiving member defines an opening including a first and second spaced apart opposing sidewalls, wherein the drive pin member is positioned within the opening and is movable within the opening. A cam is connected to the drive receiving member and rotatable with the drive receiving member about the axis of rotation. A torsion spring is positioned about the axis of rotation with the torsion spring having a first arm connected with the handle such that the first arm moves with the handle and a second arm positioned in proximity to the cam such that the second arm moves with the cam. This handle assembly is positionable in a first closed position, with the handle in a first position, the cam in a first position, the torsion spring in a first unloaded position and the drive pin member positioned adjacent the first sidewall of the opening. The handle assembly is also positionable in an open position, with the handle in a second position, the cam in a second position, the torsion spring in a second unloaded position and the drive pin member adjacent the first sidewall of the opening. The handle assembly is further positionable in a second closed position, with the handle in the first position, the cam in the second position, the torsion spring in a loaded position and the drive pin member positioned spaced apart from the first sidewall of the opening.

DETAILED DESCRIPTION

Referring to FIGS. 1-4, an embodiment of network cabinet 10 of present invention is shown. Network cabinet 10 is contemplated to carry a variety of network related equipment, such as network switches, patch panels and/or servers and will be appropriately configured to handle the particular equipment that is needed. To optimize the use of network cabinet 10, dual hinged doors are used to provide ease in access to interior portions of network cabinet 10 in order to install, maintenance, wire and remove equipment as needed, in a safe and effortless manner.

For ease in understanding orientations with respect to describing network cabinet 10, if not otherwise stated, the right and left side of network cabinet 10 will be identified as such from a view point taken from facing the front side "F" of network cabinet 10. For example, viewing from the front side "F" of cabinet 10, in FIG. 3, front door 12 is hinged on the left side of frame 16 of cabinet 10. Also, in FIG. 4, viewing from the front side "F", rear door 17 is hinged on the left side of frame 16 of cabinet 10. When referring to the "rear side" or a "back side" of a door such as front door 12, this will be the side of the door that faces the interior of the cabinet with the door in a closed position. Correspondingly, for example, the side of front door 12 that is seen from outside of network cabinet 10 with front door 12 in a closed position, will be referred to as the "front side" or "outside side" of front door 12.

Figure 1:
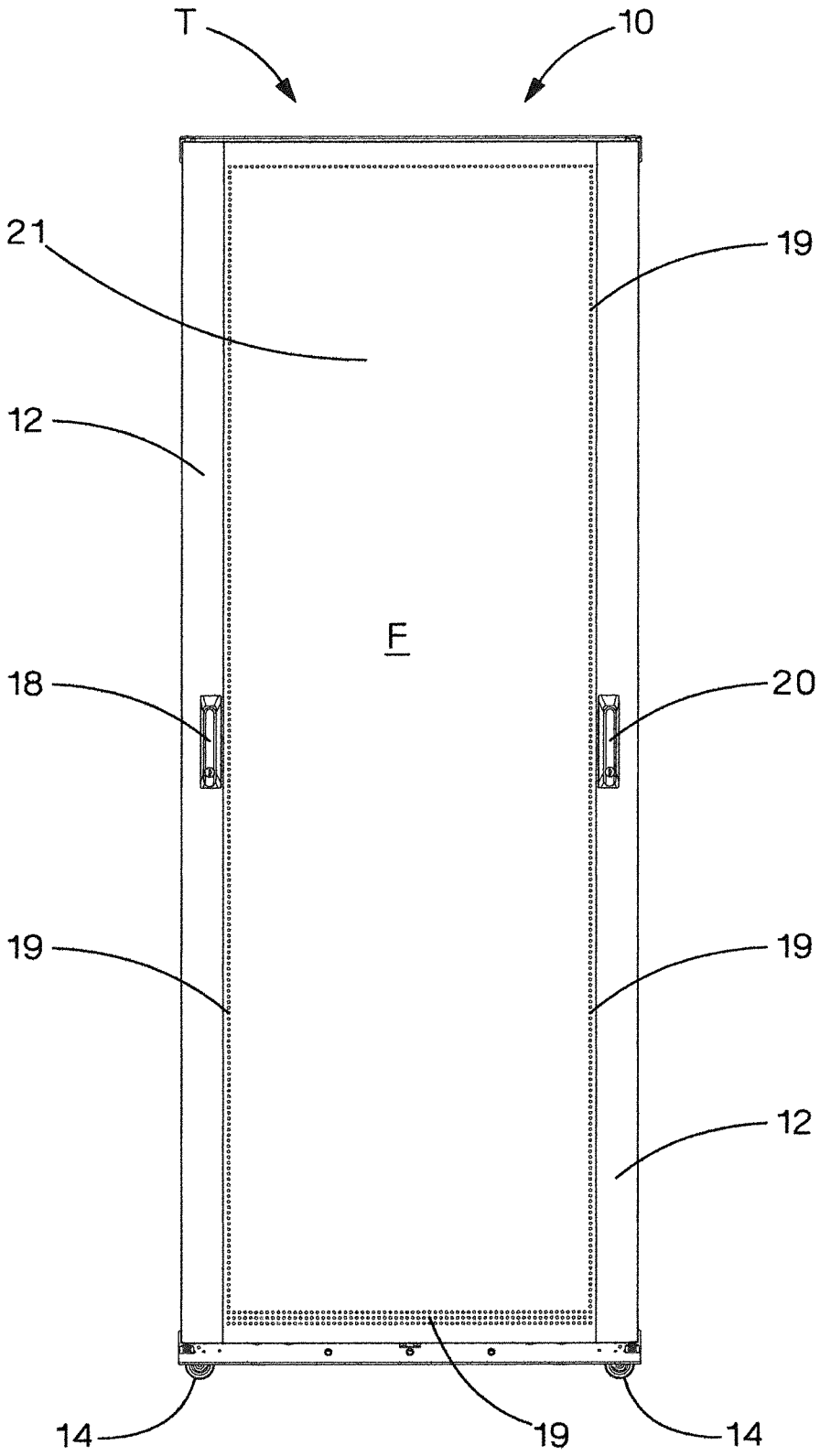
FIG. 1 is a front side elevation view of a cabinet frame with a front door in a closed position.

As seen in FIG. 1, front door 12 is positioned on the front side "F" of network cabinet 10. In certain embodiments of the present invention, network cabinet 10 provides casters 14 mounted to a bottom portion "B" of frame 16, as can be seen in FIGS. 1-4. Casters 14 provide ease in rolling network cabinet 10 to a desired position and/or location. In this embodiment, network cabinet 10 has a dual hinged door arrangement for opening both front and rear doors 12, 17 wherein each door can be hinged or unhinged selectively from either the left or right side of frame 16 of cabinet 10. Each door is provided two handles, one for opening the door with the hinge positioned on the right side of cabinet 10 and a second handle for opening the door with the hinge positioned on the left side of the cabinet 10. Since both front and back doors 12 and 17 are generally structured the same but face opposing directions, front door 12 will be described herein. Left handle 18 which is part of handle assembly 18' is positioned on the left portion of front door 12, as you face front door 12, and right handle 20 which is part of handle assembly 20' is positioned on a right portion of front door 12. For rear door 17, with the user facing door 17, handle 18 would be positioned on the left side portion of door 17 and handle 20 would be positioned on the right hand portion of door 17.

Figure 2:
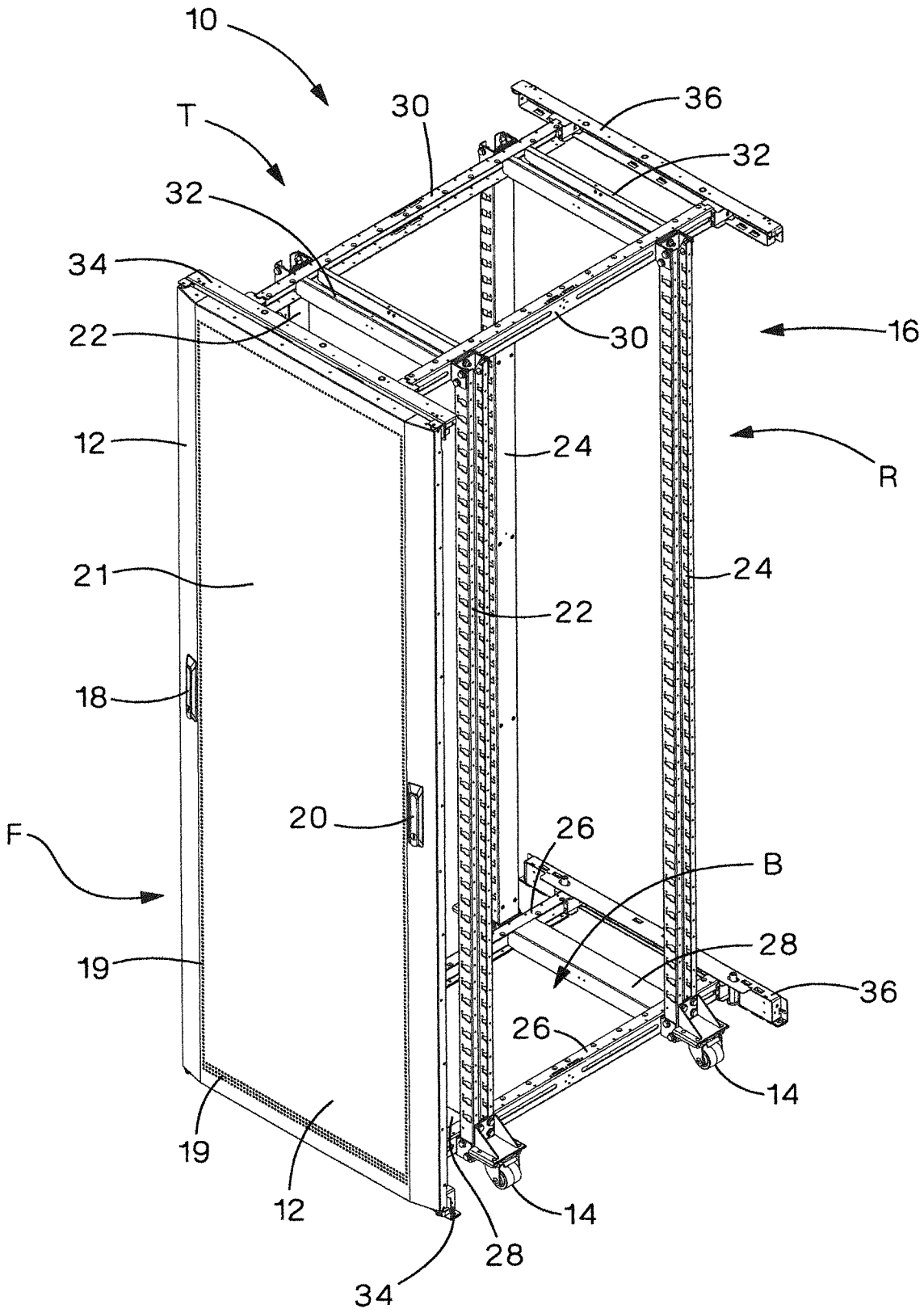
FIG. 2 is a front right side perspective view of FIG. 1 showing the front door in a closed position and the frame of the cabinet.
Figure 3:
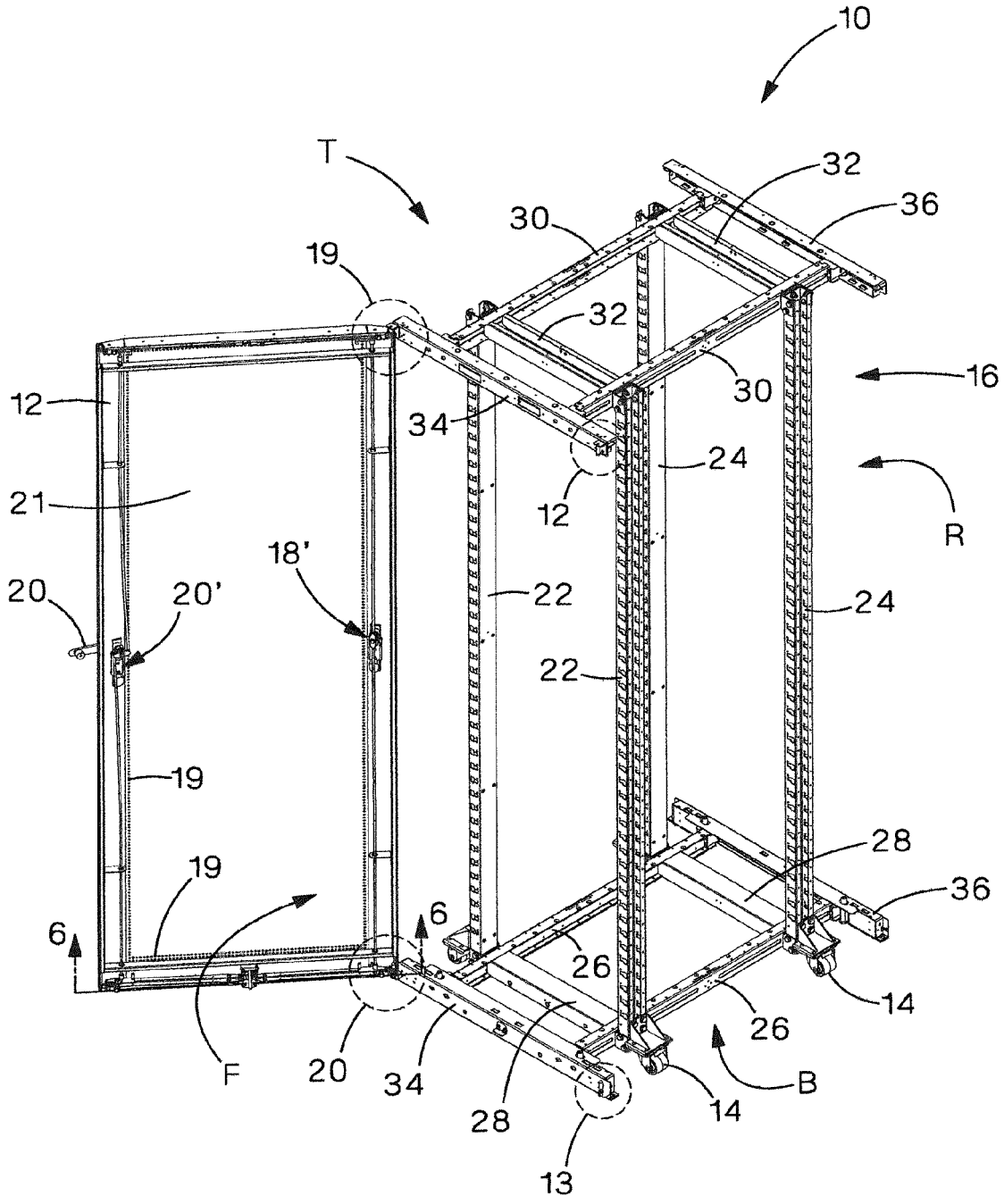
FIG. 3 is the view of FIG. 2 with the front door in an open position and hinged to the left side of the cabinet frame.
Figure 4:
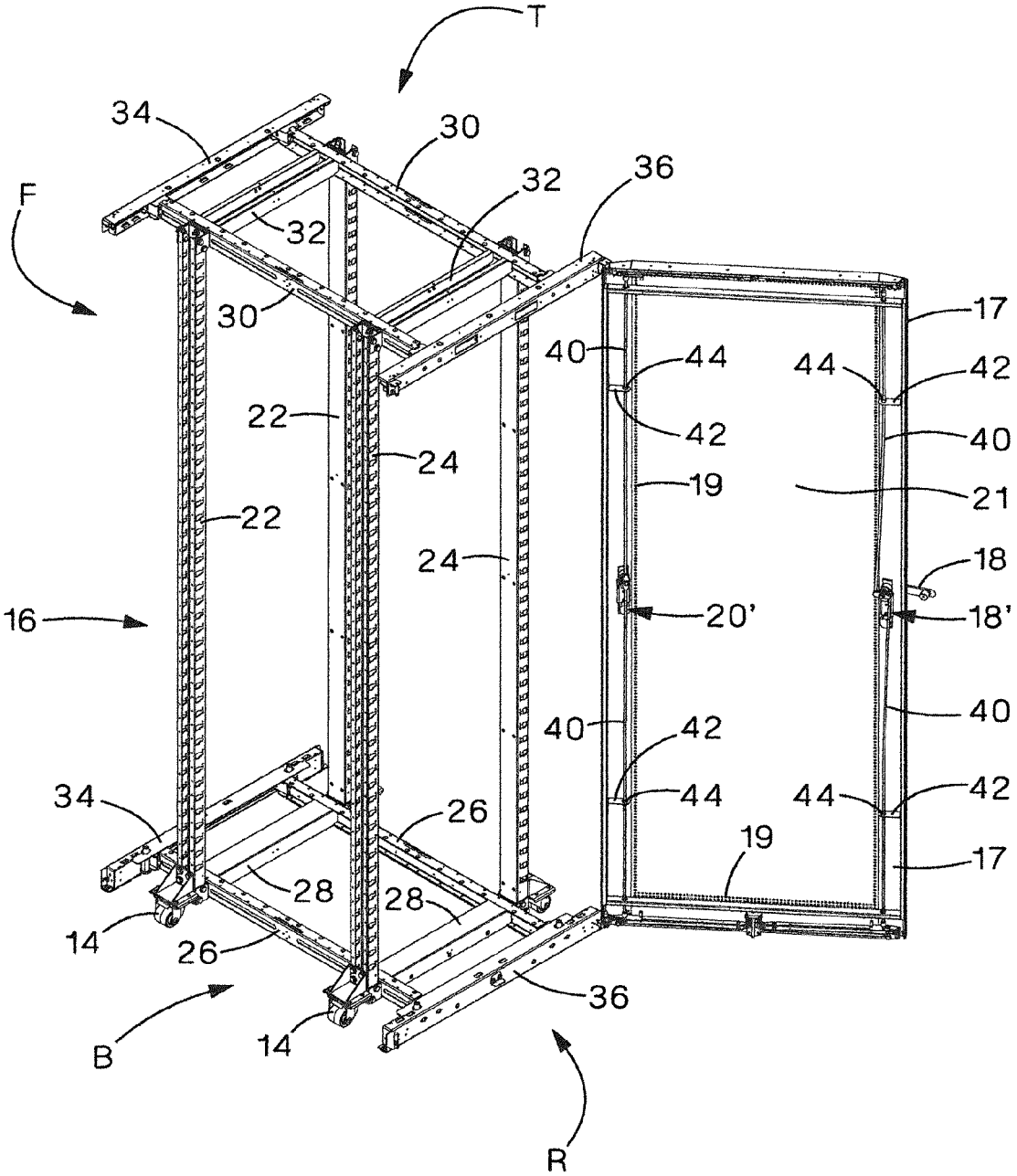
FIG. 4 is a rear perspective view of the cabinet frame as shown in FIG. 3 without a front door and with a rear door in an open position and hinged to the frame on a left side of the frame.

Frame 16, as seen in FIGS. 2-4, in this embodiment, is constructed of a conductive material such as steel which includes a pair of front vertical spaced apart frame rails 22 and a pair of rear vertical spaced apart frame rails 24. These pairs of vertical frame rails 22 and 24 are connected together at a bottom portion "B" of cabinet 10 by securing a pair of front to back base beams 26 and a pair of side to side base beams 28 to the vertical frame rails 22 and 24 by way of welding, bolting or other securing method for providing sufficient structural integrity to cabinet 10. Similarly, top portion "T" of cabinet 10 is constructed with securing together a pair of front to back top beams 30 and a pair of side to side top beams 32 to the front pair of vertical rails 22 and to the back pair of vertical frame rails 24 by way of bolting, welding or other securing method to provide sufficient structural integrity to cabinet 10 thereby completing formation of a generally rectangular box structure. In this particular embodiment, the cabinet is approximately 800 mm wide (31.5 inches), 1070 mm deep (42.2 inches) inches and approximately 84 inches tall and will carry a 2,000 pound load rating.

As can be seen in FIG. 3, front to back beams 26 positioned in the bottom portion "B" of cabinet 10 and front to back beams 30 positioned in top portion "T" of cabinet 10 each extend beyond pairs of vertical frame rails 22 and 24. In this embodiment, cross beam 34 is connected to and spans ends of the front to back beams 26 that extend outwardly toward front portion "F" at bottom portion "B" of cabinet 10. Similarly another cross beam 34 is connected to and spans the ends of the front to back beams 30 that extend outwardly toward front portion "F" at top portion "T" of cabinet 10. These two cross beams 34 which are positioned in front portion "F" of cabinet 10 are utilized to carry and from which to hinge front door 12 to cabinet 10. As seen in FIG. 4, a pair of cross beams 36 are one each positioned at the bottom portion "B" and top portion "T" of cabinet 10. Cross beam 36 positioned at bottom portion "B" of cabinet 10 is connected to and span ends of front to back beams 26 and the other cross beam 36 of this pair is connected to and span the ends of front to back beams 30, at rear portion "R" of cabinet 10. Pair of cross beams 36 are utilized to carry and from which to hinge rear door 17 to rear portion "R" of cabinet 10.

Figure 14:
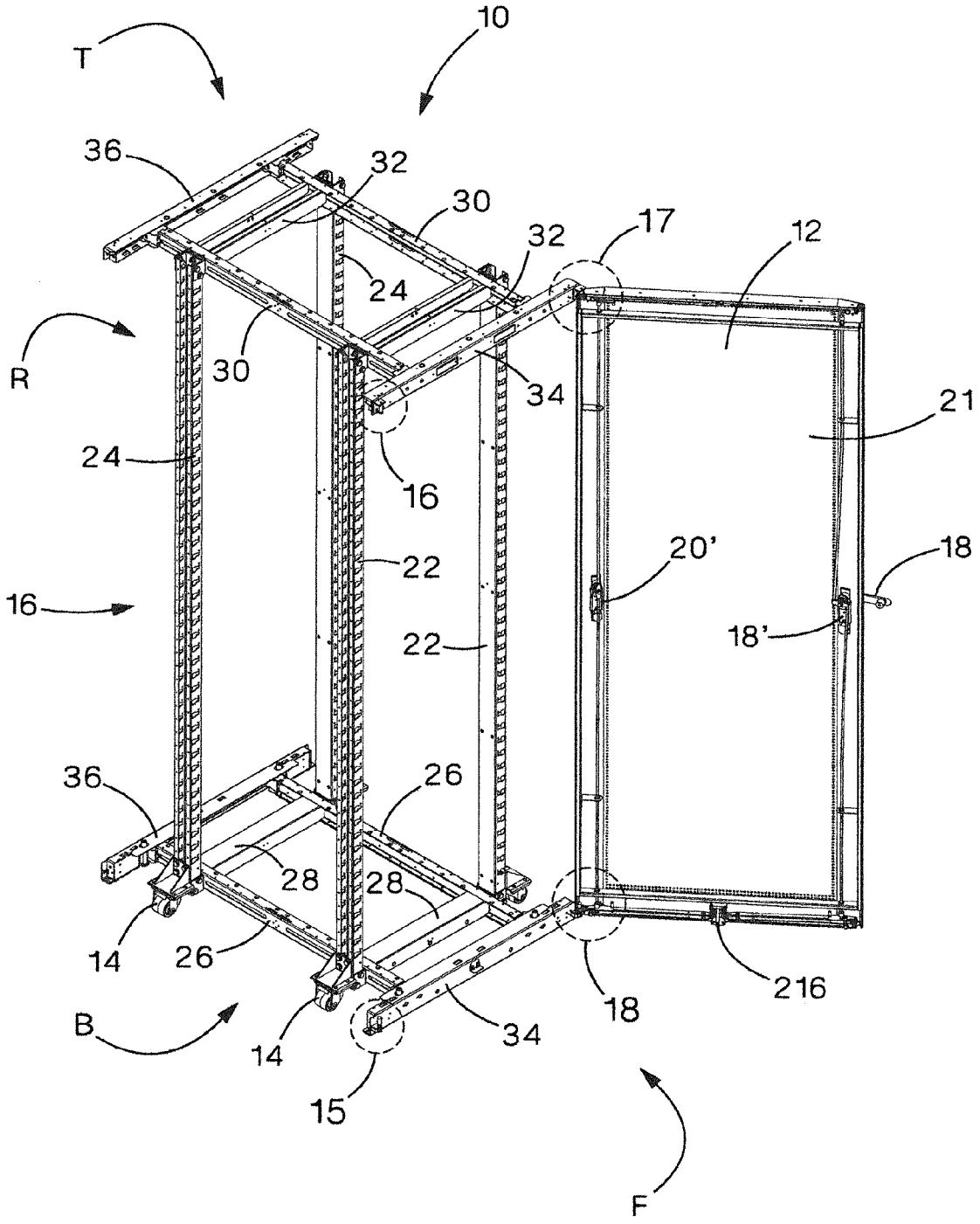
FIG. 14 is a front left side perspective view of FIG. 3. of the cabinet with the front door to the right side of the frame and the door is in an open positioned.

As is shown in FIGS. 3 and 4, front door 12 in FIG. 3 is being opened from the right side of frame 16 of cabinet 10 and is hinged to frame 16 on the left side of frame 16 of cabinet 10. As will be later described, front door 12 may be closed and secured to frame 16 and thereafter front door 12 may then be opened with door 12 hinged on the right side of frame 16 of cabinet 10 and the door opening from the left side of frame 16 of cabinet 10, as seen in FIG. 14. Similarly, in the rear of cabinet 10 it is shown that rear door 17 is hinged on the left side of frame 16 and cabinet 10 and opens from the right side of frame 16 and cabinet 10. Rear door 17 can be closed and reopened wherein rear door 17 is hinged on the right side of frame 16 of cabinet 10 and rear door 17 opens from the left side of frame 16 of cabinet 10.

In this embodiment, frame 16 carries dual hinged front door 12 and dual hinged rear door 17. Side panels (not shown) are also provided to enclose cabinet 10. In this embodiment both front door 12 and rear door 17 are vented with a plurality of perforations or openings 19 positioned throughout (not shown) the central portion of outer surface or skin portion 21. These perforations 19 allow the doors to dissipate heat generated by the electrical equipment positioned within cabinet 10. Samples of such openings can be seen in later figures, for example, such as FIGS. 22-23. Similarly, side panels (not shown) can also be constructed with similar openings 19 to provide additional ventilation to cabinet 10. Likewise, ventilation can be provided in a top (not shown) to cabinet 10 and through the bottom of cabinet 10.

Figure 5:
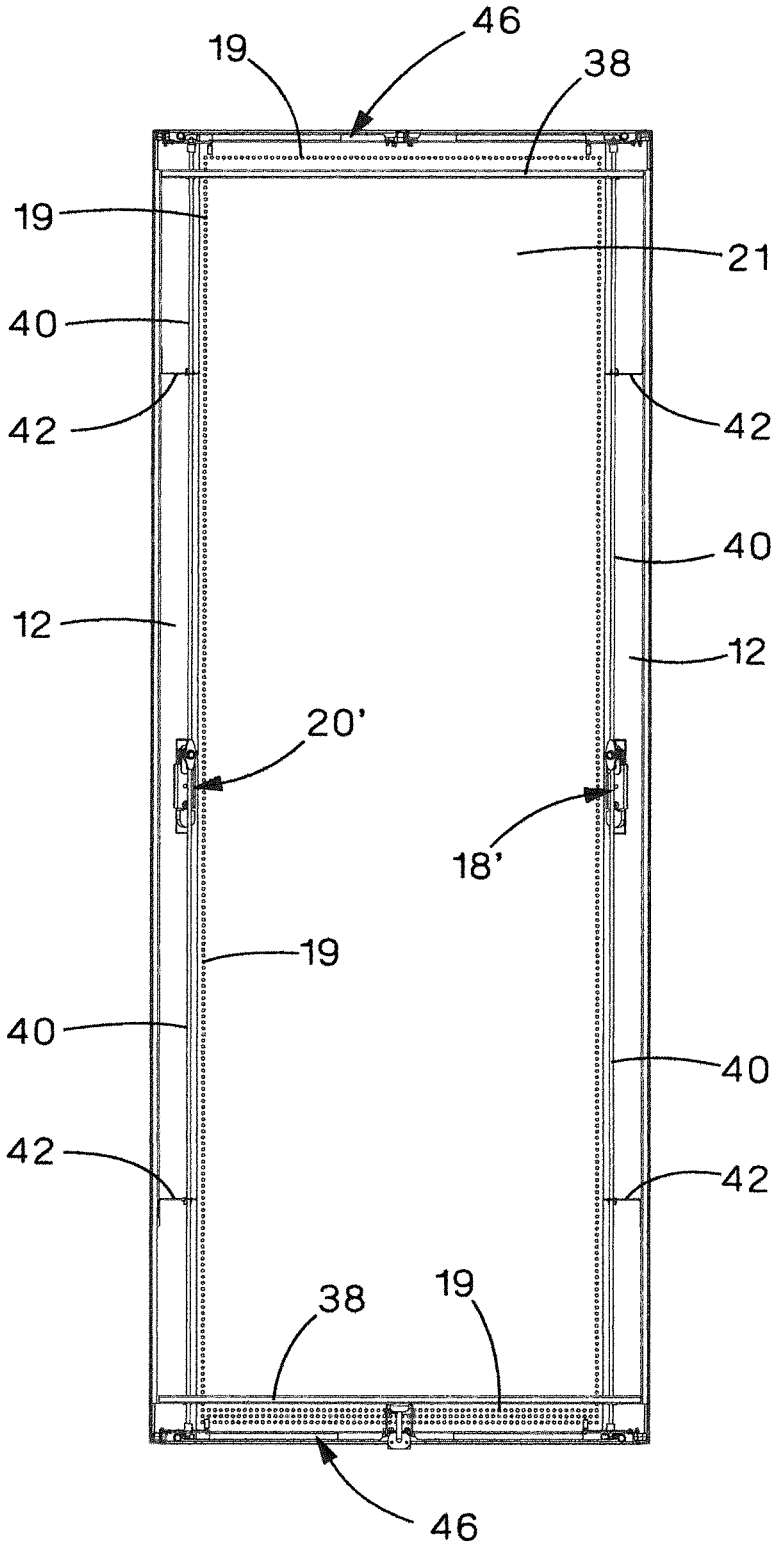
FIG. 5 is a back side elevation view of the front door as shown in FIG. 1 without the door secured to the frame of the cabinet frame.

In referring to FIG. 5, the back or rear side of front door 12 is shown without being attached to frame 16. The central portion of outer surface or skin portion 21 of front door 12, as discussed above, can be perforated with openings 19 throughout the skin portion 21. Front door 12, in this embodiment, is reinforced with door cross beam members 38 positioned across a top and bottom portions of front door 12 to provide structural integrity to front door 12. A portion of left handle assembly 18' and a portion of right handle assembly 20' are seen from the rear side or back side of front door 12. Handle assemblies 18' and 20' will be discussed later in more detail.

A pair of locking rods 40 are connected to each handle assembly 18' and 20'. From each assembly 18' and 20' a locking rod 40 extends toward the top of front door 12 and from each assembly 18' and 20' a locking rod 40 extends toward the bottom portion of front door 12. As will be discussed in more detail later, a pair of locking rods 40 associated with each handle assembly will selectively move together between an extended position relative to the handle assembly to which it is associated and a retracted position. Since each locking rod 40 spans from a mid portion of front door 12 to either the top or to bottom portion of front door 12, each locking rod 40 can be subjected to unwanted deflection with movement of the door which could result in locking rod shortening its span. A shortening of the span of locking rod 40 could remove locking rod 40 from a locked extended position to an unlocked position which could result in unintended disengagement or unlocking of locking rod 40. Bracket 42 has been connected to the rear side of front door 12 for each of the four locking rods 40, such that each bracket 42, engages a locking rod 40 at a central portion of its span and thereby minimizes undesired flexing of locking rod 40 in operation of the door. In this example, bracket 42 defines an opening 44 in which locking rod 40 can be restrained from flexing.

Referring to FIGS. 6-11, an interlocking assembly 46 will be described herein, will prevent users of network cabinet 10 which have dual hinged doors, from accidentally unhinging both sides of a door which could cause either damage, injury or both. The interlocking assembly to be described herein is located on a bottom portion of front door 12. The same interlocking assembly 46 is also positioned on the top portion of front door 12. Since this embodiment includes both front door 12 and rear door 17 as dual hinged doors, the same interlocking assembly 46 structure described herein will also be found also in both the top and bottom portions of rear door 17.

Figure 6:
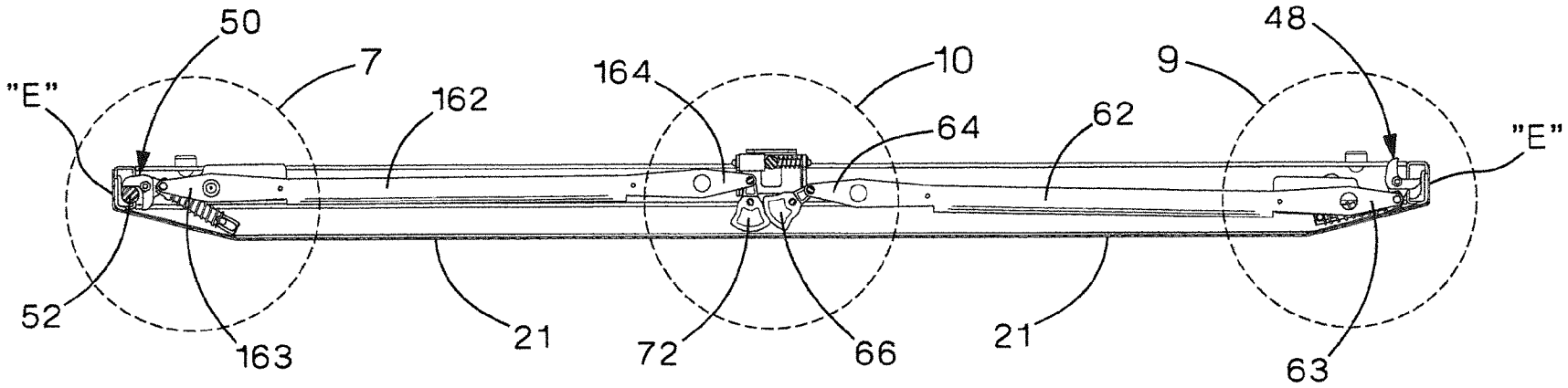
FIG. 6 is a top plan view of the interlocking assembly positioned at the bottom portion of the door shown along line 6-6 in FIG. 3 wherein the door is hinged to the left side of the frame of the cabinet and the right side of the door in an open position.
Figure 7:
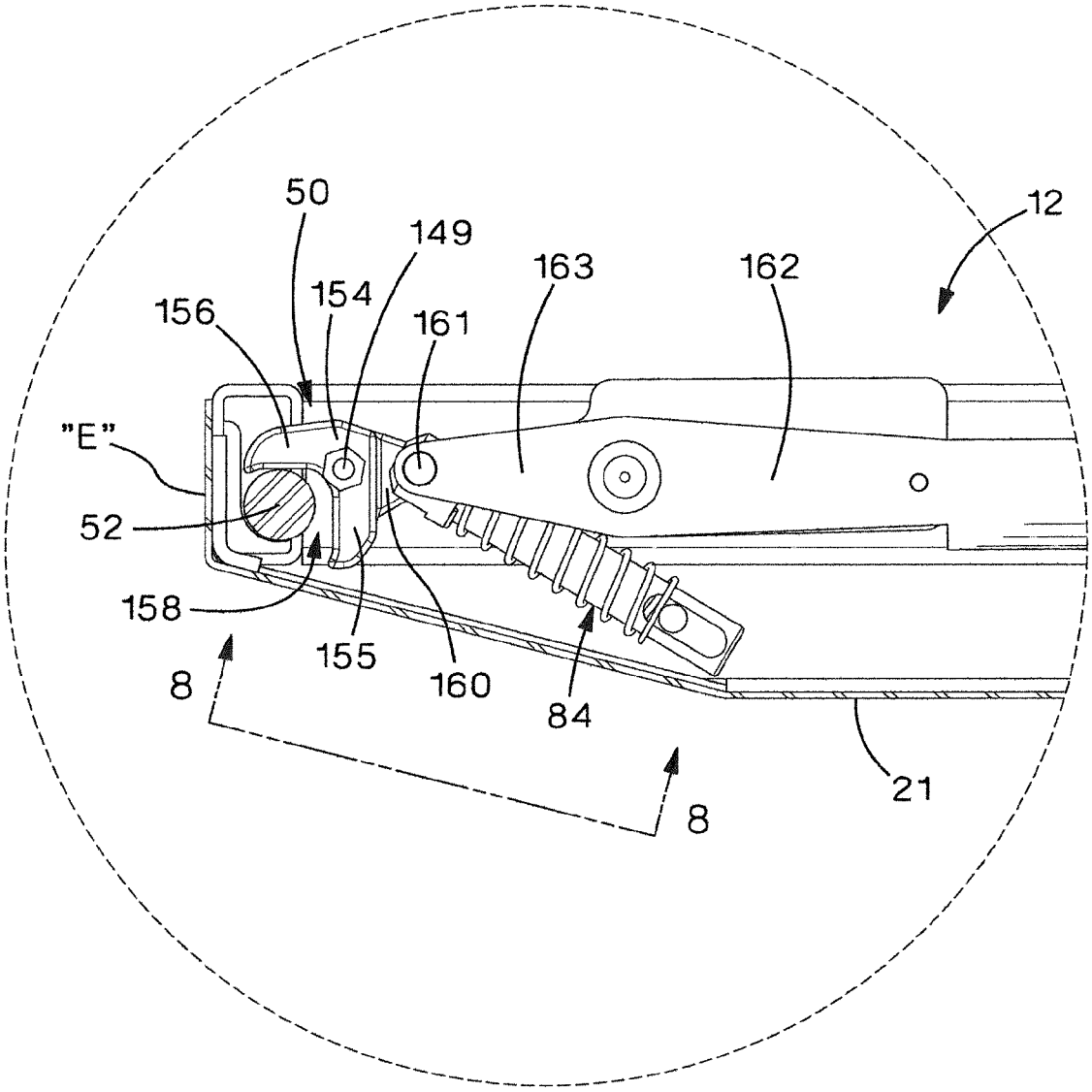
FIG. 7 is an enlarged view of a portion of the interlocking assembly as shown within circle designated as 7 in FIG. 6.
Figure 9:
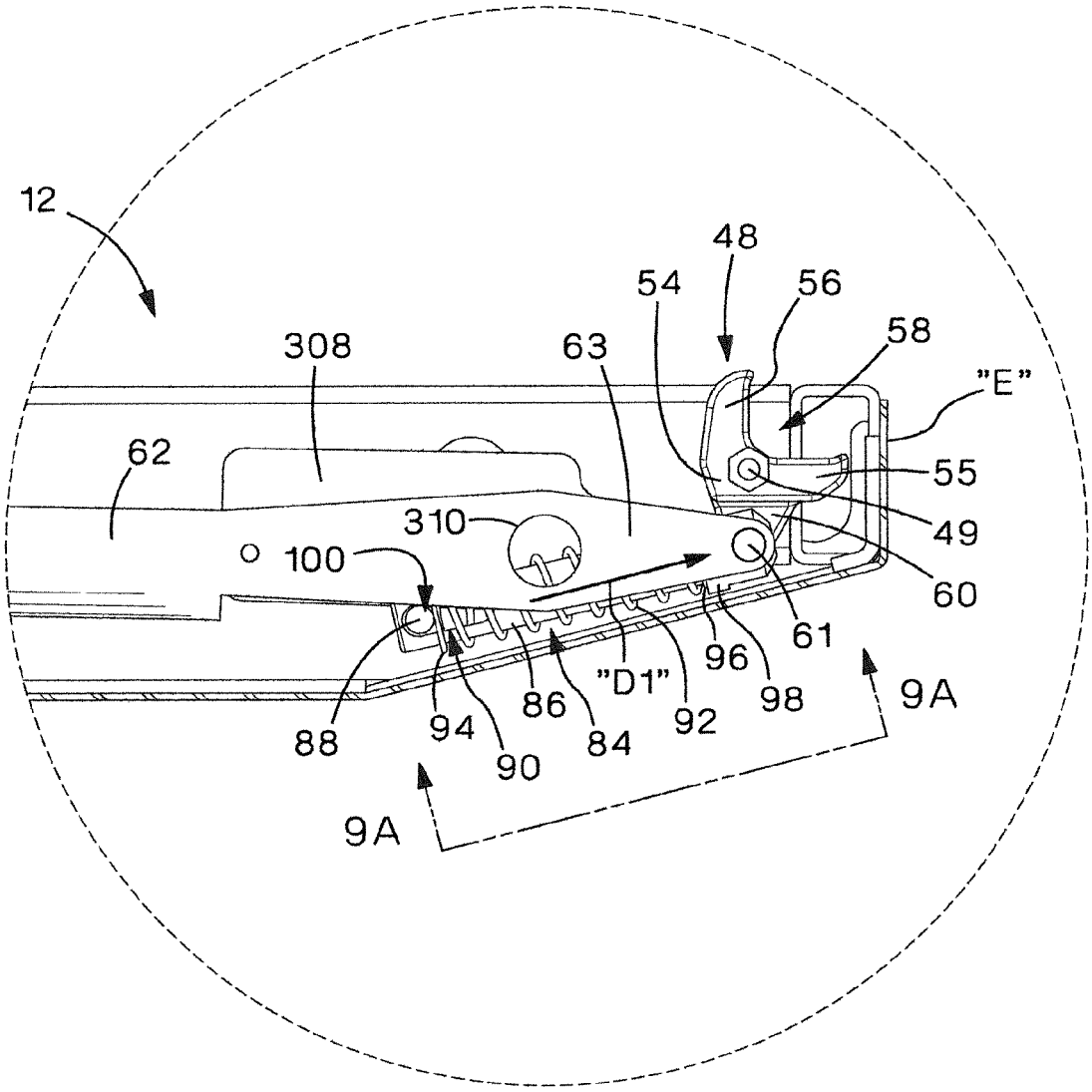
FIG. 9 is an enlarged view of a portion of the interlocking assembly as shown within circle designated as 9 in FIG. 7.
Figure 15:
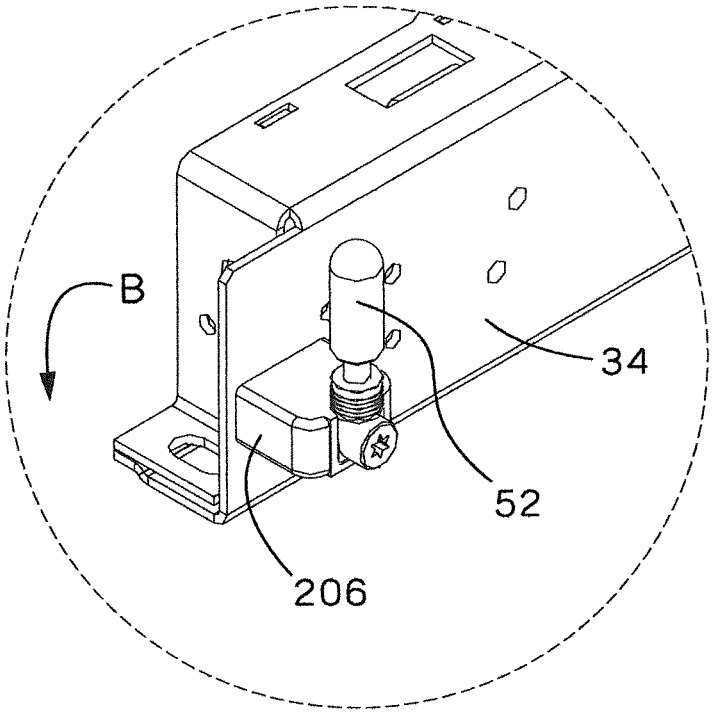
FIG. 15 is an enlarged view of that which is circled and designated as 15 in FIG. 14.
Figure 20:
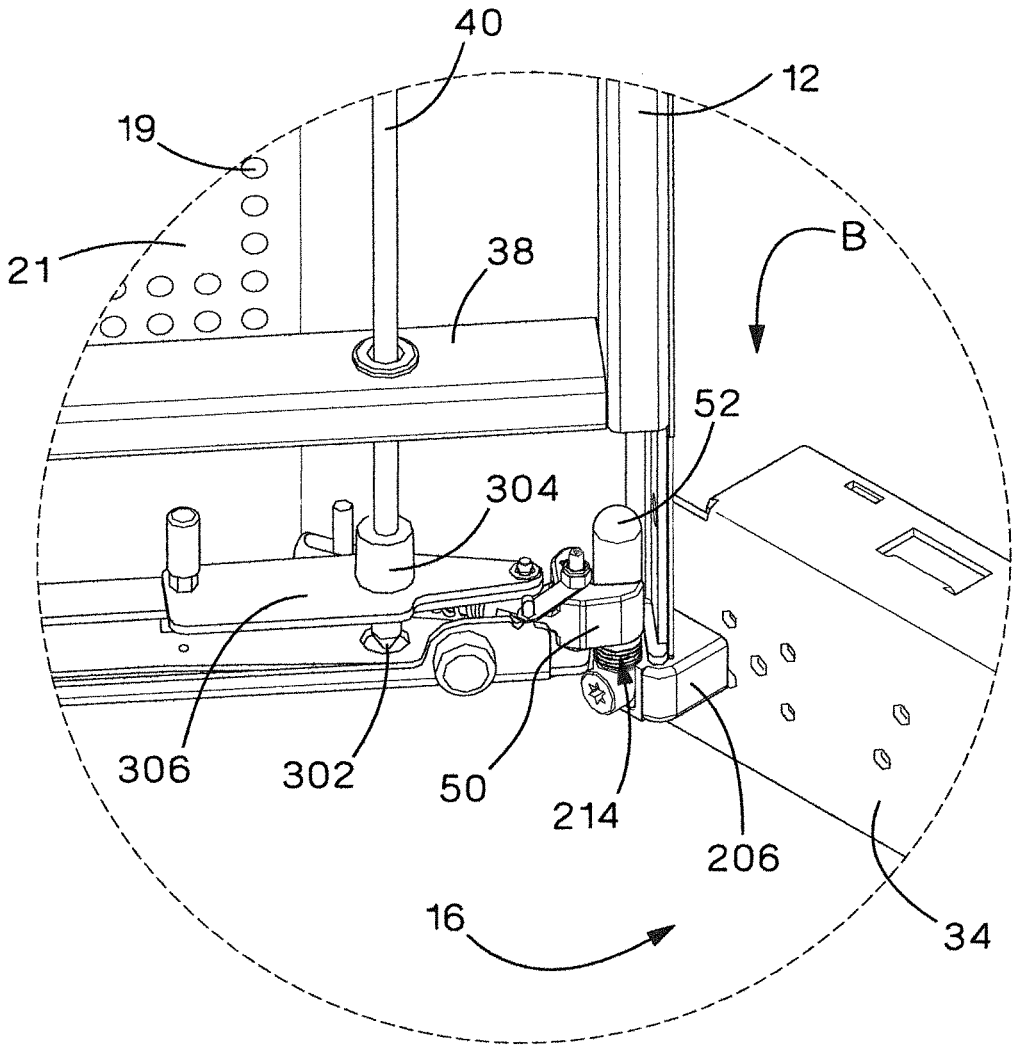
FIG. 20 is an enlarged view of that which is circled and designated as 20 in FIG. 3.

In referring to FIG. 6, interlocking assembly 46 includes first rotatable lower latch or first latch 48 positioned at a right side of front door 12 and second rotatable lower latch or second latch 50 positioned on the opposing left side of front door 12. As will be described in more detail later on, these rotatable latches rotate between open and closed positions relative to door 12. In looking at FIG. 3, the positions of latches 48 and 50 coincide with the position of front door 12 in FIG. 3. As can be seen in FIG. 3, the left side of front door 12 is hinged to frame 16. Second lower latch or second latch 50 is in a closed position engaging second lower hinge pin or hinge pin 52 as seen in FIGS. 6, 7, and 20. Second lower hinge pin 52, as seen in FIG. 15, is connected to and extends in an upward direction from a bottom portion "B" of frame 16, forming a hinge with second lower latch 50, as seen in FIGS. 6, 7 and 20. On the right side of front door 12, with that side of door 12 in an open position, first lower latch or first latch 48 has been rotated into an open or unhinged position, as seen in FIGS. 6 and 9. Without a hinge pin engaged within first lower latch 48, the right side of the door 12 is permitted to be in an opened position relative to frame 16 of cabinet 10. As will be described in more detail below, interlocking assembly 46 positioned at the top portion of front door 12 is constructed and operates in the same way as the interlocking assembly 46 positioned in a lower portion of door 12. As a result, one side of door 12 will be either hinged or unhinged.

Figure 19:
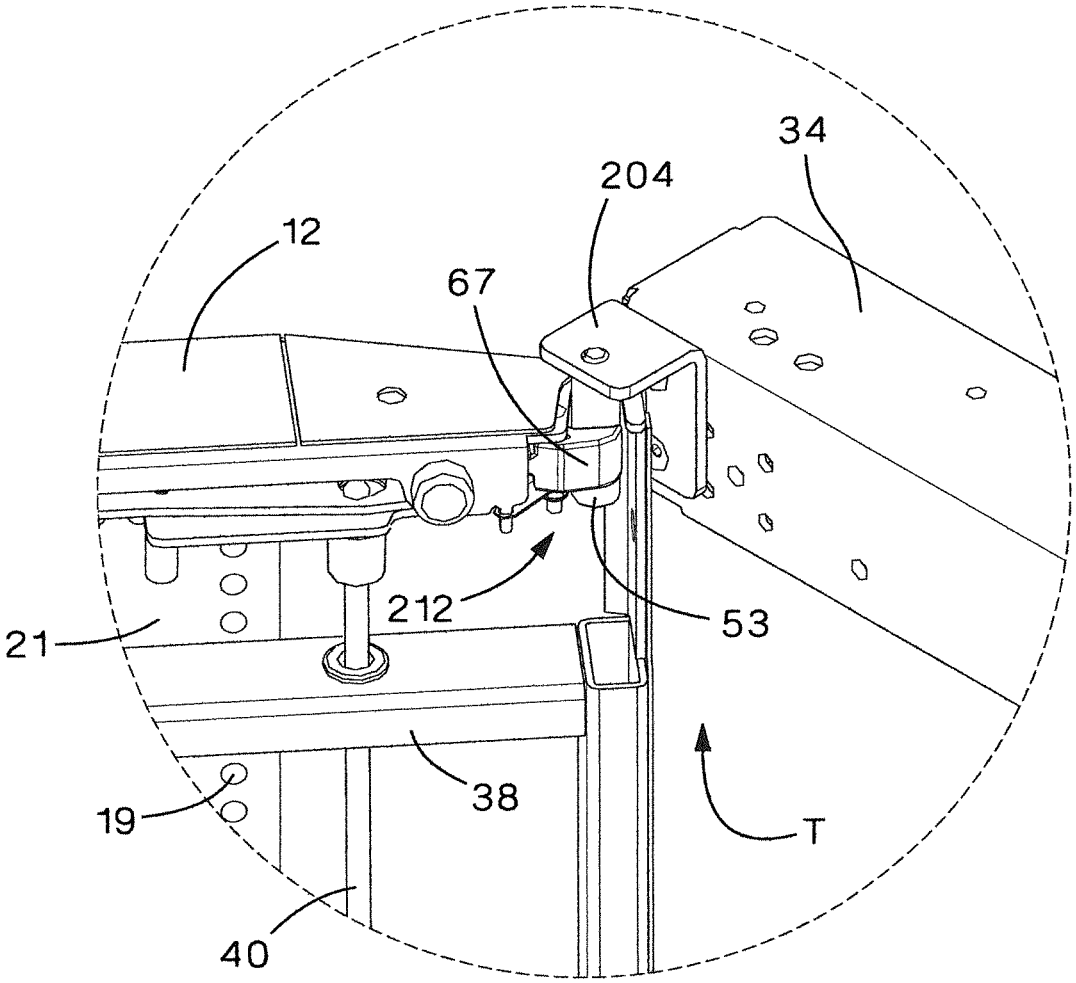
FIG. 19 is an enlarged view of that which is circled and designated as 19 in FIG. 3.

Further referring to FIG. 3, with the right side of front door 12 in an opened position, first lower latch 48 is in an open position relative to door 12, as seen in FIG. 9, as well as, first upper latch 65 is positioned in the same open position in interlocking assembly 46 positioned in the top portion of door 12. First upper latch 65 is positioned generally vertically and spaced apart above latch 48. First upper latch 65 can be generally seen in FIG. 17, however, in this figure first upper latch 65 is in a closed position. First upper latch 65 will be in the same open configuration as first lower latch 48 as seen in FIGS. 6 and 9 with door 12 opened on the fright side of frame 16. On the other or left side of door 12, second upper latch 67, as seen in FIG. 19, which is part of interlocking assembly 46 positioned on the top portion of door and is positioned on the left side of door 12. Second upper latch 67, shown in FIG. 20, is positioned on the same side of front door 12 as second lower latch 50. Both latches 50 and 67 have been rotated to a closed position relative to door 12 and form hinges with second lower hinge pin 52 and second upper hinge pin 53 respectively, as seen with door 12 in the hinged position shown in FIG. 3.

Since both front door 12 and rear door 17, in this embodiment, are both dual hinged doors that will have interlocking assemblies 46 positioned on both the top and bottom portions of each door, each door will have four latches, two on each the left and right sides of each door. As a result, both front portion "F" and rear portion "R" of frame 16, will need four hinge pins connected to each of front portion "F" and rear portion "R" of frame 16 to correspond to the four latches on each door, thereby being able to secure with hinges the right and left side of each door to frame 16.

Figure 12:
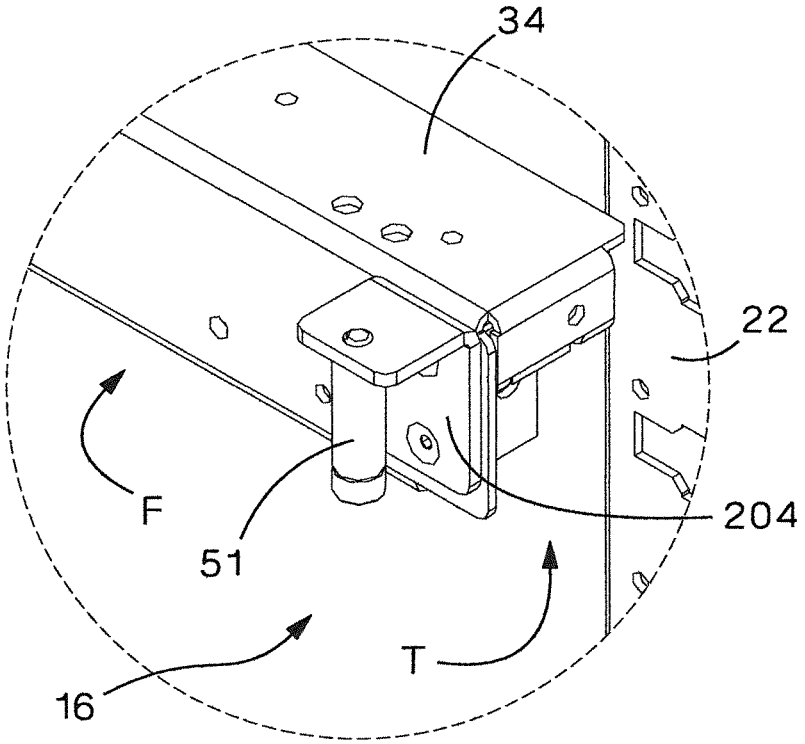
FIG. 12 is an enlarged view of that which is circled and designated as 12 in FIG. 3.
Figure 13:
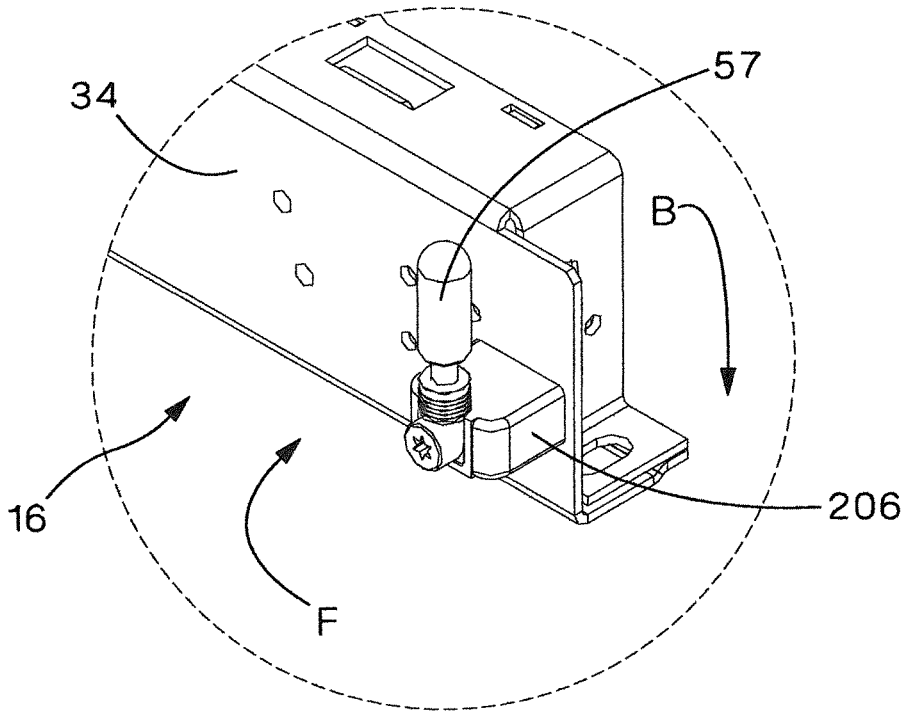
FIG. 13 is an enlarged view of that which is circled and designated as 13 in FIG. 3.
Figure 16:
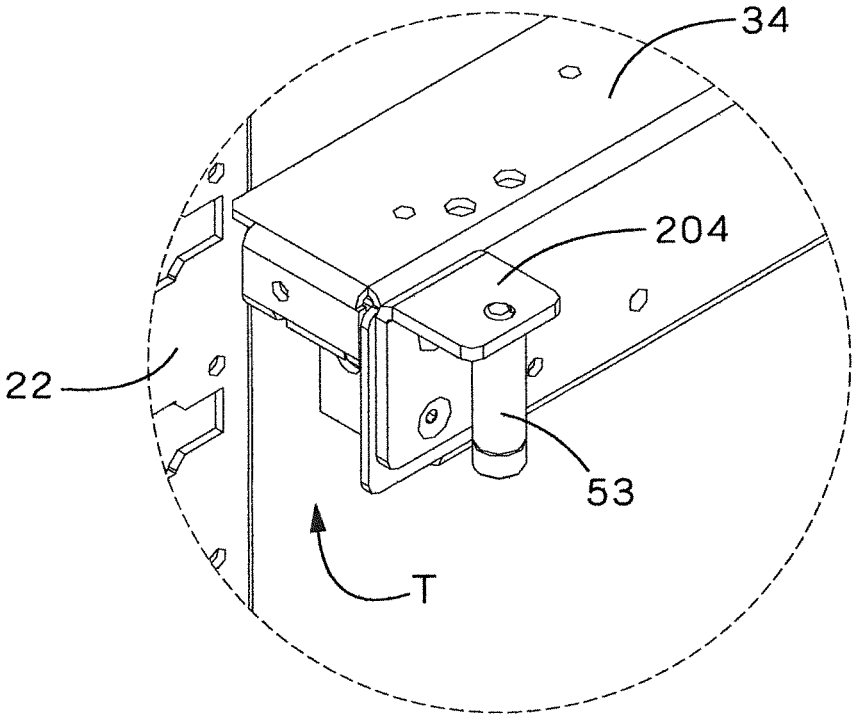
FIG. 16 is an enlarged view of that which is circled and designated as 16 in FIG. 14.

For purposes of this description, the four hinge pins 51, 52, 53 and 57, each is connected to front portion "F" of frame 16. The same arrangement is provided for rear portion "R" of frame 16. Second lower and second upper hinge pins 52 and 53, as seen in FIGS. 15 and 16 are connected to frame 16 on the left side portion of frame 16 and are in vertical alignment with one another. Second upper hinge pin 53 is positioned on top portion "T" of frame 16 and second lower hinge pin 52 is positioned on bottom portion "B" of frame 16. The other two hinge pins, first lower hinge pin 57, as seen in FIG. 13, and first upper hinge pin 51, as seen in FIG. 12, are positioned on the right side portion of frame 16 and are vertically aligned with one another with first upper hinge pin 51 secured to top portion "T" and another hinge pin or first lower hinge pin 57 is secured on bottom portion "B" of frame 16.

The hinge pins on the left side of frame 16 align and interact with the latches positioned on the left side of the door that are in interlocking assembly 46 positioned on the top and the bottom of door 12. Hinge pins on the right side of frame 16 align and interact with the latches positioned on the right side of the door that are in interlocking assembly 46 positioned on the top and the bottom of door 12. The hinge pins assist in moving the latches they engage from an open position to a closed position and from a closed position to an open position. This will be described in more detail below with respect to first lower latch 48 and second lower latch 50 and the same will apply to the other latch on the same side of the door, first upper latch 65 and second upper latch 67 respectively. It will be appreciated that the latches on one side of door 12 will be rotated between open and closed positions relative to the door by the hinge pins they align with and engage on that side of the door. With the latch rotated to a closed position, it forms a hinge with the pin it has engaged. Then with moving that side of the door away from frame 16, as the door opens on that side hinge pins on that side of frame 16 urge latches on door 12 on that corresponding side to an open position. With returning that side of the door to a closed position, the latches engage the hinge pins and the hinge pins causes the latches to rotate to a closed position, again forming the hinges. This sequence of the operation of the hinges and pins work in the same way on both sides of the door.

Figure 8:
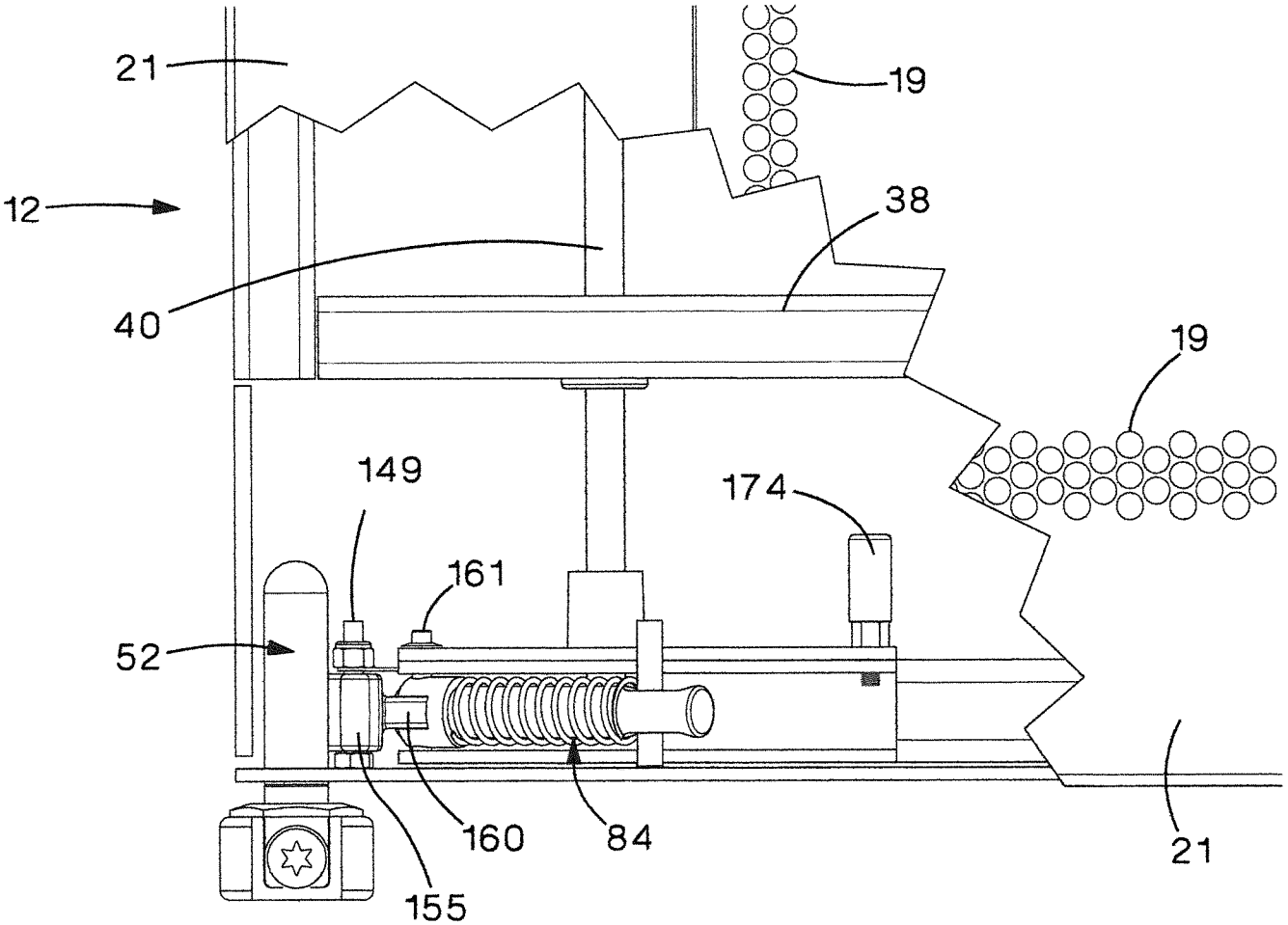
FIG. 8 is a partial broken away elevation view as viewed along line 8-8 as shown in FIG. 7 with the front skin portion of the door partially broken away.
Figure 9A:
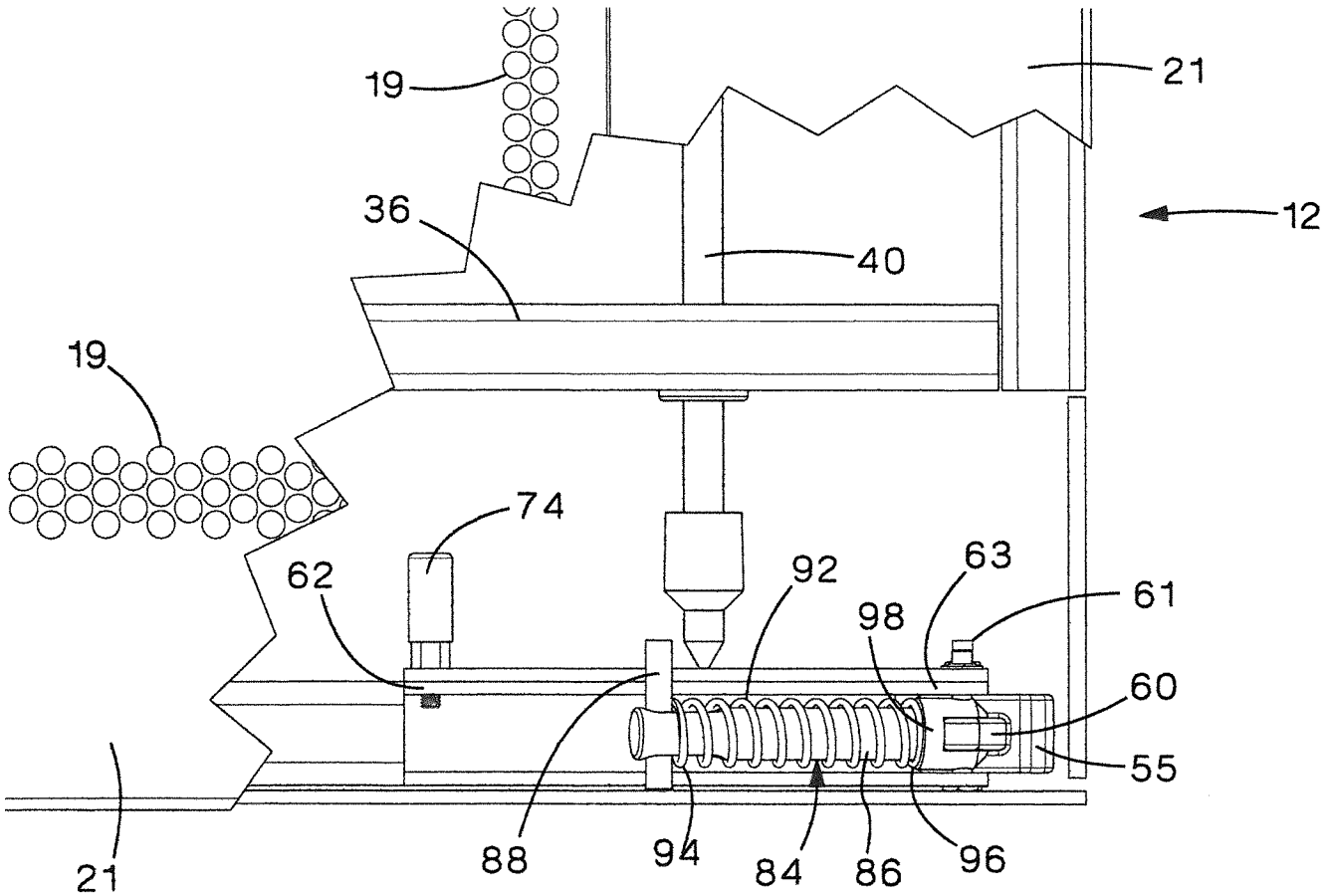
FIG. 9A is an elevation view of a partial cut away view taken along line 9A-9A in FIG. 9.
Figure 9B:
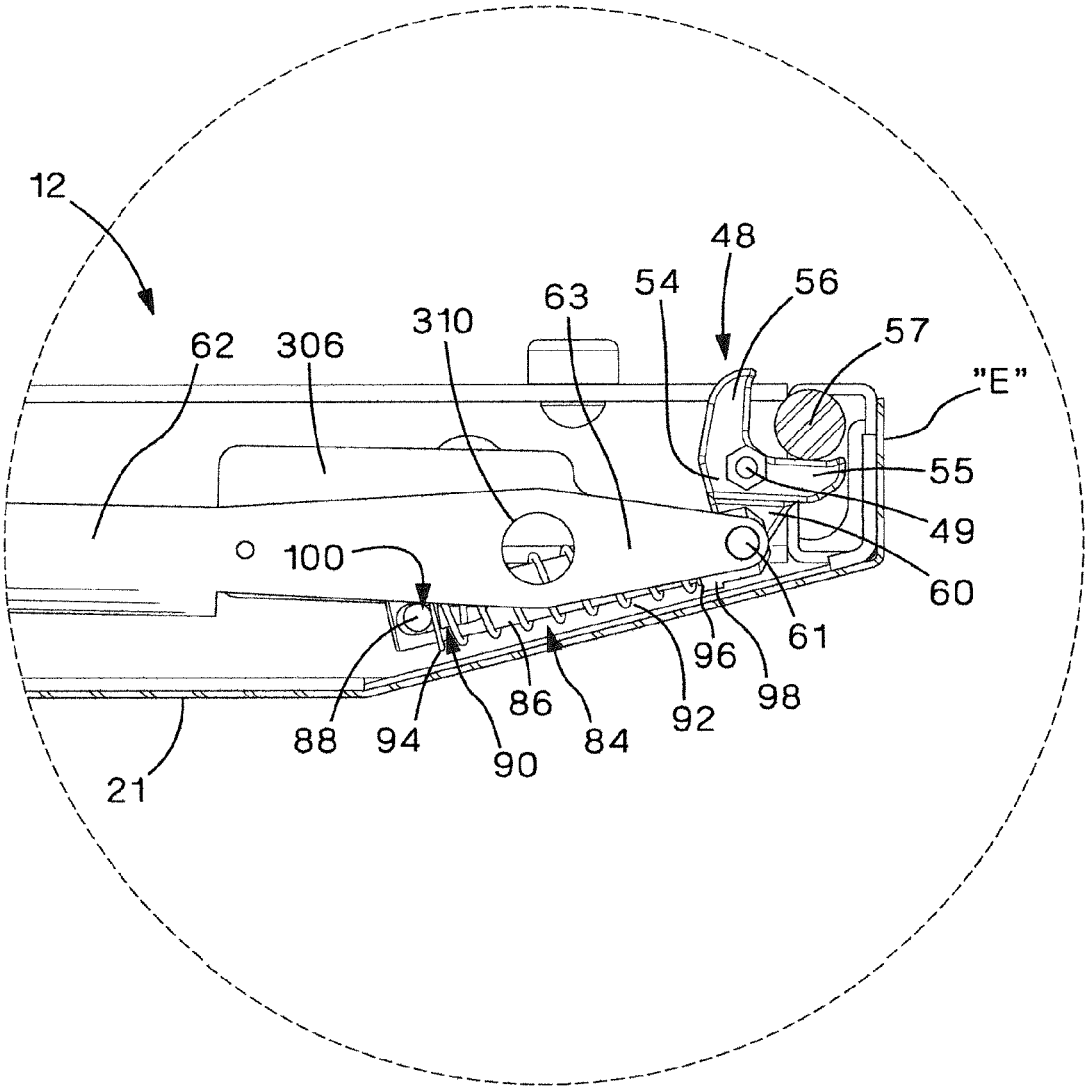
FIG. 9B is the view of FIG. 9 with the door being moved toward a closed position wherein the first latch is initially engaging a hinge pin of the cabinet frame.
Figure 9C:
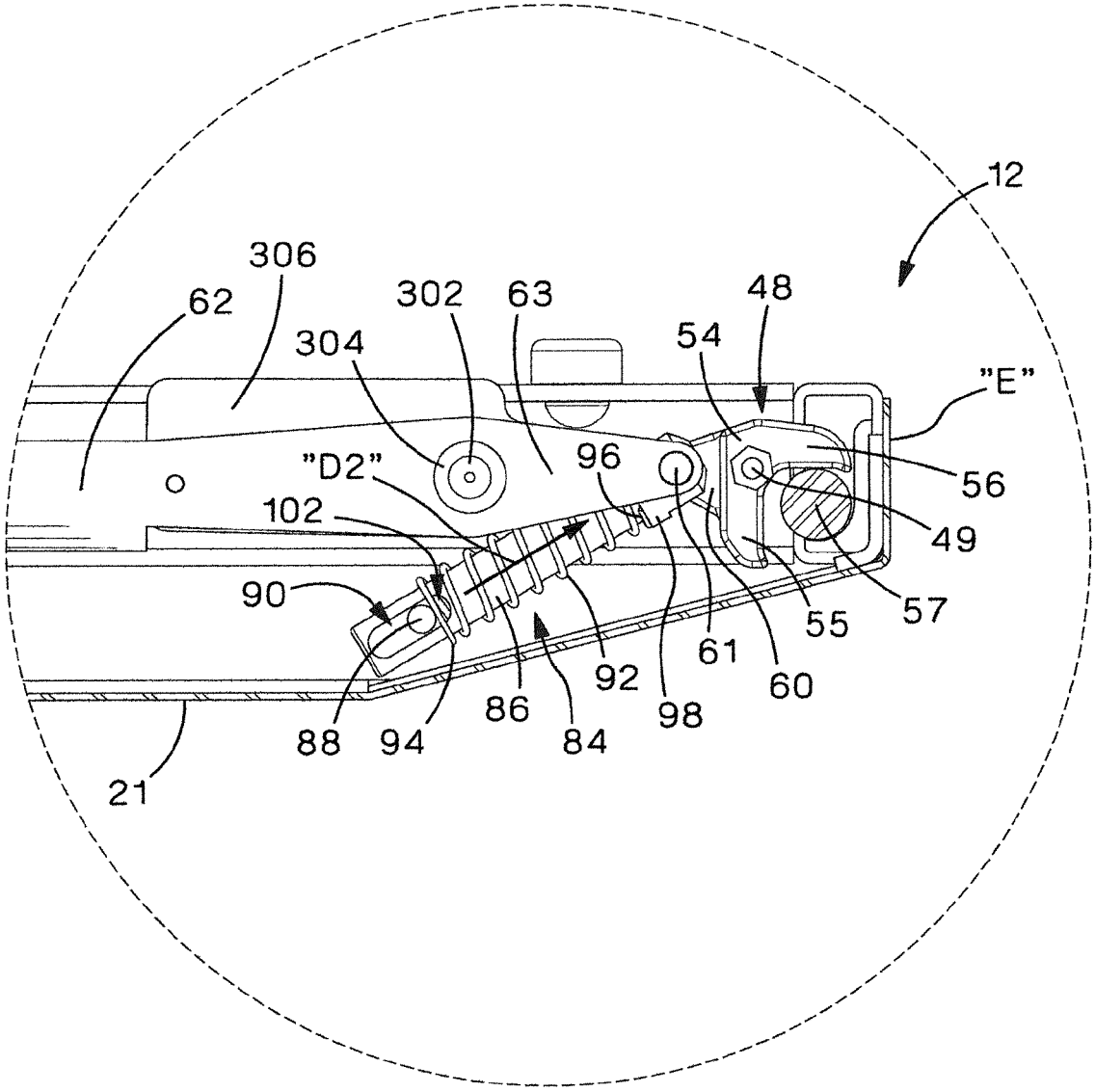
FIG. 9C is the view of FIG. 9B with the door moved to a closed position with first latch in a closed position.

In referring to interlocking assembly 46 seen in FIGS. 6-11, first latch or first lower latch 48 is secured to and rotatable relative to front door 12 between an open position shown in FIG. 9, and closed position, as seen in FIG. 9C. First lower latch 48, as seen in FIGS. 9-9C comprises base 54 with two spaced apart arms 55, 56 which extend from base 54 and define a space 58 positioned between arms 55, 56 for receiving a hinge pin or first lower hinge pin 57, as seen in FIG. 9B which is aligned to engage first lower latch 48 with door 12 moved toward a closed position. In this embodiment, first latch 48 is secured to front door 12 with pin connector 49 that is affixed to front door 12, such that first latch 48 is only movable relative to door 12 by rotation about pin connector 49. As a result, pin connector 49 forms an axis of rotation for first latch 48 in a fixed location relative to door 12, about which first latch 48 rotates between open and closed positions relative to door 12 as seen in FIGS. 9 and 9C.

Cam arm 60 is affixed to first latch 48 and, in this example, is integrally formed with first latch 48 and extends from first latch 48. A first portion 63 of first latch linkage arm 62 is rotatably connected to cam arm 60 with second pin connector 61. First latch linkage arm 62 and cam arm 60 can rotate about an axis of rotation formed by second pin connector 61. Since second pin connector 61 is not affixed to door 12, the axis of rotation formed by second pin connector 61 is movable relative to front door 12. The fixed axis of rotation of the first latch 48 and the movable axis of rotation between the cam arm 60 and first latch linkage arm 62 are spaced apart from one another.

Figure 10:
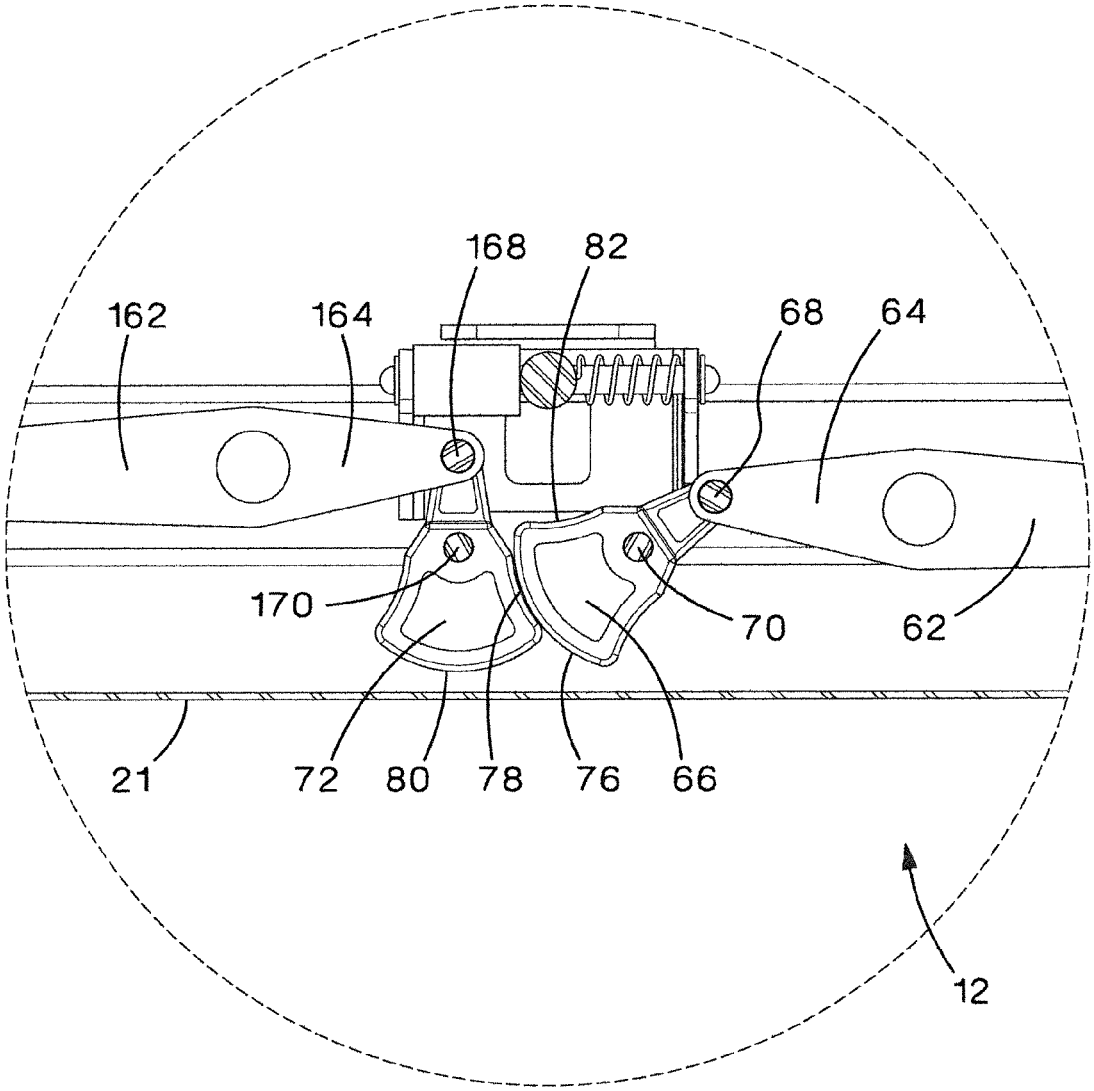
FIG. 10 is an enlarged view of the interference members of the interlocking assembly as seen within circle designated 10 in FIG. 6 wherein a first latch is in an open position and the second latch is in a closed.
Figure 11:
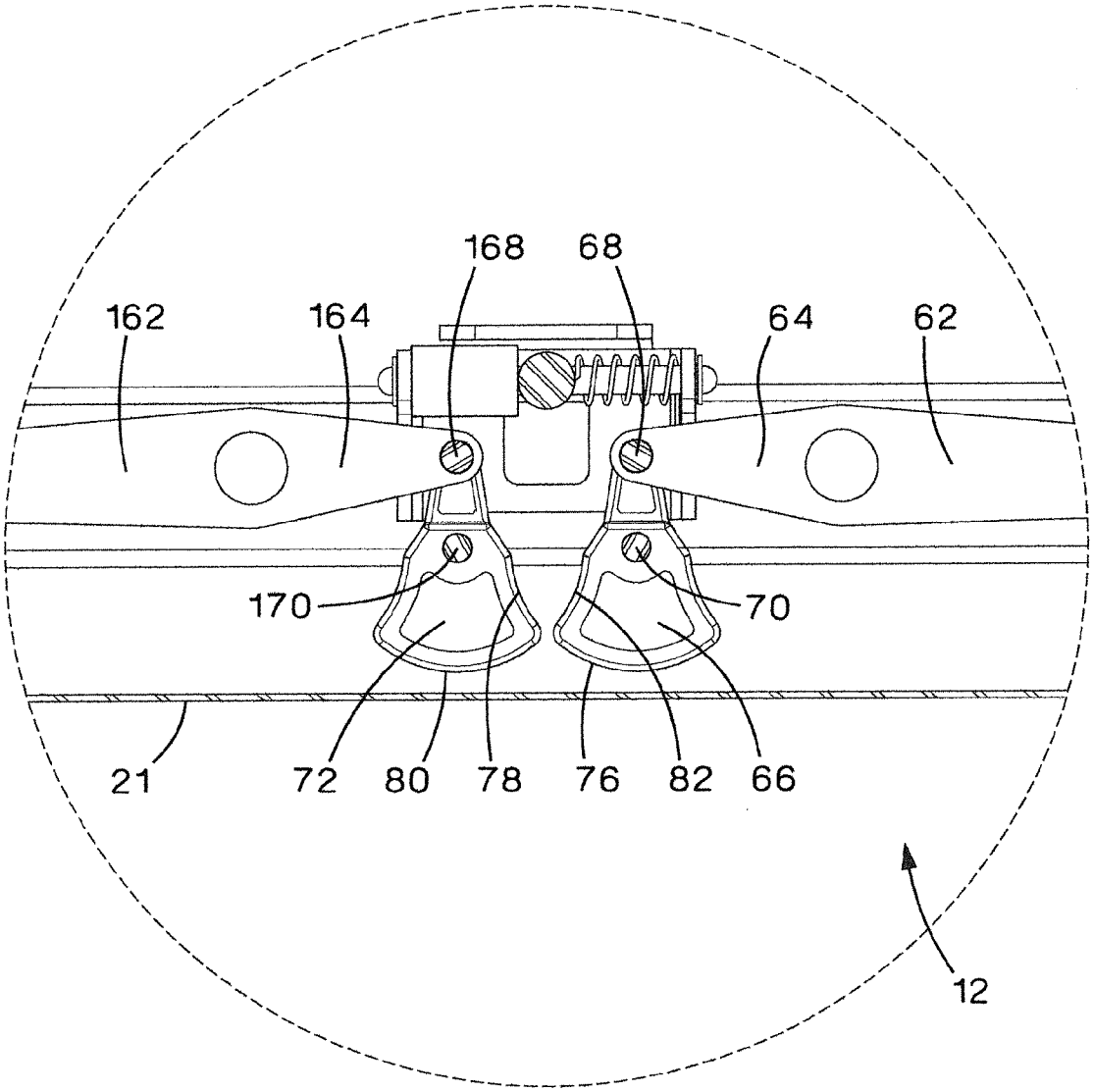
FIG. 11 is the view of FIG. 10 showing the position of the interference members with the first and second latches both in a closed position.

Spaced apart from first portion 63 of first latch linkage arm 62 is second portion 64 of first latch linkage arm 62 is rotatably connected to first interference member 66 with third pin connector 68, as seen in FIGS. 6, 10 and 11. Third pin connector 68 permits rotational movement between first latch linkage arm 62 and first interference member 66 and without third pin connector 68 being affixed to front door 12, an axis of rotation formed by third pin connector 68 is movable relative to door 12. First interference member 66 is rotatably secured to door 12 with a fourth pin connector 70 wherein the fourth pin connector 70 is affixed to door 12 permitting first interference member 66 to rotate about a fixed axis of rotation formed by the fourth pin connector 70. The axis of rotation formed by the third pin connector 68 is positioned spaced apart from the axis of rotation of the fourth pin connector 70. Thus, with first lower latch 48 positioned in an open position as seen in FIG. 9, cam arm 60 positions first latch linkage arm 62 in a retracted position such that first portion 63 positioned proximate to end portion "E" of door 12. With first latch linkage arm 62 in the retracted position first interference member 66 is positioned in blocking relationship to a path of rotation of second interference member 72, as seen in FIG. 10 and which will be discussed in more detail herein.

With first lower latch 48 in an open position as seen in FIG. 9 and first upper latch 65 is also in an open position, door 12 on the right side of frame 16 is in an open position. As door 12 is moved toward a closed position, as seen in FIG. 9B, first lower latch 48 is moved toward first lower hinge pin 57 and lower hinge pin 57 is received in space 58 between arms 55 and 56 of first latch member 48. As door 12 is further moved from the position shown in FIG. 9B to a closed position as seen in FIG. 9C, arm 55 is pushed up against stationary first lower hinge pin 57 causing first latch 48 to rotate about pin connector 49 to a closed position in FIG. 9C. With the rotation of first latch 48, cam arm 60 rotates about pin connector 49 and pushes against first latch linkage arm 62 and moves first latch linkage arm 62 from the retracted position as seen in FIG. 9B to an extended position as seen in FIG. 9C. The extended position of first latch linking arm 62 is a position relative to a retracted position, which is seen in FIG. 9. In the extended position first portion 63 is positioned further away from end portion "E" of door 12 than is the retracted position where first portion 63 is positioned closer to end portion "E". Movement of first latch linkage arm 62 from the retracted position to the extended position rotates first interference member 66 from a blocking position with respect to second interference member 72, as seen in FIG. 10, to a non-blocking relationship with the second interference member 72 as seen in FIG. 11. Thus, with first latch member 48 reaching a closed position and door 12 is closed, first and second interference members 66 and 72 which are positioned adjacent to one another and are positioned in non-blocking relationship with one another, as seen in FIG. 11 with second lower latch 50 also in a closed position. This will be more fully discussed below.

With respect to opening door 12 from a closed position with first lower latch 48 in a closed position, as seen in FIG. 9C, door 12 is urged away from frame 16 on the side of the door first lower latch 48 is located. With hinge pin 57 positioned in the path of movement of arm 56 of first latch 48 and as door 12 is urged to an open position, arm 56 and first latch 48 begin to rotate about pin connector 49 to an open position in FIG. 9. Cam arm 60 rotates about pin connector 49 moving first latch linkage arm 62 from an extended position in FIG. 9C to a retracted position as seen in FIG. 9. This movement of first latch linkage arm 62 results in rotation of first interference member 66 from a non-blocking relationship with respect to second interference member 72 as seen in FIG. 11 to a blocking relationship with second interference member 72 as seen in FIG. 10. With door 12 moved to an open position, first latch 48 is in an open position as seen in FIG. 9. Thus, as door 12 moves back from this open position, seen in FIG. 9, to a closed position as seen in FIG. 9C, first lower latch 48 is pushed by hinge pin 57 and moves latch 48 from an open to a closed position resulting in first interference member 66 rotating from a blocking relationship, as seen in FIG. 10, to a non-blocking relationship with respect to second interference member 72 as seen in FIG. 11.

Because the interlocking assembly 46 positioned at the top portion of door 12 is the same as that described above for the interlocking assembly positioned on the lower portion of door 12, corresponding first upper latch 65 interacts with first upper pin 61 in the interlocking assembly 46 positioned at the top portion of door 12 in the same way as the above described first lower latch 48 interacts with first lower hinge pin 57. The result in the upper interlocking assembly 46 is also the same as the lower interlocking assembly 46 with the positioning a first interference member in blocking and non-blocking relationship with respect to the second interference member.

On the second or opposite side of door 12 from first lower latch 48, in this instance, the left side of front door 12, interlocking assembly 46 is structured the same as the right side of interlocking assembly that has been described above. In referring to interlocking assembly 46 shown in FIGS. 6, 7 and 8, second lower latch 50 is secured to and rotatable relative to front door 12 between a closed position as shown in FIG. 7 and an open position as does first lower latch 48, seen in FIG. 9, relative to door 12. Second lower latch 50 comprises base 154 with two spaced apart arms 155, 156 which extend from base 154 and define a space 158 positioned between arms 155, 156 for receiving other hinge pin 52 connected to frame 16. In this embodiment, second latch 50 is secured to front door 12 with pin connector 149 that is affixed to front door 12, such that second latch 50 is only movable by rotation about pin connector 149. As a result, pin connector 149 forms an axis of rotation for second latch 50 in a fixed location relative to door 12.

Second cam arm 160 is affixed to second latch 50 and, in this example, is integrally formed with second latch 50 and extends from second latch 50. A first portion 163 of second latch linkage arm 162 is rotatably connected to second cam arm 160 with second pin connector 161. Second latch linkage arm 162 and second cam arm 60 can rotate about an axis of rotation formed by second pin connector 161. Since second pin connector 161 is not affixed to door 12, the axis of rotation formed by second pin connector 161 is movable relative to front door 12. The fixed axis of rotation of the second latch 50 and the movable axis of rotation between the second cam arm 60 and second latch linkage arm 62 are spaced apart from one another.

Spaced apart from first portion 163 of second latch linkage arm 162 is second portion 164 is rotatably connected to second interference member 166 with third pin connector 168, as seen in FIGS. 6, 7 and 8. Third pin connector 168 permits rotational movement between second latch linkage arm 162 and second interference member 72 and without third pin connector 168 being affixed to front door 12, an axis of rotation formed by third pin connector 168 is movable relative to door 12. Second interference member 72 is rotatably secured to door 12 with a fourth pin connector 170 wherein the fourth pin connector 170 is affixed to door 12 permitting second interference member 72 to rotate about a fixed axis of rotation formed by the fourth pin connector 170. The axis of rotation formed by the third pin connector 168 is positioned spaced apart from the axis of rotation of the fourth pin connector 170. Thus, with second lower latch 50 positioned in a closed position as seen in FIGS. 7 and 8, second cam arm 158 positions second linkage arm 162 in an extended position as seen in FIGS. 6-8, such that second linkage arm 162 positions second interference member 72 in a non-blocking relationship with respect to first interference member 66, as seen in FIG. 11. It should be understood that the structure of interlocking assembly 46 positioned on the top portion of door 12 in the same left side of door 12 as second lower latch 50, includes second upper latch 67 and second upper hinge pin 53 and is structured and operates the same as the interlocking assembly 46 as described for second lower latch 50 and second lower hinge pin 52.

When a user chooses to open door 12 from the side of door 12 wherein second lower latch 50 is positioned, second lower latch 50 starts in a closed position as seen in FIG. 7. With the door moved to an open position, as seen in FIG. 14. So long as first lower latch 48 is in a closed position as shown in FIG. 9C, door 12 from the side in which second lower latch 50 is positioned, can be pulled away from frame 16. With first lower latch 48 in a closed position, first interference member 66 is in a non-blocking position, out of path of rotation of second interference member 72, as seen in FIG. 11. Thus, the left side of door 12 can be urged away from frame 16 causing arm 156 to be pushed by hinge pin 52 rotating second lower latch 50 about pin connector 149. Rotation of second latch 50 causes second cam arm 160 to rotate about pin connector 149 thereby moving into an open position and moving second latch linkage arm 162 from its extended position as seen in FIG. 7 to a retracted position similar to a retracted position of first latch linkage arm 62 as seen in FIG. 9. With first interference member 66 positioned outside the path of rotation and in a non-blocking relationship with second interference member 72 as seen in FIG. 11, movement of second latch arm 162 to a retracted position with second lower latch 50 moving to an open position, second interference member 72 is rotated to into a blocking relationship with first interference member 66 (not shown). Thus, with second interference member 72 rotated toward first interference member 66, first interference member 66 is blocked from being able to rotate toward second interference member 72. Without interference member 66 being able to rotate toward second interference member 72, first lower latch 48 will not be able to be moved to an open position. Such arrangement prevents accidental opening of first latch 48 with second latch 50 now in an open position.

As discussed earlier, with first lower latch 48 in an open position as seen in FIG. 9 and second lower latch 50 positioned in a closed position as seen in FIG. 7, first interference member 66 is positioned in the path of rotation or blocking relationship with second interference member 72, as seen in FIG. 10. With first interference member 66 in blocking relationship to rotation of second interference member 72, and in this embodiment abutting second interference member 72, second interference member 72 is not permitted to rotate as would otherwise be required with opening of second latch 50. Thus, second lower latch 50, as seen in FIG. 7, cannot be opened with first lower latch 48 already in an open position, as seen in FIG. 9. Thus, the opposite orientation of latches 48 and 50 wherein second latch 50 is in an open position, second interference member 72 is then positioned in the path of rotation of first interference member 66. Thus with second lower latch 50 in an open position, first lower latch 48 cannot be moved from a closed position, as seen in FIG. 9C, to an open position as seen in FIG. 9 which would otherwise require first interference member 66 to rotate toward second interference member 72. As can be appreciated, interlocking assembly 46 permits only latches positioned on one side of door 12 to be opened at a time and will not permit latches to be opened on opposing left and right sides of door 12 at the same time. An override is provided should a door need to be completely removed. Handle 74 and 174 which are connected to first and second latch linkage arms 62 and 162 respectively, as seen in FIGS. 9A and 8 respectively. The user can be grasp handle 74 and urge first lower latch to an open position and could grasp handle 174 and urge second lower latch 50 to an open position.

In referring to FIGS. 10 and 11, in this embodiment, first interference member 66 comprises convex surface 76 and second interference member 72 comprises concave surface 78. With first interference member 66 positioned in a path of rotation of second interference member 72, as seen in FIG. 10, convex surface 76 is positioned within concave surface 78. This configuration in this embodiment places first interference member 66 in abutting relationship with second interference member 72. This arrangement permits first interference member 66 to move smoothly in relationship to second interference member 72 and provide a secure blocking position with respect to second interference member 72 without permitting undesired movement of second interference member 72 with first interference member 66 in blocking position. Similarly, second interference member 72 comprises convex surface 80 and first interference member 66 comprises concave surface 82 such that convex surface 80 is positioned within concave surface 82 with second interference member positioned within the path of rotation of the first interference member 66. This arrangement of this embodiment also places second interference member in abutting relationship with respect to first interference member 66 with second interference member 72 in blocking relationship to first interference member 66. Second interference member 72 positioned in blocking relationship with first interference member 66 is not shown, however, that configuration is well understood in referring to FIG. 10 wherein the opposite orientation is shown with first interference member 66 is in blocking relationship to second interference member 72. This arrangement permits second interference member 72 to move smoothly in relationship to first interference member 66 and provide a secure blocking position with respect to first interference member 66 without permitting undesired movement of first interference member 66 with second interference member 72 in blocking position.

In referring to FIGS. 6-9C, push rod 84 urges latches in interlocking assembly 46. Push rod 84 will urge a latch in a direction to maintain the latch in an open position, with the latch being in an open position and in another direction to maintain the latch in a closed position with the latch positioned in a closed position. Push rod 84 is constructed in the same way with each latch and for purposes of describing push rod 84 herein, push rod associated with first lower latch 48 will be described.

Push rod 84 comprises rod member 86 that is rotatably mounted to door 12. In this embodiment, rod member 86 is rotatably connected to second pin connector 61 wherein push rod 84 and cam arm 60 are in rotational relationship about second pin connector 61. Spaced apart from this rotation connection 61 push rod 84 is mounted to door 12 for rotational and translational movement relative to door 12. Pin 88 is affixed to door 12 and is positioned within slot 90 defined in rod member 86 such that push rod 84 is rotatable around pin 88 and push rod is movable in a linear direction relative to pin 88 with pin 88 moveable within slot 90.

Push rod 84 further comprises spring 92 positioned along rod member 86 such that one end 94 abuts pin 88 and opposing end 96 abuts collar member 98 positioned on rod member 86. Spring 92 is positioned between one end 94 and opposing end 96 such that spring 92 maintains a compression position as the cam arm 60 rotates with first lower latch 48 between open and closed positions, as seen in FIGS. 9-9C. With the first lower latch member 48 in an opened position, a seen in FIG. 9, push rod 84 exerts a force in a first direction "D1" on cam arm 60 maintaining first latch 48 in an open position, as seen in FIG. 9. In this configuration, pin 88 is positioned in a back portion 100 of slot 90, spring 92 is still in compression and first latch linkage arm 62 positions first interference member 66 in the path of rotation of second interference member 72. With arm 55 of first lower latch member 48 engaging hinge pin 57, as seen in FIG. 9B, first latch 48 rotates to a closed position as door 12 is urged to a closed position, as seen in FIG. 9C. With first lower latch 48 positioned in a closed position as seen in FIG. 9C, push rod 84 exerts a force on the cam arm 60 in a second direction "D2" maintaining the first lower latch 48 in the closed position and maintains first interference member 66 in a position out of the path of rotation of second interference member 72, as seen in FIG. 11. In this configuration, pin 88 is positioned in a forward position 102 in slot 90 as seen in FIG. 9C and spring 92 is still in a compression configuration.

Now in referring to FIGS. 12-30, an assembly for lifting and supporting a network cabinet door is shown. This assembly may be used with a single hinged door and as described in the embodiment herein, it will be applied to a double hinged door as well. Network cabinet 10 as seen in FIGS. 1-4, include dual hinged doors 12 and 17 as described earlier. Front door 12 will be referred to for purposes of this description, however, the same will apply to dual hinged rear door 17 as well. Door 12 because of its weight, size and at times fabrication tolerances in hinges that support door 12, door 12 can sag with door 12 in an open position. In this instance door 12 can be opened from a right side and hinged on the left side as seen in FIG. 3 and can be opened from the left side and hinged on the right side as seen in FIG. 14.

With door 12 in an open position, door 12 will be supported on only one side of door 12 and will be subjected to sagging. With door 12 in a sagging position, the user at times will be required to lift door 12 relative to frame 16 in order to properly align latches and corresponding hinge pins on the open side of the door so as to close the door properly.

Door lifting assembly 200, is shown in FIGS. 21-25, which provides the user assistance to automatically realign the door from a sagging position, as door 12 is moved from an open position to a closed position. Door lifting assembly 200 provides an effortless unobstructed closing of door 12. Door lifting assembly 200 will operate regardless which side of the door is hinged when the door is being closed.

Door support structure 202, as seen in FIGS. 26-30, is provided to operate with each of first lower hinge pin 57 and second lower hinge pin 52, which are both positioned on the bottom portion "B" of frame 16. Door support structure 202 with the door in an open position supports door 12 proximate to a lower hinge with door 12. Door support structure 202 will support door 12 at or near the elevation attained of door 12 by door lifting assembly 200 when the door was in a closed position. Thus, with use of support structure 202, a reduction of up and down movement of door 12 can be provided as door 12 moves between open and closed positions.

In referring to FIG. 12 an example of first upper hinge pin 51 is shown connected to top portion "T" of frame 16 of network cabinet 10 and on the right side portion of frame 16. Hinge pin 51 is connected to bracket 204 by using a bolt, rivet or other common securing means and bracket 204 is in turn bolted to cross beam 34 of frame 16. Spaced apart from and positioned directly below first upper hinge pin 51 is first lower hinge pin 57, shown in FIG. 13. First lower hinge pin 57 is connected to bottom portion "B" and right side portion of frame 16 on cross beam 34. First lower hinge pin is bolted to mounting bracket 206 and in turn mounting bracket 206 is bolted to cross beam 34.

In referring to FIG. 14, door 12 is hinged on the right side of frame 16 to hinge pins 51 and 57 with door 12 in an open position on the left side of frame 16. First upper hinge pin 51 and first lower hinge pin 57 are engaged with first upper latch 65 and first lower latch 48, respectively, forming a first upper hinge 208, in FIG. 17, and a first lower hinge 210, in FIG. 18.

Referring to FIGS. 15 and 16, second lower hinge pin 52 and second upper hinge pin 53 are both not hinged to door 12, with door 12 open on the left side of frame 16 and door 12 hinged on the right side of frame 16, as shown in FIG. 14. Second lower hinge pin 52, in FIG. 15, is connected to a bottom portion "B" of frame 16 of network cabinet 10 with second lower hinge pin 52 bolted to mounting bracket 206 and mounting bracket 206 in turn bolted to cross beam 34 of frame 16. In this example, second lower hinge 52 is positioned on the left portion of frame 16. Second upper hinge pin 53 is shown in FIG. 16 connected to top bottom portion "T" and on a left side portion of frame 16. Second upper hinge pin 53 is positioned spaced apart and directly above second lower hinge pin 52. Second upper hinge pin 53 is connected to cross beam 34 with hinge pin 53 bolted, riveted or otherwise secured to mounting bracket 204 and mounting bracket 201 in turn is bolted to cross beam 34.

In referring to FIGS. 19 and 20, door 12 is hinged on the left side of frame 16 as shown in FIG. 3 and opened on the right side of frame 16. Second upper hinge pin 53 as shown in FIG. 19 is engaged with closed first upper latch 67 forming second upper hinge 212. Second lower hinge pin 52 is engaged with closed second lower latch 50 forming second lower hinge 214.

The assembly for lifting and supporting a door relative to the cabinet, as mentioned earlier, can be applied to operate with a door that opens and closes on one side, however, for the present embodiment the assembly will be applied to dual hinged door 12. With respect to dual hinged doors 12, the dual hinged operation performs with latches on the right side of door 12 operating between open and closed positions with respect to the hinge pins on the right side of frame 16 and likewise the latches on the left side of door 12 operate between open and closed positions with respect to the hinge pins on the left side of frame 16.

Figure 17:
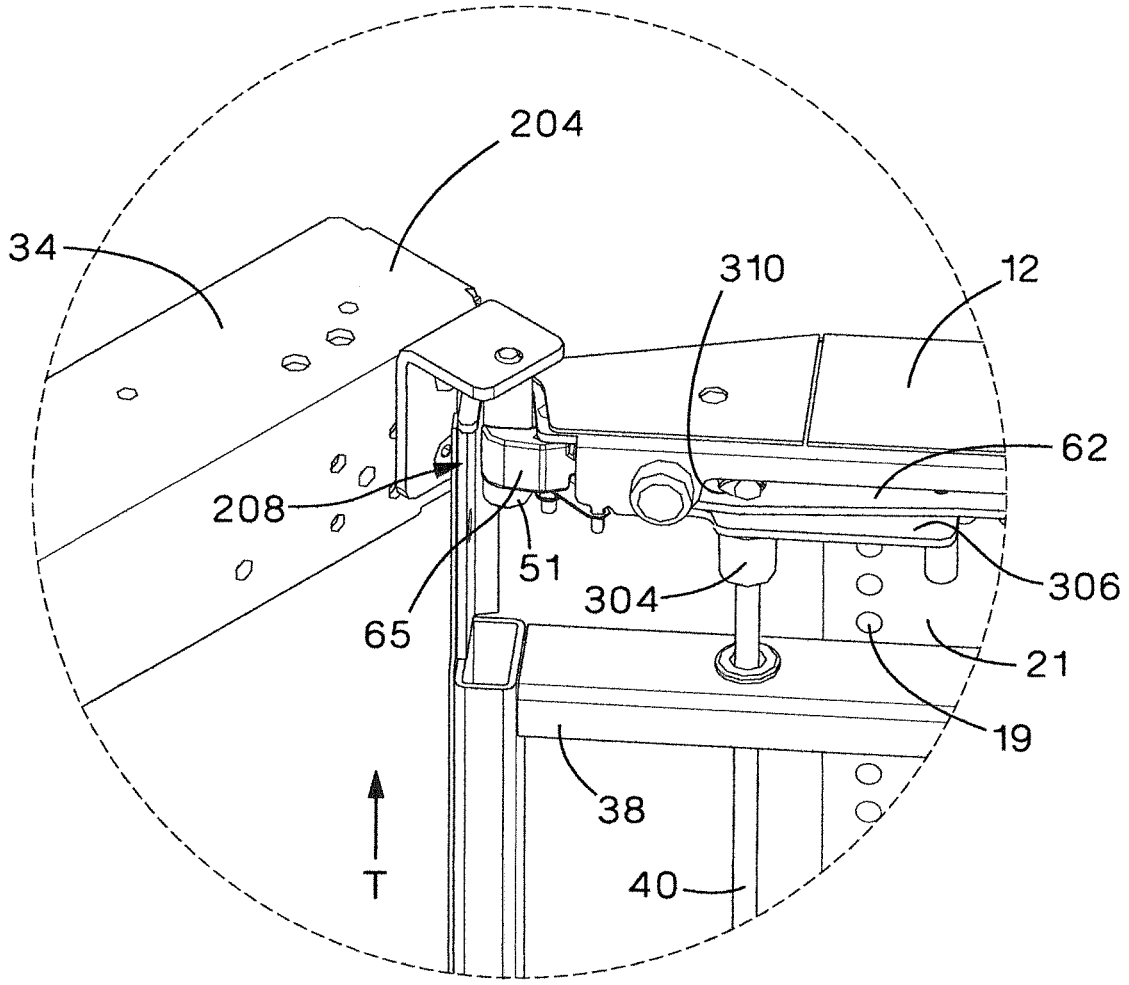
FIG. 17 is an enlarged view of that which is circled and designated as 17 in FIG. 14.
Figure 18:
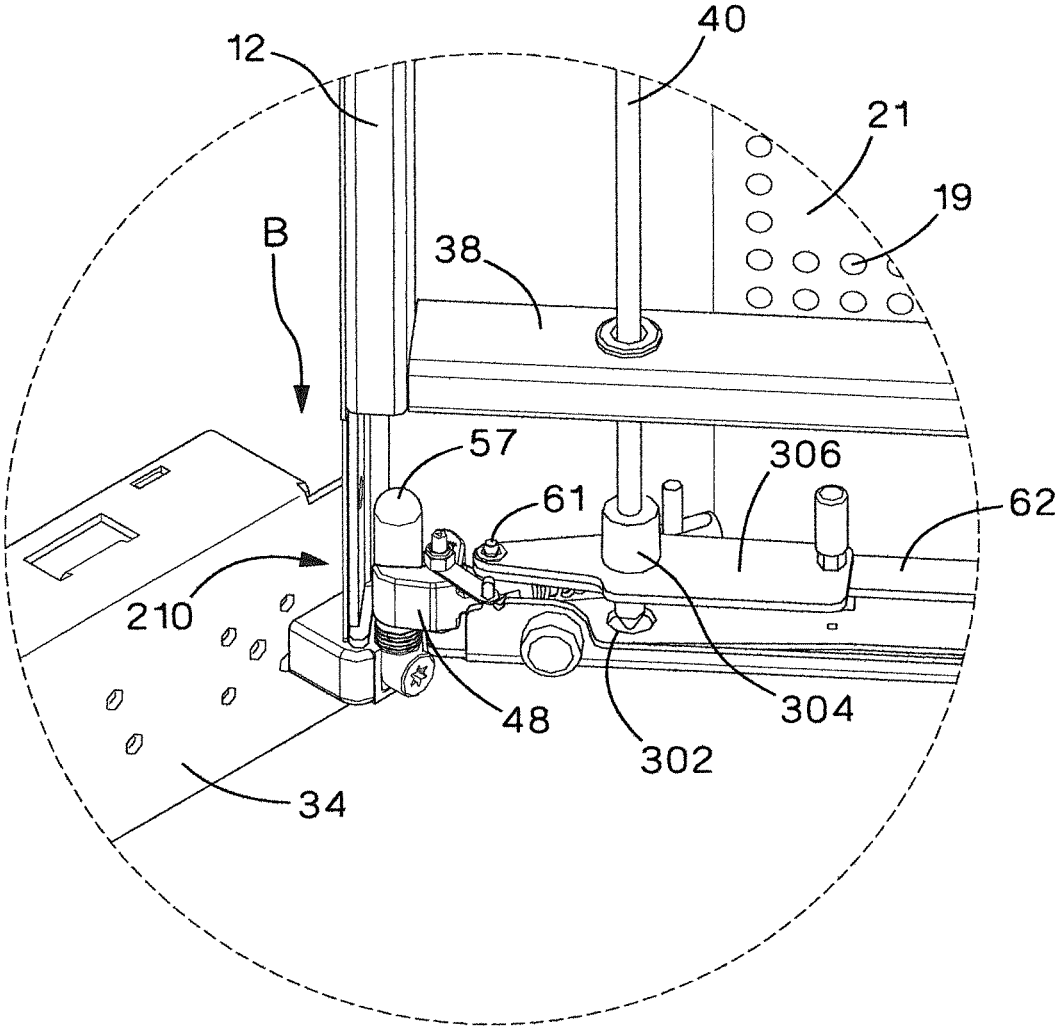
FIG. 18 is an enlarged view of that which is circled and designated as 18 in FIG. 14.

In addressing the operation of the latches and hinge pins that operate on the right side of cabinet 10, first upper latch 65, as describe earlier, is rotatably connected to door 12 in interlocking assembly 46 so as to rotate between an open and closed position relative to door 12, as seen for example in FIGS. 9-9C, and is positioned in the upper right portion of door 12. With first upper latch 65 in a closed position, as seen for example in FIG. 9C, latch 65 forms first upper hinge 208, as seen in FIG. 17. In an open position first upper hinge 65, as seen, for example, in FIG. 9, is positioned out of blocking relationship with first upper hinge pin 51 as seen in FIG. 12 such that hinge pin 51 and latch 65 are permitted to separate from one another and move the door to an open position as seen in FIG. 3. Similarly the other latch on the right side of door 12, first lower latch 48, operates in the same way. First lower latch 48 is rotatably connected to door 12 in interlocking assembly 46 so as to rotate between an open and closed position as seen in FIGS. 9-9C. and is positioned in the lower right portion of door 12. With first lower latch 48 in a closed position, as seen in FIG. 9C, latch 48 forms first lower hinge 210, as seen in FIG. 18. In an open position first lower hinge 48, as seen in FIG. 9, is positioned out of blocking relationship with first lower hinge pin 57 as seen in FIG. 13 such that hinge pin 57 and latch 48 are permitted to separate from one another and move the door to an open position as seen in FIG. 3. This configuration permits, the right side of door 12 to move between open and closed positions.

Now with respect to the left side of frame 16 and the left side of door 12, second upper hinge pin 53 as described earlier is connected to a top portion "T" and left side of frame 16 spaced apart from and across frame 16 from first upper hinge pin 51. Second lower hinge pin 52 is connected to the bottom portion "B" of frame 16 and is spaced apart from and across frame 16 from first lower hinge pin 57. Second upper latch 67, as describe earlier, is rotatably connected to door 12 in interlocking assembly 46 so as to rotate between an open and closed position relative to door 12, as seen for example in FIGS. 9-9C, and is positioned in the upper left portion of door 12. With second upper latch 67 in a closed position, as seen for example in FIG. 7, latch 67 forms second upper hinge 212, as seen in FIG. 19. In an open position, first upper hinge 67, as seen, for example, in FIG. 9, is positioned out of blocking relationship with first upper hinge pin 53 as seen in FIG. 16 such that hinge pin 53 and latch 67 are permitted to separate from one another and move the door to an open position, as seen in FIG. 14. Similarly the other latch on the left side of door 12 is second lower latch 50. Second lower latch 50 is rotatably connected to door 12 in interlocking assembly 46 so as to rotate between an open and closed position as seen in FIG. 7, and by way of example in FIGS. 9-9C. and is positioned in the lower left portion of door 12. With first lower latch 50 in a closed position, as seen in FIG. 7, latch 50 forms second lower hinge 214, as seen in FIG. 20. In an open position second lower hinge 50, as seen for example in FIG. 9, is positioned out of blocking relationship with second lower hinge pin 52 as seen in FIG. 15 such that hinge pin 52 and latch 50 are permitted to separate from one another and the door can be moved to an open position as seen in FIG. 14.

Figure 24:
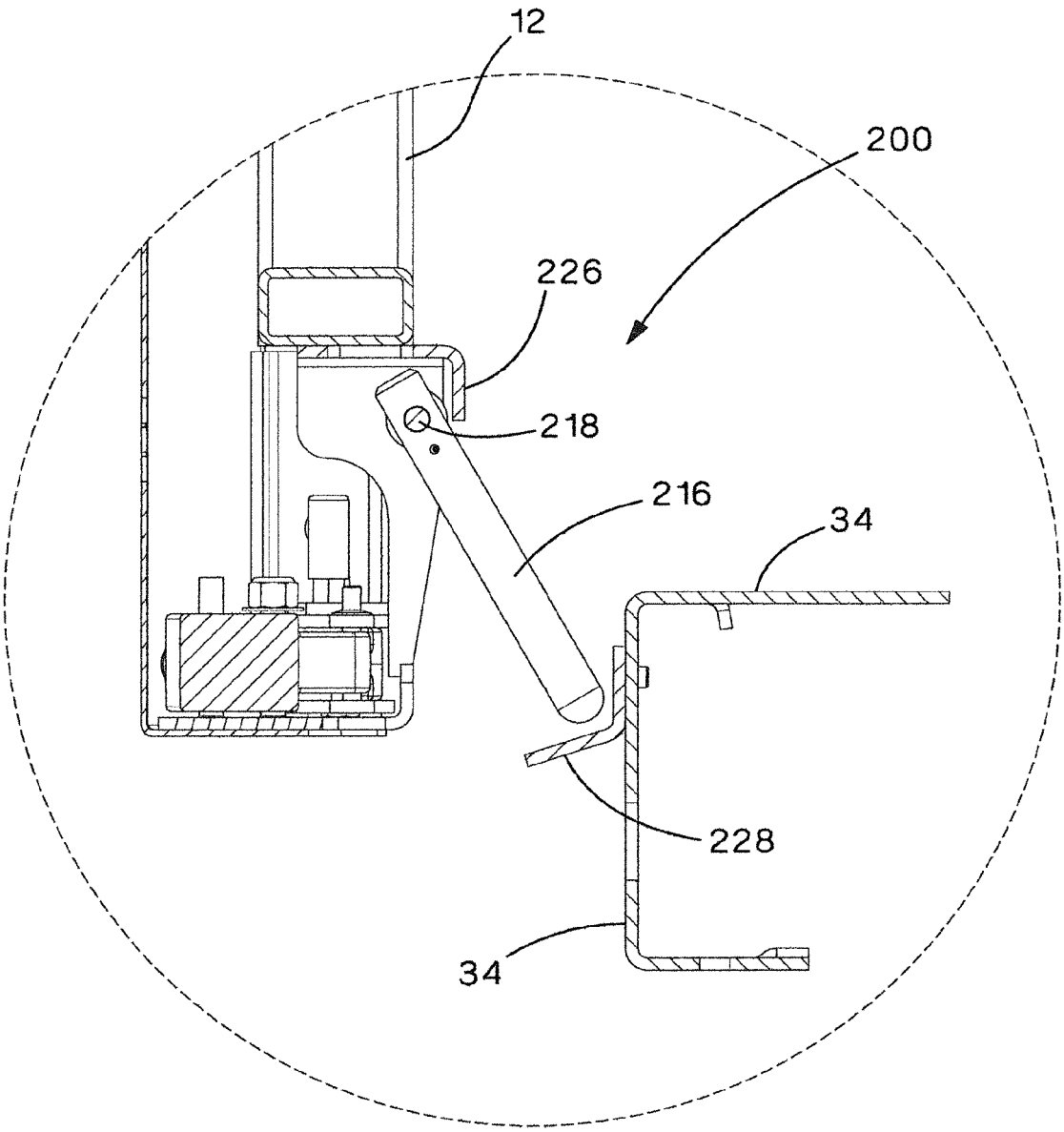
FIG. 24 is a cross section view as seen along line 24-24 in FIG. 23 along with the lift pin support member secured to the frame with the door approaching a closed position.
Figure 25:
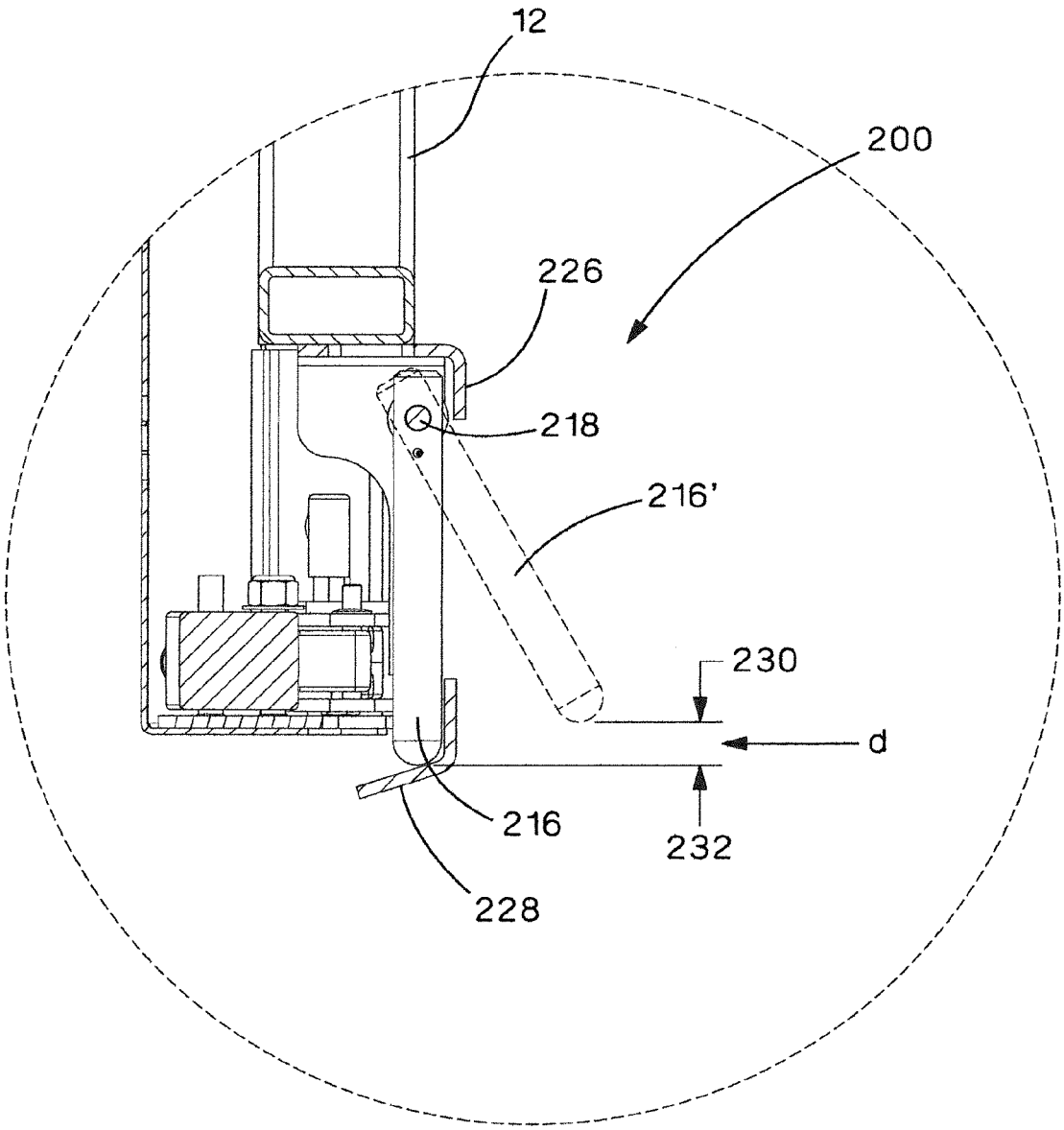
FIG. 25 is the view seen in FIG. 24 with the door in a closed position along with a phantom view of the lift pin in a position wherein the door would be in an open position.

With respect to lift pin assembly 200, shown in FIGS. 24 and 25, this is a portion of the assembly for lifting and supporting a door relative to cabinet 10. In referring to FIGS. 14 and 21, lift pin 216 is connected to front door 12. Lift pin 216 extends in a direction forming an angular relationship with a plane formed by door 12. This angular relationship with door 12 is the same regardless of which side of door 12 is hinged and with the door is in an open position.

Figure 21:
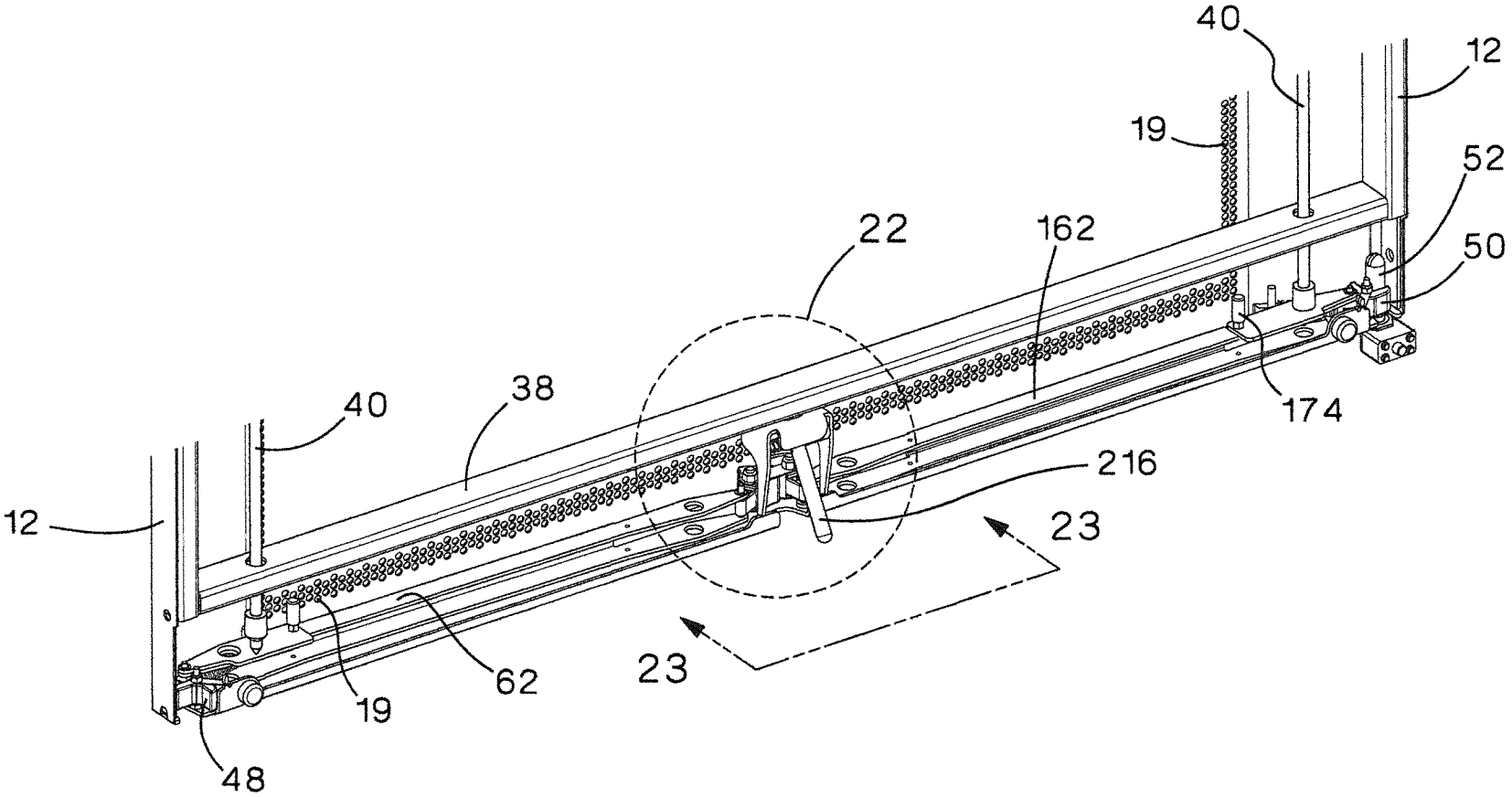
FIG. 21 is partial perspective view of a lower portion of the front door as shown in FIG. 3 showing a portion of the lift pin assembly without showing the frame of the cabinet.

In FIG. 14, front door 12 is hinged on the right side of frame 16 and door 12 is open on the left side of frame 16. In this instance, door 12 is hinged about first lower hinge pin 57, as shown in FIG. 18, and about first upper hinge pin 51, as shown in FIG. 17. In FIG. 21, front door 12 is hinged on the left side of frame 16, as shown in FIG. 3, and is opened on the right side of frame 16. In this instance, door 12 is hinged about second upper hinge pin 53, as shown in FIG. 19, and about second lower hinge pin 52, as shown in FIG. 20. In either orientation of door 12 opened and hinged from either the right or left side of frame 16, lift pin 216 is positioned in the angular position relative to the plane of door 12 and operates in the same way. Thus, the operation of lift pin 216 will apply to door 12 regardless from which side of frame 16 it is hinged.

Figure 23:
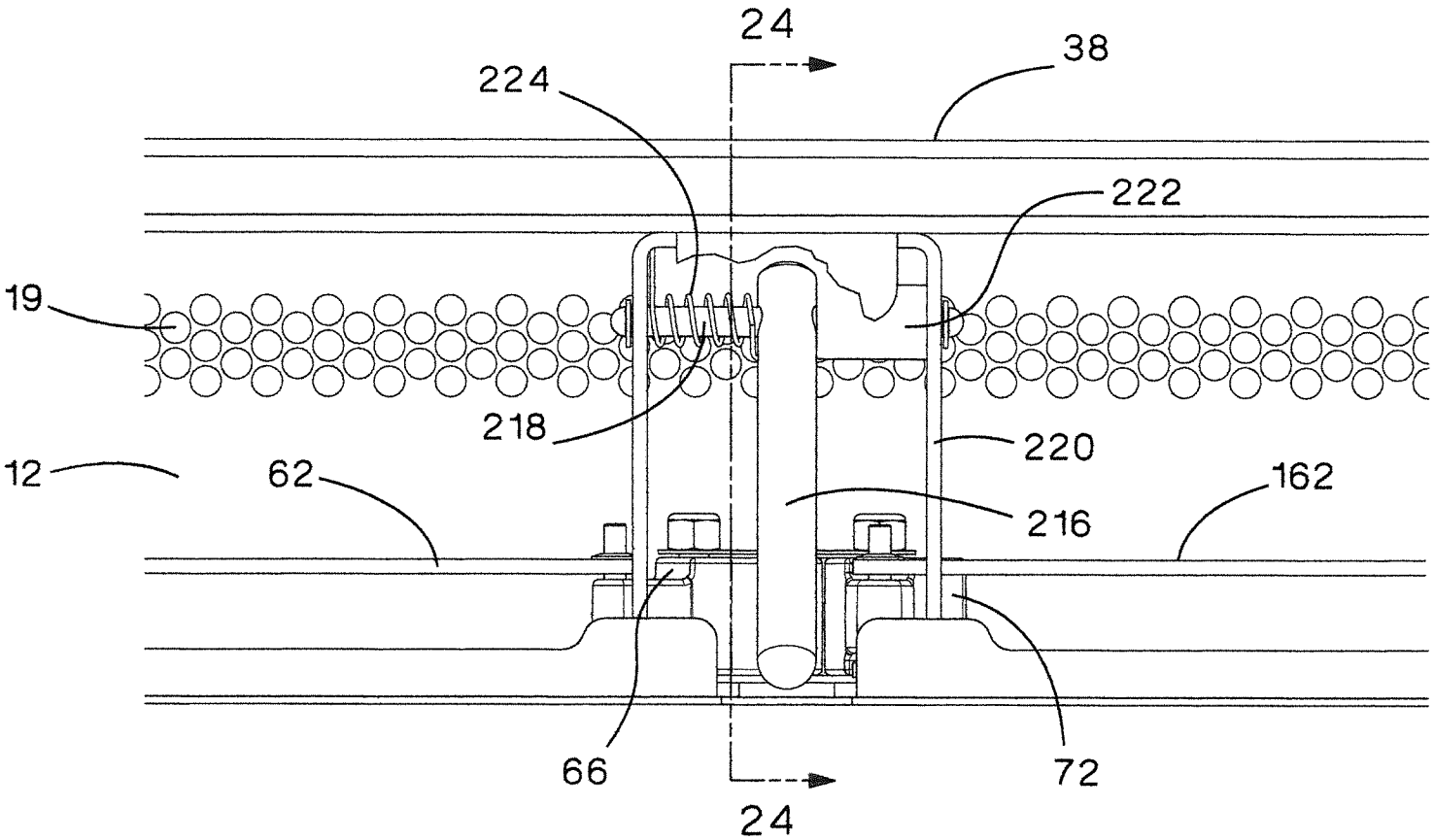
FIG. 23 is a partial cut away elevation view as seen along line 23-23 in FIG. 21.

Lift pin 216 is rotatably mounted to axle 218 as seen in FIGS. 23-25. Axle 218 is secured to door 12 by being rotatably mounted to bracket 220 and bracket 220 being connected to door 12 with bolts or any other conventional method. With lift pin 218 positioned, in this embodiment, in a central portion of axle 218, bushing 222 is positioned on axle 218 and is positioned between lift pin 216 and bracket 220, as seen in FIG. 23. On the other side of lift pin 216, torsion spring 224 is positioned between lift pin 216 and bracket 220. One end of torsion spring 224 is connected to lift pin 216 and the other end of torsion spring 224 is connected to bracket 220. Bracket 220 in turn is connected to door 12.

Figure 22:
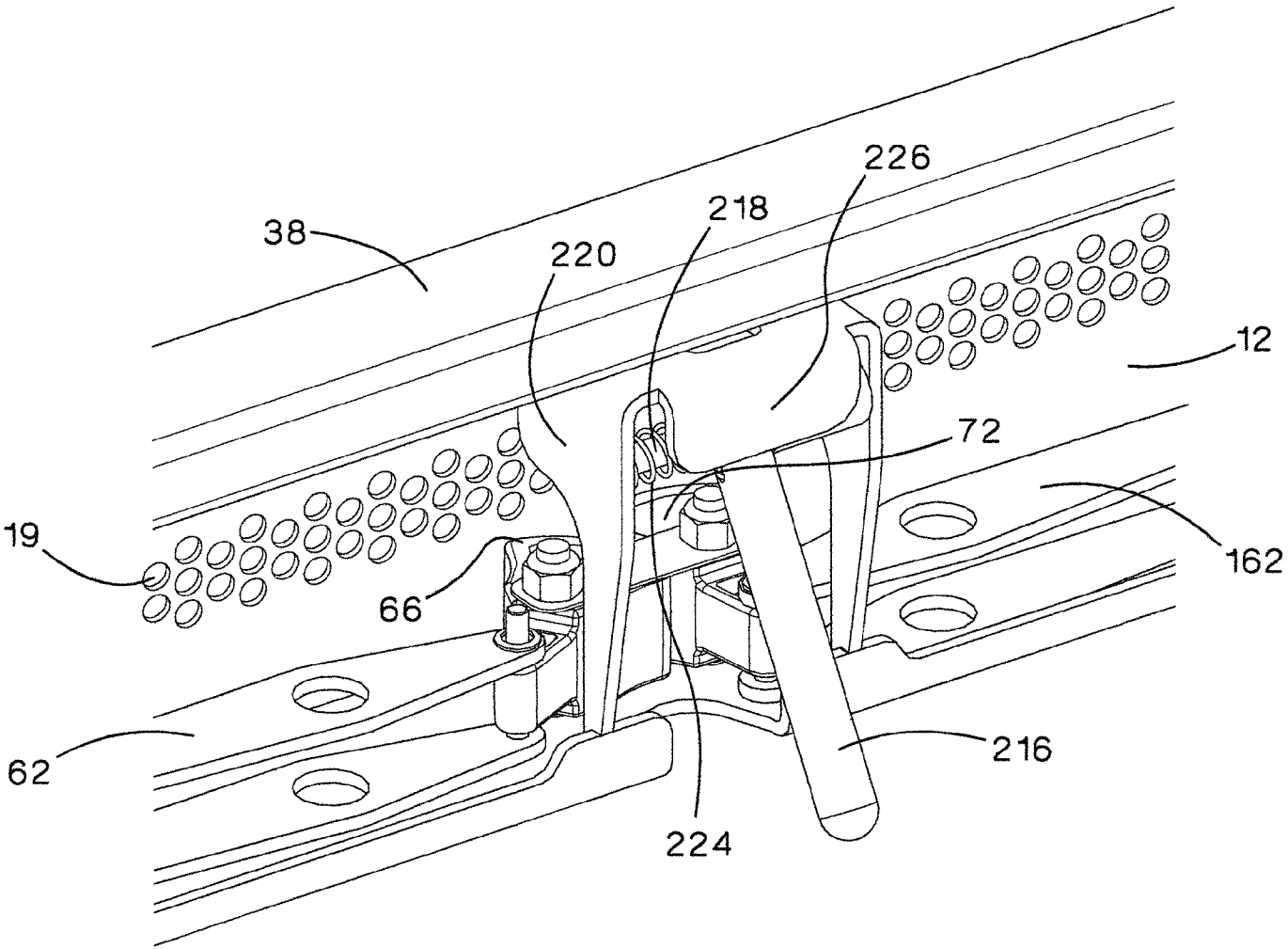
FIG. 22 is an enlarged view of that which is circled and designated as 22 in FIG. 21.

Torsion spring 224 is positioned to exert an upward force on lift pin 216. Restraint member 226 which is connected to bracket 220 and is in turn connected to door 12, is positioned in a path of upward rotation of lift pin 216, as seen in FIG. 22. Restraint member 226 is positioned such that torsion spring 224 retains stored energy and continues to urge lift pin 216 against restraint member 226.

As door 12 is moved from an open position toward a closed position relative to frame 16, lift pin 216, as seen in FIG. 24, engages lift pin support member 228. Lift pin support member 228 is connected to cross beam 34. In this example, frame 16 is constructed to angle in an upward direction as it approaches cross beam 34. Member 228 is bolted or otherwise secured to frame 16 and is positioned at a predetermined elevation to elevate door 12 to a desired elevation with lift pin 216 fully engaged, as seen in FIG. 25. Thus, as lift pin engages support member 228 and door 12 continues to move toward a closed position, lift pin 216 rotates in a downward direction relative to door 12, to a more vertical position as door 12 attains a closed position, as seen in FIG. 25. With door 12 in the closed position, lift pin 216 extends in a direction, in this embodiment, generally aligned with the plane formed by door 12. Also, with door 12 in a closed position, as shown in FIG. 25, door 12 has been lifted to a predetermined desired elevation relative to frame 16 to permit smooth closure of door 12 with door latches and corresponding hinge pins aligned.

In referring to FIG. 25, door 12 is in a closed position and lift pin 216 has rotated and is supported by support member 228. Distance "d" shown in FIG. 25 is the distance door 12 has elevated from an open position to a closed position. Line 230 represents a position of a distal end of phantom lift pin 216' with door 12 in an open and sagging position and other line 232 represents an elevation of the distal end of lift pin 216 with door 12 in an elevated position with door 12 in a closed position. The distance "d" between line 230 and other line 232 demarks the distance door 12 was raised in an upward direction or elevated relative to frame 16 to a desired predetermined elevation in the process of closing door 12.

With door 12 in a completely closed position, with both right and left sides of door 12 hinged to frame 16, lift pin 216 has elevated door 12 to the desired elevation for provide smooth operation of the door by the user. Thus, with door 12 in the closed position lift pin support member 228 can maintain door 12 at or near the desired elevation. When door 12 is then thereafter placed in an open position, wherein only one side of door 12 is hinged to frame 16, door support structure 202 is utilized to support door 12 at or near the desired predetermine elevation door 12 was positioned by lift pin 216 with door in a closed position.

In referring to door support structure 202, two embodiments will be discussed herein and are shown in FIGS. 26-30. Door support structure 202 will provide support to door 12 at a location proximate to the lower hinge pin about which door 12 is hinged, with the door in an open position. Door support structure 202 will support door 12 at or near the elevation door 12 attained by the operation of lift pin 216 with door 12 placed into a closed position.

Figure 26:
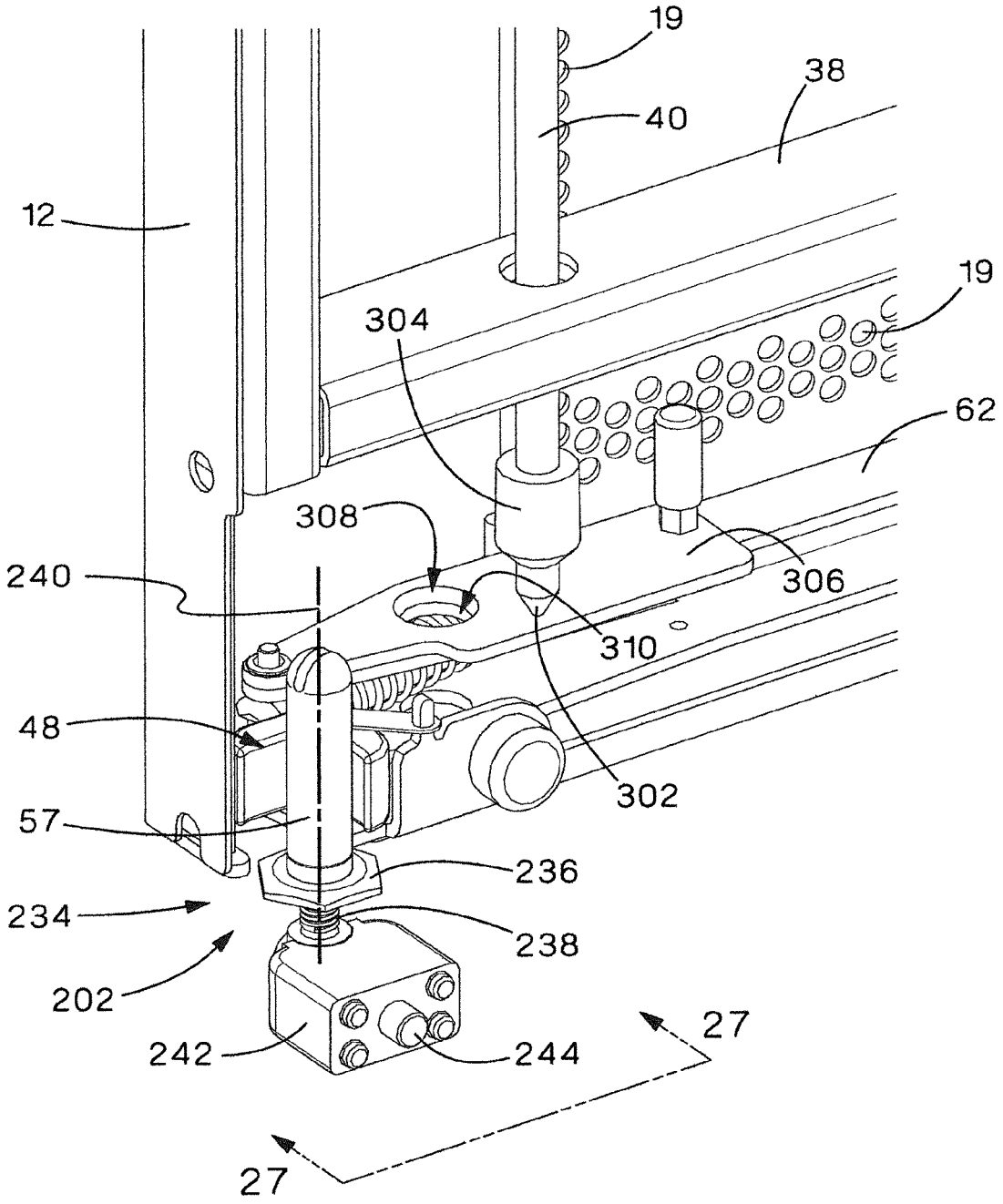
FIG. 26 is a perspective view of an embodiment of the door support structure with a partial view of door approaching a closed position.
Figure 27:
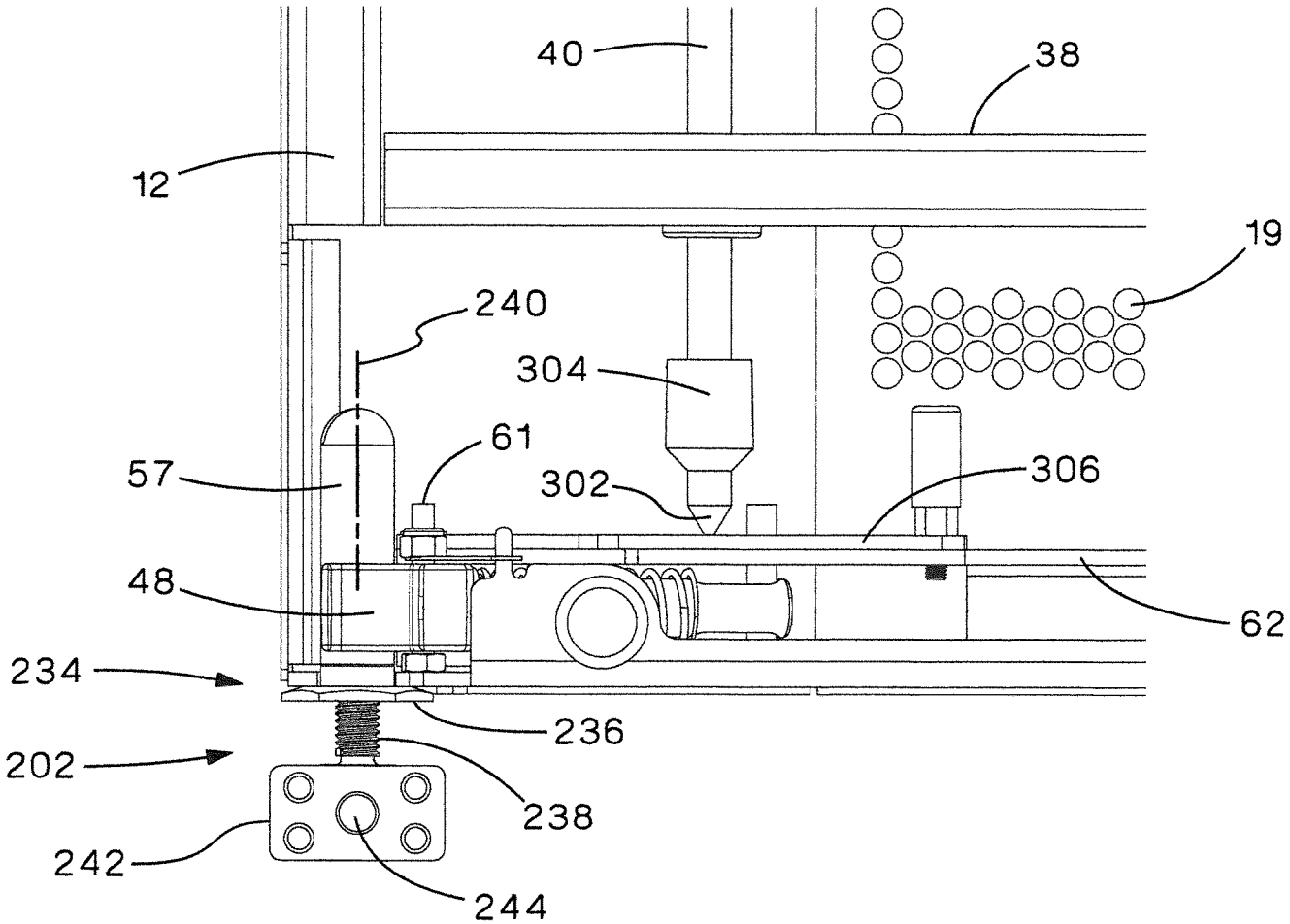
FIG. 27 is an elevation view along line 27-27 of FIG. 26 with the door in a closed position.

For example, with respect to door 12 being hinged about first lower hinge pin 57 and first upper hinge pin 51, as seen in FIG. 14, first embodiment 234 of door support structure 202 is shown in FIGS. 26 and 27. First embodiment 234 of door support structure 234 comprises nut member 236 that is threaded (not shown) and engages compatible threads 238 defined by first lower hinge pin 57. Nut member 236 is adjustable in elevation relative to hinge pin 57. Nut member 236 extends away from a longitudinal axis 240 and in angular relationship with longitudinal axis 240. In this embodiment, the angular relationship is generally perpendicular to longitudinal axis 240.

First lower hinge pin 57 is secured to mounting bracket 242 with bolt 244 and in turn bracket 242 is bolted to cross beam 34 of frame 16. Thus, as door 12 is placed into a closed position, as seen in FIG. 27, nut member 236 is adjusted by the user. The user turns nut member 236 and adjusts the elevation of nut member 236 along hinge pin 57 to abut a lower portion of door 12. With door 12 in a closed position, door 12 has been positioned into its desired predetermined elevation with lift pin 216. With positioning or adjusting nut member 236 to abut the lower portion of door 12 and then with door 12 then opened from an opposing side of frame 12 from hinge pin 57 with door 12 hinged about hinge pin 57, nut member 236 will support door 12 at or near the desired elevation attained when door 12 had been placed in a closed position.

This same construction for the above first embodiment 234 of door support structure 202 can be applied in association with second lower hinge pin 52 on the other side of frame 16. This will be understood to be the second door support structure. With door 12 placed in a closed position, nut member 236 can also be adjusted to abut the lower portion of door 12. The result would also be that with door 12 hinged about second lower hinge pin 52 and door 12 opened from the opposite side of frame 16, door 12 will be supported at or near the desired elevation attained by lifting pin 216 when door 12 was in the closed position.

Figure 28:
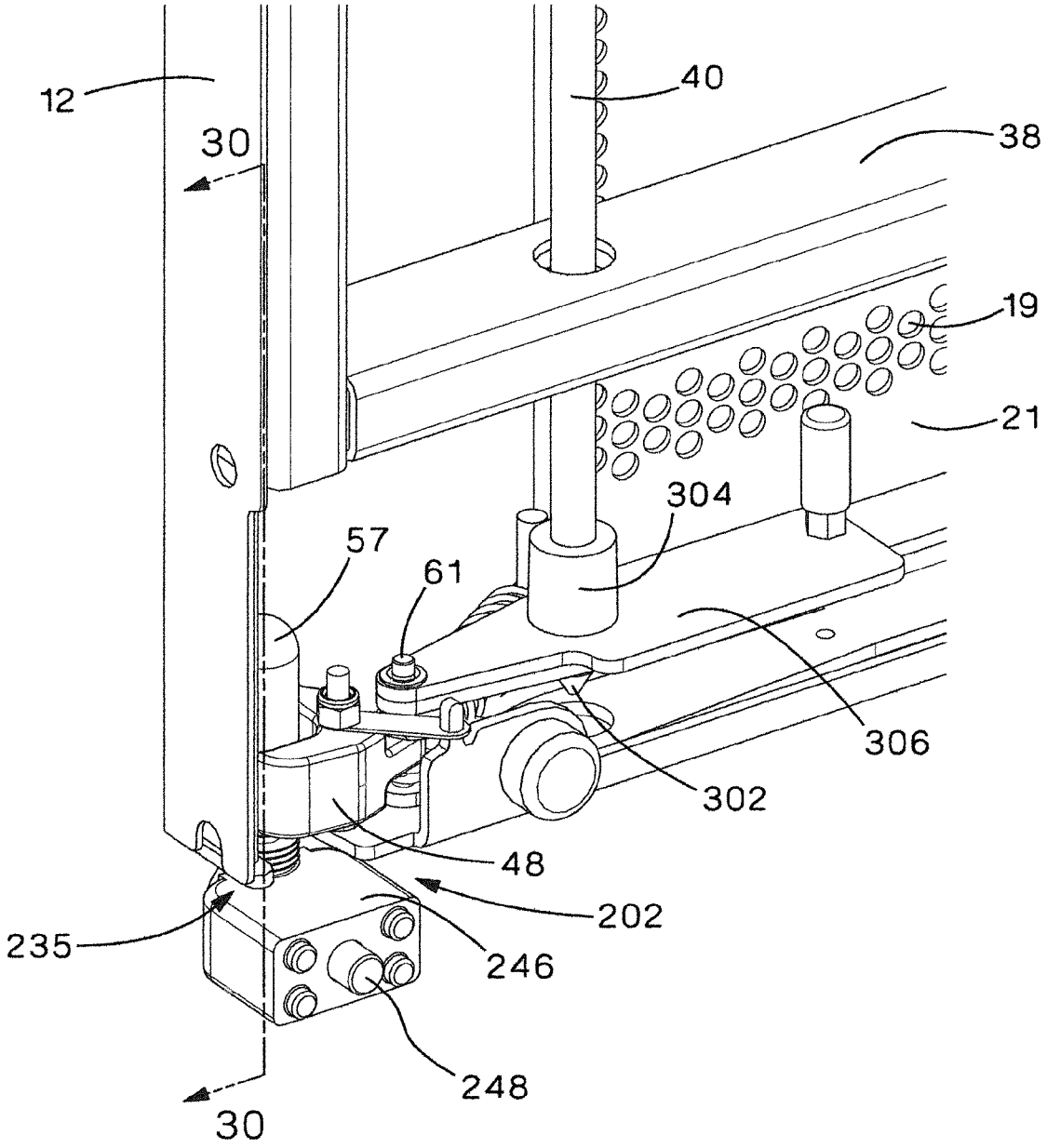
FIG. 28 is a perspective view of another embodiment of the door support structure engaged to the door with the door in a closed position.
Figure 29:
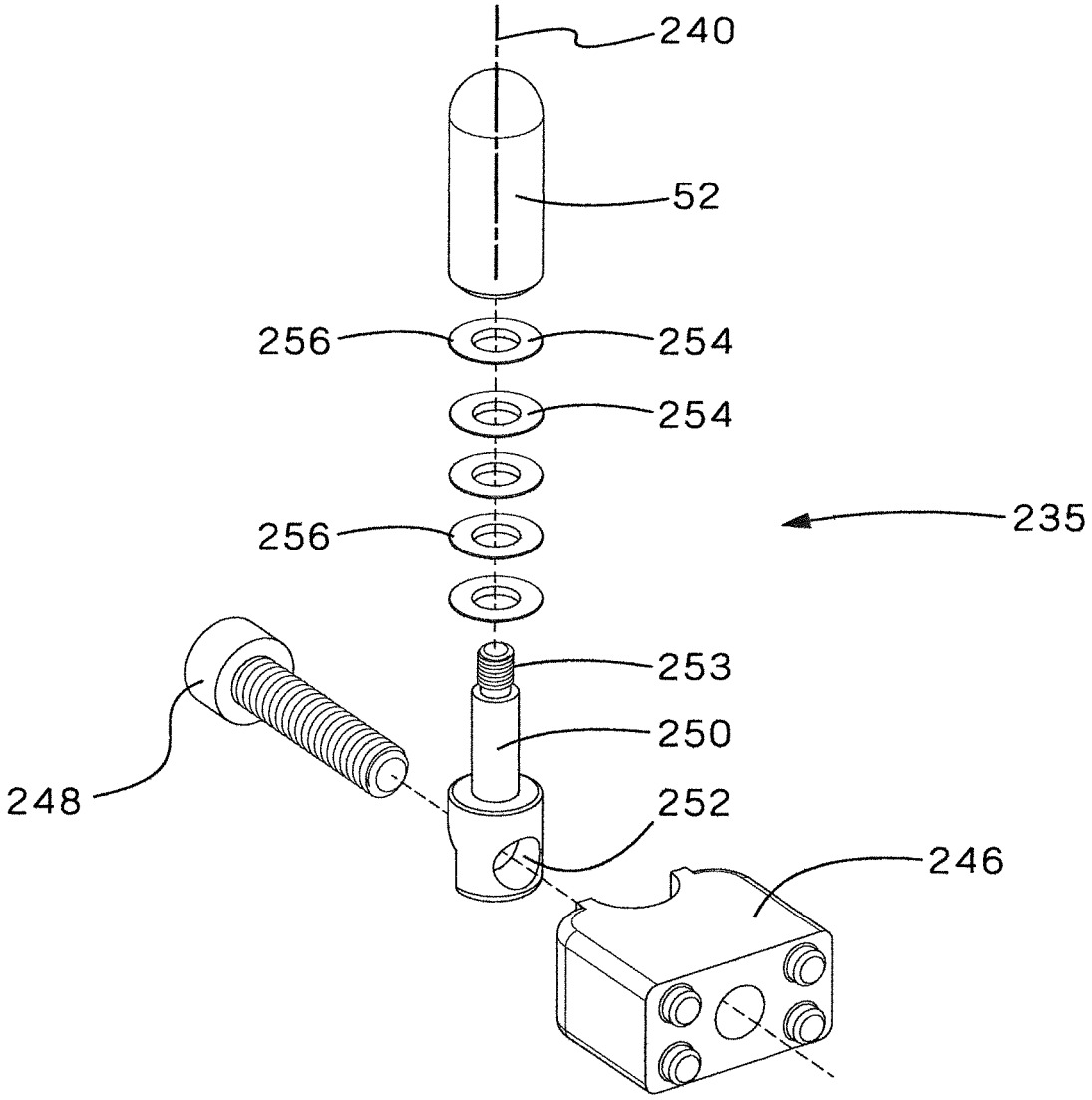
FIG. 29 is perspective exploded view of the embodiment of the door support structure shown in FIG. 28.
Figure 30:
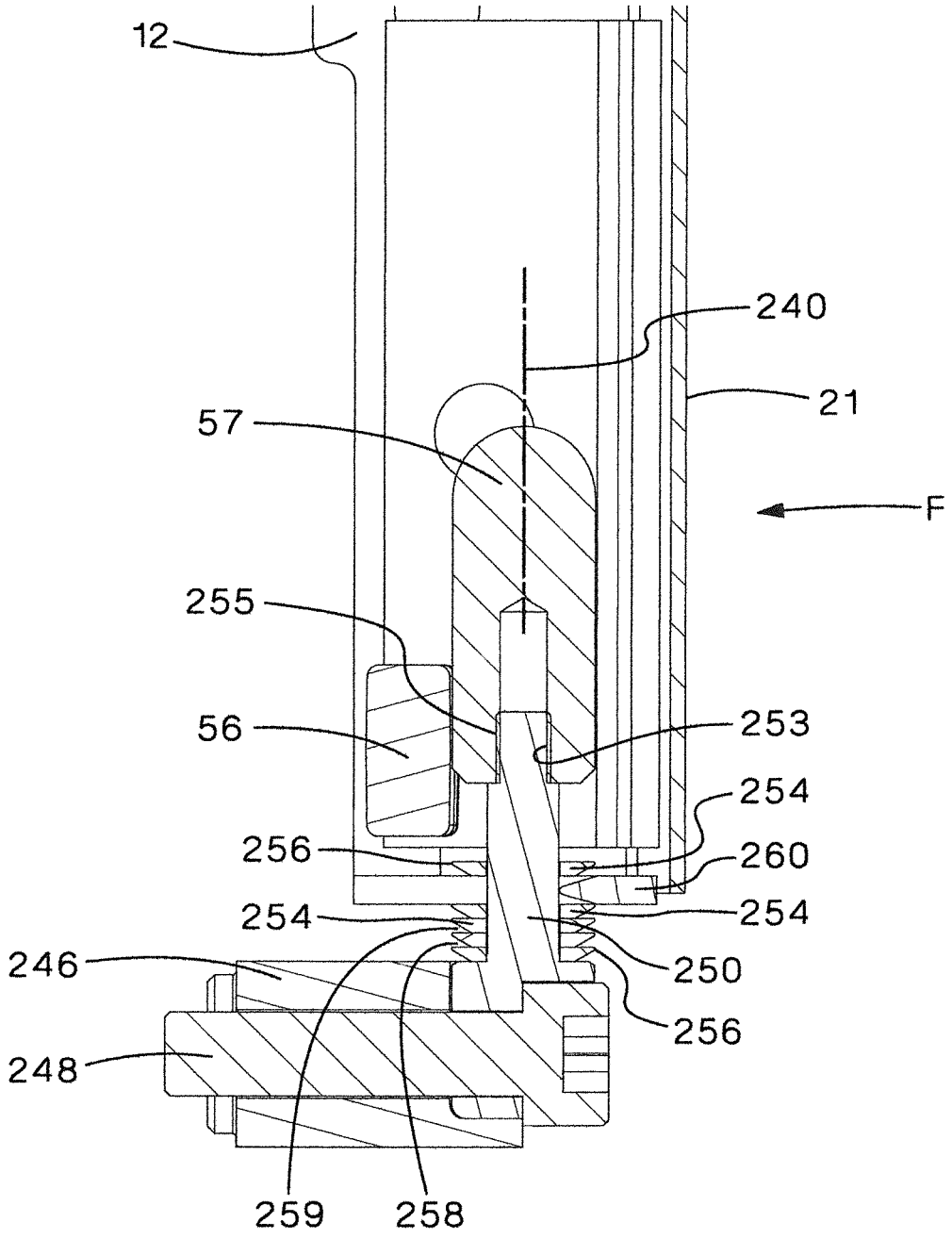
FIG. 30 is a cross section view as seen along line 30-30 of FIG. 28.

A second embodiment 235 of door support structure 202 is shown in FIGS. 28-30. In referring to FIG. 28, first lower hinge pin 57 is shown engaged with closed first lower latch 48 with second embodiment 235 supporting door 12 with door 12 in a closed position. In this configuration, door 12 is hinged to first lower hinge pin 57 and door 12 is opened on the opposing side of door 12 from latch 48. In this instance, second lower latch 50 and corresponding second upper latch 65 are open.

For purposes of this description of second embodiment 235 of door support structure 202, the same structure is positioned and associated with second lower hinge pin 52 and is known as second door support structure. Thus, the description of door support structure 202 associated with first lower hinge pin 57 will provide the description of the same second door support structure associated with second lower hinge pin 52.

In FIGS. 28-30, first lower hinge pin 57 connected to cross beam 34 of frame 16. Hinge pin 57 is bolted to bracket 246 and bracket 246, in turn, is bolted to cross beam 34 with bolt 248. Hinge pin lower segment 250 defines opening 252 through which bolt 248 passes. On an upper portion of segment 250 are defined threads 253 which engage and are compatible to threads 255 defined within hinge pin 52 such that lower segment 250 and hinge pin 57 are threadingly secured together.

At least two annular door support members 254, wherein each define an opening 246, are stacked onto hinge pin 52 with hinge pin 52 passing through openings 246. As seen in FIG. 30, annular members 254 are stacked on top of one another. Each annular member 254 extends away from longitudinal axis 240 of hinge pin 57 in an angular relationship. The angular relationship is generally perpendicular to longitudinal axis 240. With annular members 254 configured to have a narrower construction in their thickness on the peripheral outside portion 256 of each annular member 254, two adjacent annular members 254 define a first space 258 positioned between each adjacent annular members 254. With three annular members 254 stacked, two successive spaces 258 and 259 are defined, wherein each space is positioned at different elevations relative to frame 16.

As seen in FIG. 30, with door 12 moved to a closed position, an edge 260 of door 12 enters a space positioned between two adjacent annular members 254. Thus, with door 12 positioned in a desired predetermined elevation attained with lift pin 216 with door 12 in a closed position, door 12 is supported by an annular disk member 254 at or near the desired predetermined elevation attained by lift pin 216. Thus when door 12 is reopened, in this example, with hinge formed around hinge pin 52 positioned on the other side of frame 12, door 12 is supported by annular member 254 which is positioned immediately below door 12, as seen in FIG. 30.

As mentioned earlier, this same door support structure is positioned at both lower hinge pins 52 and will operate in the same way as door support structure associated with first lower hinge pin 57 described above. Thus, moving door 12 open from either the right or left side of door 12 will result, in door 12 supported at or near the desired predetermined elevation attained by lift pin 216 when door 12 was closed.

In referring to FIGS. 31-40, handle assembly 300 is shown. Handle assembly 300 in this embodiment is used to operate handles 18 and 20 that are positioned on each dual hinged door 12 and 17. Handle assembly 18', for handle 18 positioned on the left side of door 12, as seen in FIGS. 1-3, Likewise handle 18 will be positioned on the left hand portion of rear door 17, from a frame of reference of facing door 17, as seen in FIG. 4. Handle assembly 20' which includes handle 20 positioned on the right side of door 12, as seen in FIGS. 1-3, is also positioned on the right hand portion of rear door 17, frame a frame of reference of facing door 17, as seen in FIG. 4.

Figure 39:
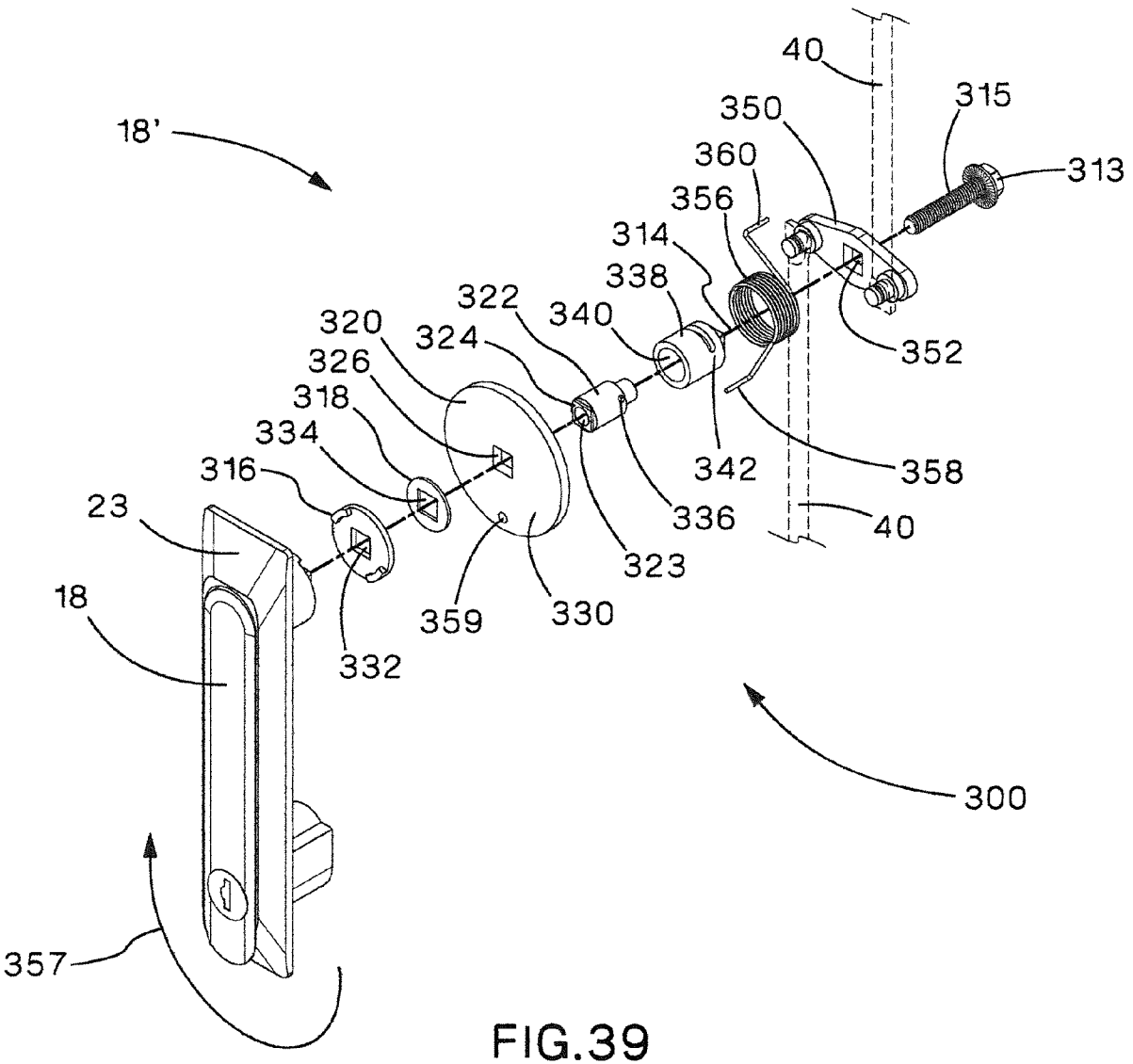
FIG. 39 is a top front perspective exploded view of the torsion handle assembly of FIG. 31 for a handle to be positioned on a left portion of the door and in a first closed position.
Figure 40:
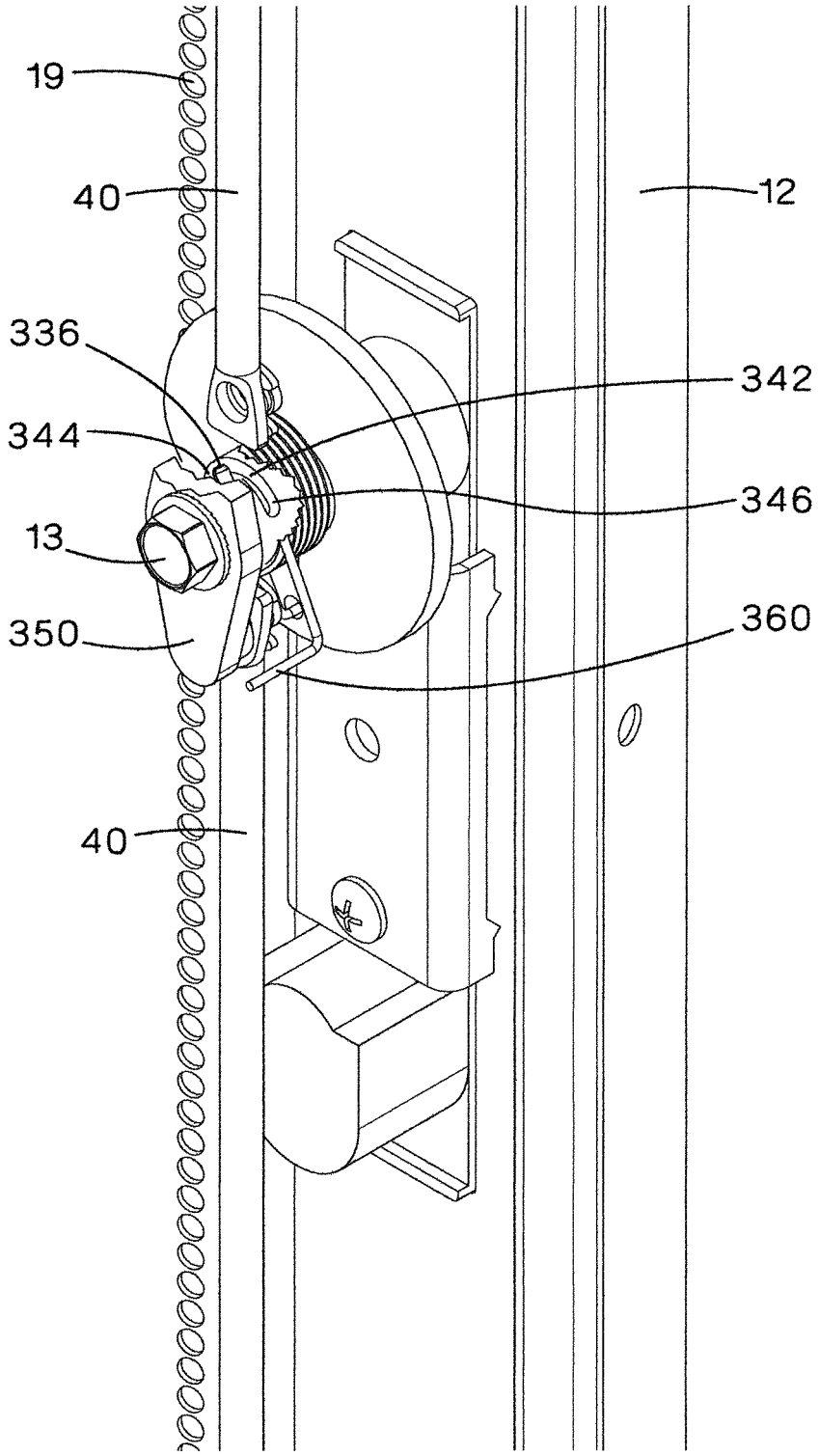
FIG. 40 is a perspective and partial cutaway back side view of the door handle assembly as shown in FIG. 39 assembled, with a portion of the torsion spring cut away.

In this embodiment, handle 18 will rotate in a clockwise direction to open doors 12 and 17 and handle 20 will rotate in a counterclockwise direction to open doors 12 and 17. Right handle assembly 20' will be described herein below with reference to front door 12 and such will apply to right handle assembly 20' positioned on rear door 17. It should be noted left hand handle assembly 18' is shown in FIGS. 39 and 40 and will operate in generally the same way as right handle assembly 20', except that the arrangement of parts within handle assembly 18' will be adjusted to accommodate rotating handle 18 in a clockwise direction to open the left hand side of door 12 and left hand side of door 17, from a frame of reference of facing door 17. The variation in arrangement or positioning of parts within left handle assembly 18' will be set forth in the description of FIGS. 39 and 40.

Figure 31:
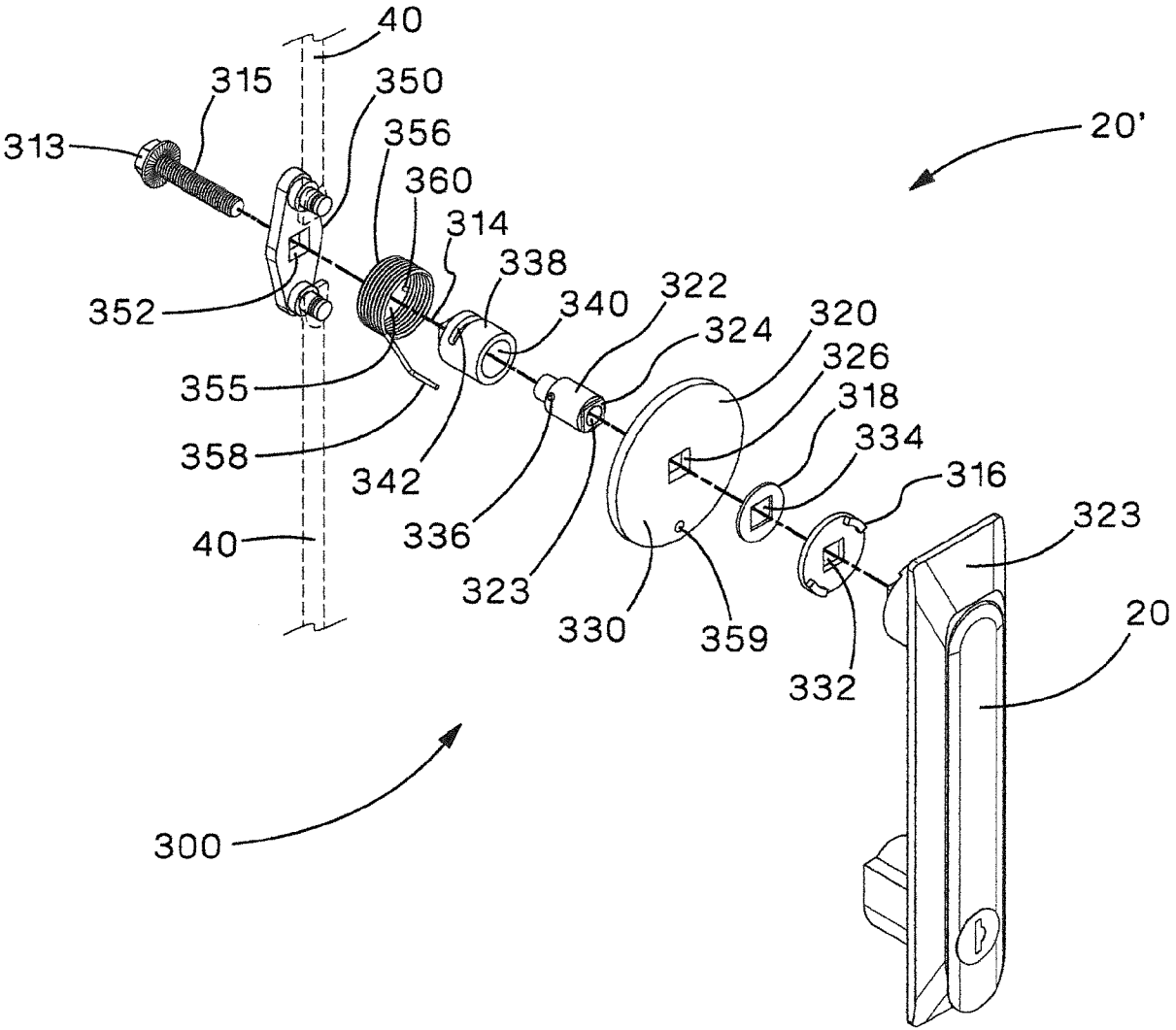
FIG. 31 is a top front perspective exploded view of the handle assembly positioned on a right side of a door in a first closed position, positioning the locking rods into an extended locked position.
Figure 35:
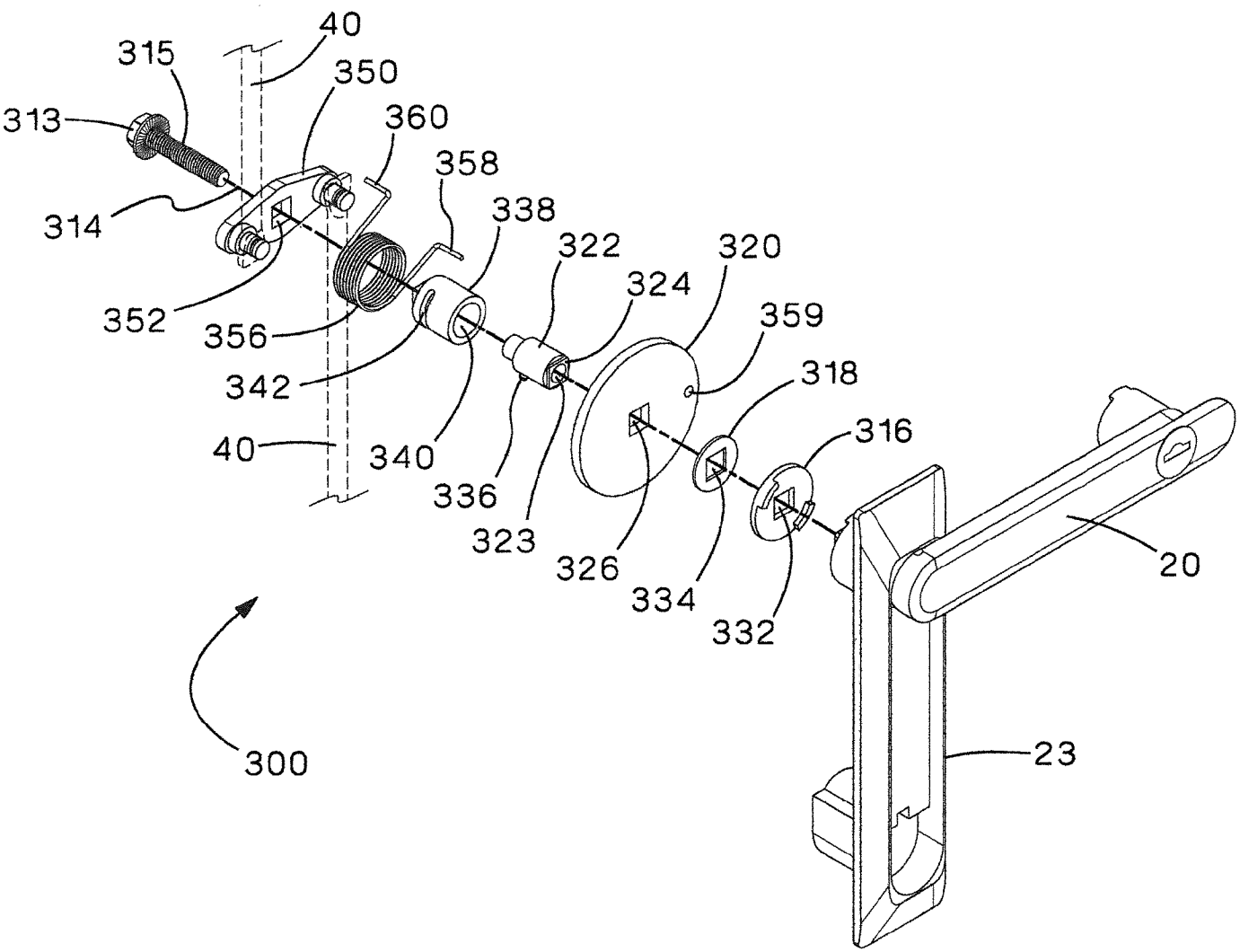
FIG. 35 is the exploded perspective view of the handle assembly shown in FIG. 31 with the handle in an open position which positions the locking rods in a retracted unlocked position.
Figure 37:
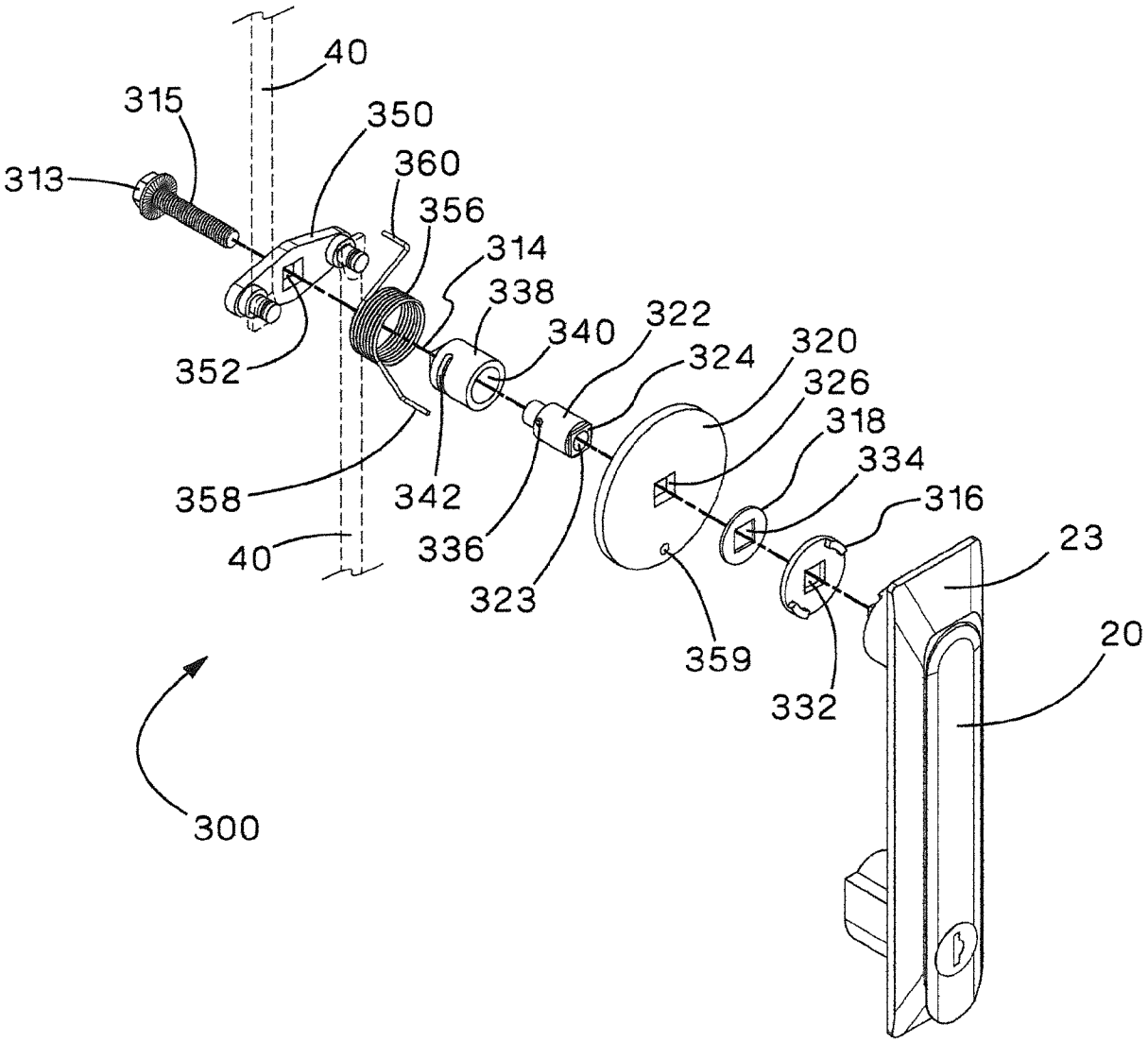
FIG. 37 is the exploded perspective view of the handle assembly as shown in FIG. 35 with the handle now in a second closed position with the locking rods in the retracted position.

Right handle assembly 20' is the same for both front and rear doors 12 and 17. As earlier mentioned, pair of locking rods 40, as seen in phantom in FIGS. 31, 35 and 37, are associated with (right) handle assembly 20' as they are with (left) handle assembly 18', as seen in FIGS. 39 and 40. Locking rods 40, are used to lock and unlock latches positioned on the same side of the door as the handle is positioned. Locking rods 40 will be in an extended position with latches closed and in a retracted position with latches open.

Locking rods 40, as seen in FIG. 31, with handle assembly 300 positioned in a first closed position and handle 20 positioned in a first position, are in an extended position extending toward the top and bottom of door 12. In the extended position, as will be discussed below, locking rods 40 lock latches, 65 and 48, as seen in FIGS. 17 and 18, in a closed position with both latches being positioned on the right side portion of door 12.

Figure 34:
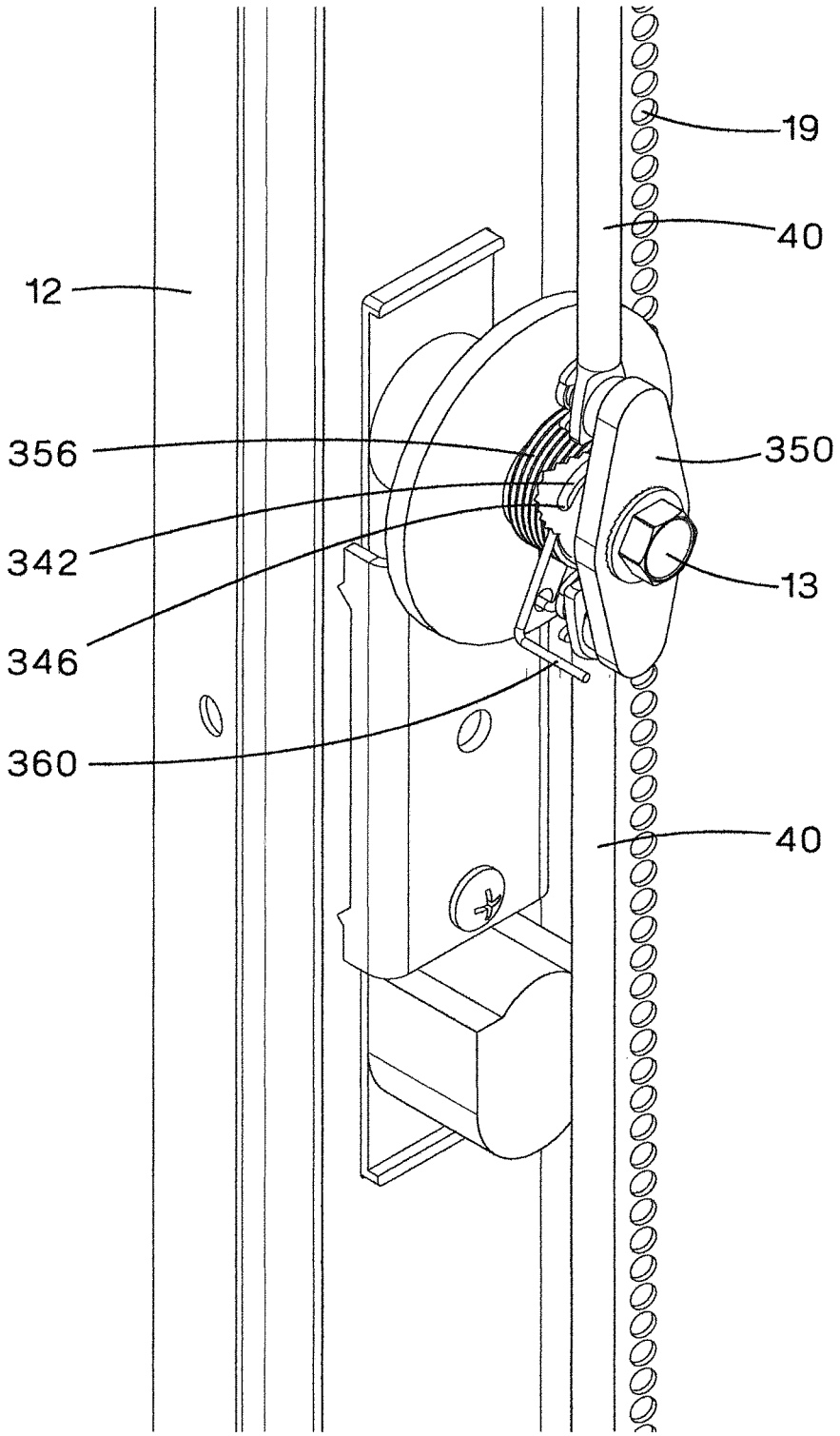
FIG. 34 is a perspective back side view of the door with the handle assembly as shown in FIG. 31 assembled, with the door handle assembly in the first closed position and with a portion of the torsion spring cut away.

Pair of locking rods 40 are secured to cam 350, as seen in FIGS. 31 and 34 one is positioned on one side of axis of rotation 314 and another is positioned on an opposing side of axis of rotation 314. Each locking rod 40, is positioned in an extended position relative to handle 20 with handle 20 in the first closed positioned shown in FIG. 31, which will be discussed in further detail below. Locking rods 40 will be positioned in a retracted position relative to handle 20 with handle 20 in a second position, shown in FIGS. 35 and 36.

Figure 36:
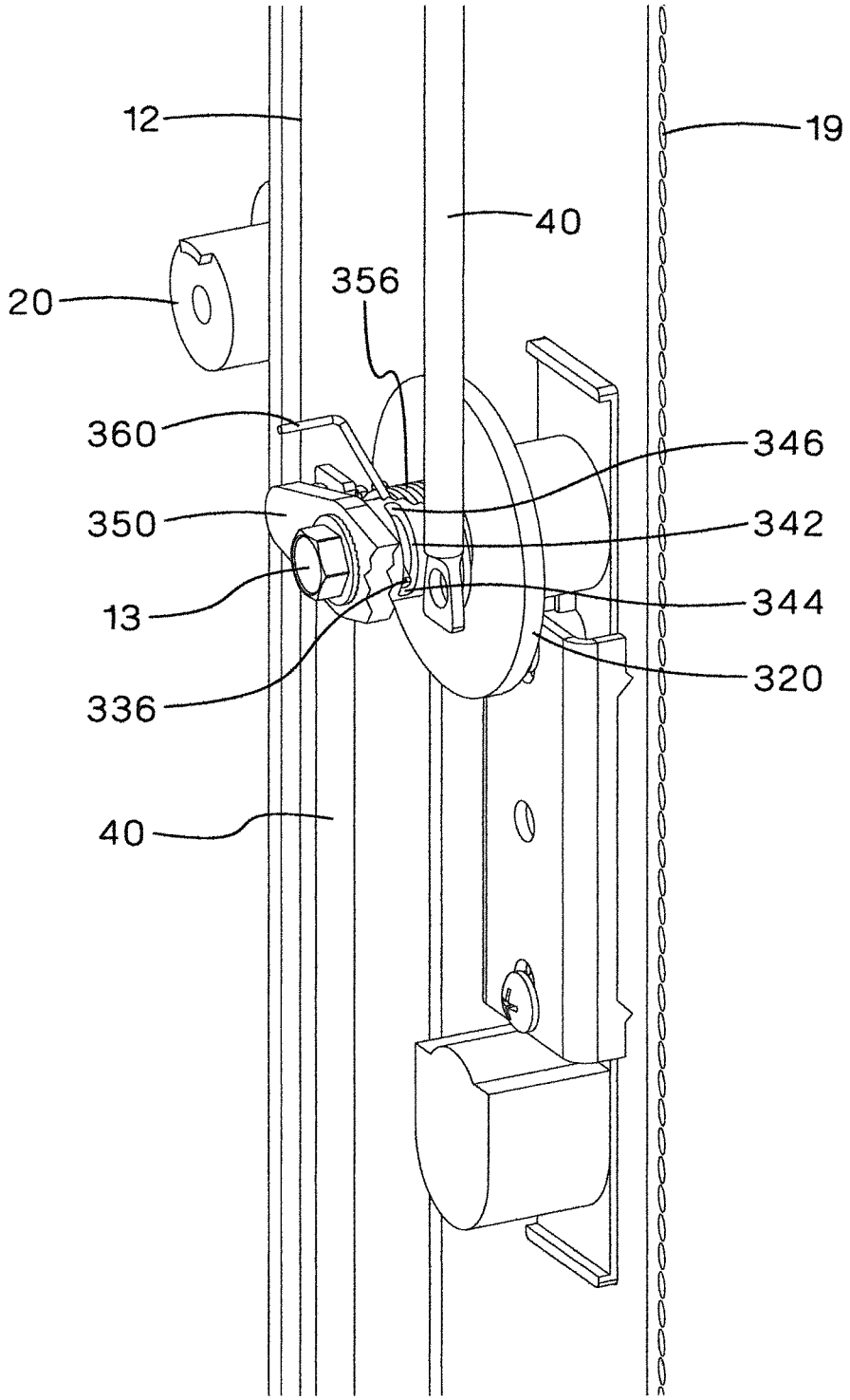
FIG. 36 is a perspective and partial cutaway back side view of the door handle assembly as shown in FIG. 35 assembled, with the door handle assembly in the open position with a portion of the cam and the torsion spring cut away.

As seen in FIGS. 35 and 36, handle assembly 20' is positioned in an open position, with handle 20 in a second position. Locking rods 40 are in a retracted position in relationship to the top and bottom of door 12 and with respect to handle 20, as mentioned above. In the retracted position, locking rods 40 unlock latches 48 and 65, as seen in FIGS. 26 and 27. With latches in an open position and being both on the right side portion of door 12, door 12 can now be opened from that right side of the door 12.

Figure 38:
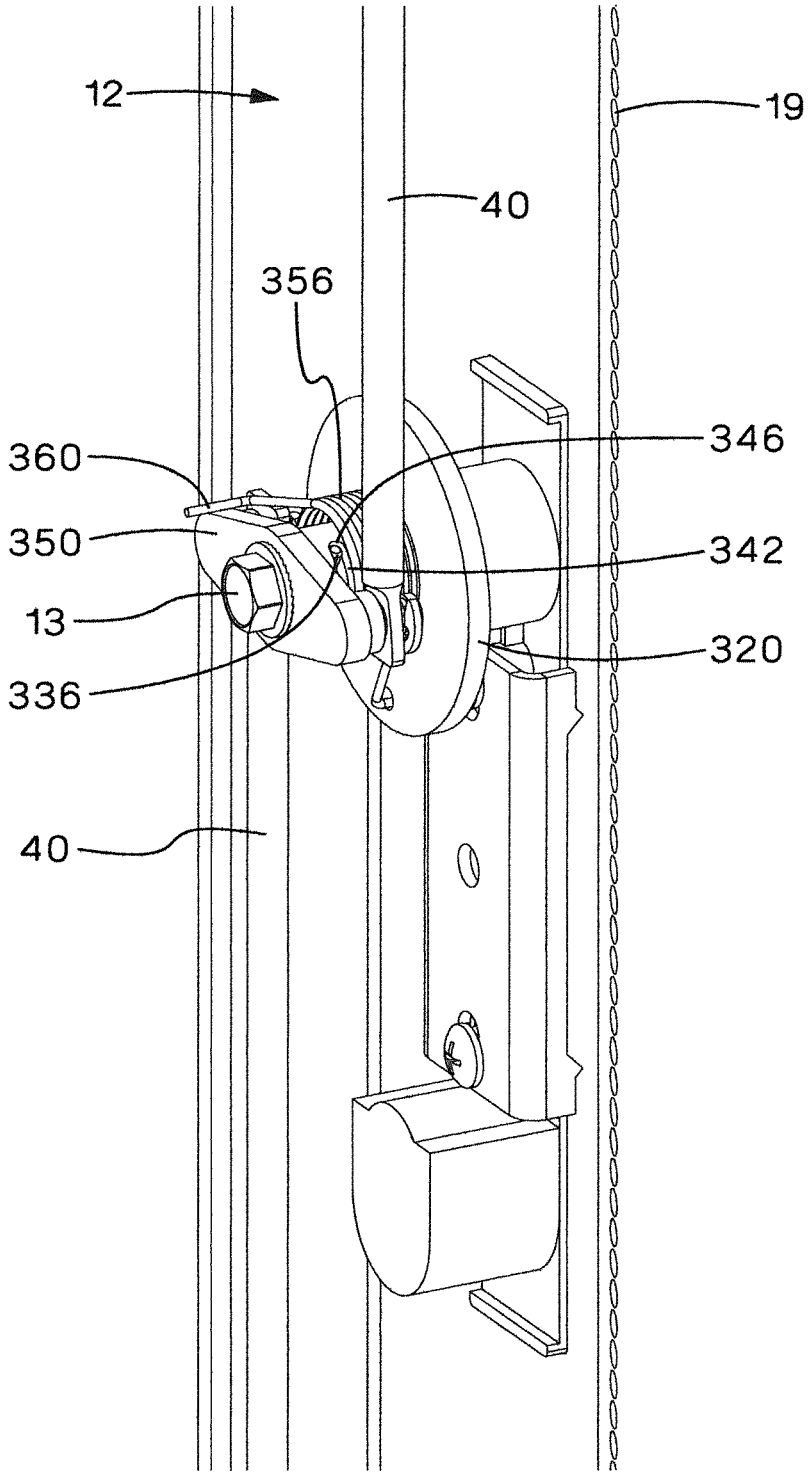
FIG. 38 is a perspective back side view of the door with the handle assembly of FIG. 37 assembled and in the second closed position with a portion of the torsion spring cut away.

As seen in FIGS. 37 and 38, handle assembly 20' is positioned in a second closed position, and locking rods 40 are in a retracted position in relationship to the top and bottom of door 12 and with respect to handle 20. In this retracted position, each of the locking rods 40 are positioned abutting bearing plate 302 as seen in FIGS. 26 and 27, with handle 20 moved back to its first position. As will be described in more detail below, with handle assembly 20' in this second closed position, locking rods 40 are urged with a spring within assembly 20' to move locking rods 40 toward an extended and locked position and will do so automatically when the corresponding latches 67 and 48 are moved back to a closed position, as seen in FIGS. 17 and 18.

Thus, with door 12 in a closed position, locking rods 40 associated with handle assembly 20' are in locking relationship with first upper latch 65 and first lower latch 48, as seen in FIGS. 17 and 18. At the same time locking rods 40 associated with handle assembly 18' will be in locking relationship with respect to second upper latch 67 and second lower latch 50, as seen in FIGS. 19 and 20.

Referring to FIGS. 26 and 27, locking rod 40 is not in a locking relationship with latch 48, however, this view will provide a further understanding of the working relationship between locking rod 40 with latch 48. Locking rod 40 extends through door cross beam 38 and is restricted to typically to movement in an upward and downward directions. A bottom portion of locking rod 40 includes a beveled lead edge 302. Bearing plate 306 is affixed to first latch linkage arm 62 by bolting, welding or other conventional means for securement. Bearing plate 306, in this embodiment, is rotatably secured to first connector 61 and will rotate and linearly move with pin connector 61.

Bearing plate 306 defines an opening 308 which is in registration alignment with an opening 310 defined in first latch linkage arm 62. In FIG. 26, locking rod 40 is in a retracted position and is positioned directly above bearing plate 306 with latch 48 in an opened position. With latch 48 in an open position, pin connector 61 has been moved by cam 60 such that first latch linkage arm 62 has been positioned in the retracted position, as seen in FIG. 9. With linkage arm 62 in the retracted position, openings 308 and 310 are not positioned in alignment with locking rod 40, as seen In FIG. 26. As latch 48 is rotated to a closed position, as seen in FIG. 9C, first latch linkage arm 62 is moved to the extended position, as seen in FIG. 9C, and openings 308 and 310 are moved to align with locking rod 40. With openings 308 and 310 in alignment with locking rod 40, locking rod 40 can be extended through openings 308 and 310, as seen in FIG. 18 and as seen in FIG. 9C. As will be discussed below, with handle 20 moved to a second closed position, as seen in FIGS. 37 and 38, with door 12 still in an open position, openings 308 and 310 are still not aligned with locking rod 40. Locking rod 40 will be automatically inserted into an extended position into openings 308 and 310 with a spring associated with handle assembly 20'. This will occur when door 12 and latch 48 reach a closed position thereby bringing openings 308 and 310 into alignment with locking rod 40. With locking rod 40 extending through openings 308 and 310, first latch linkage 62 is blocked from being able to move. Without linkage 62 being able to move, latch 48 cannot rotate and therefore latch 48 is locked in a closed position.

With door 12 in an open position as in FIG. 26, it can be further appreciated with this arrangement that as latch 48 moves toward a closed position, as seen in FIGS. 9 through 9C, openings 308 and 310 are moved closer to aligning with locking rod 40. As openings 308, 310 approach locking rod 40, beveled edge 302 engages an edge of opening 308 and locking rod 40 begins to and is able to slide smoothly into both openings 308 and 310 until it reaches a fully engaged position as seen in FIG. 17. Bumper 304 is sized to snuggly fit the internal dimensions of openings 308 and 310 and provide a snug fit between the locking rod 40 and bearing plate 306 and first latch linkage min 62. This snug fit prevents undesired movement of locking rod 40 within openings 308 and 310. Typically, bumper 304 is constructed of an elastomeric material.

With the removal of locking rod 40 from openings 308 and 310, as seen with moving handle 20 to a second position in FIGS. 35 and 36, latch 48 can now be rotated by pulling that side of the door away from frame 16 causing latch 48 to push against hinge pin 57 rotating latch 48 to an open position as seen in FIGS. 9 and 26. With locking rod 40 retracted out of openings 308 and 310, latch 48 is free to move linkage arm 62 to a retracted position as seen in FIG. 9 and FIG. 26 and thereby move openings 308 and 310 away from and out of alignment with locking rod 40. Door 12 is now in condition to be opened on from the right side of door 12.

This same operation of locking rod 40 interacting with first lower latch 48 is also occurring at the same time with first upper latch 65, resulting in the right side of door 12 to be able to be moved between open and closed positions. Likewise, locking rods 40 are associated with handle assembly 18' on the left side of door 12 and locking rods 40 interact with second lower latch 50 and second upper latch 67 on the left side of door 12 as that which has been described for the right side of door 12 above. Handle assemblies 18' and 20' as referred to and described herein, are connected to locking rods 40 and assist to move locking rods 40 between extended and retracted positions, to lock and unlock the lower and upper latches positioned on that side of the door in which the handle assembly is located.

Figure 32:
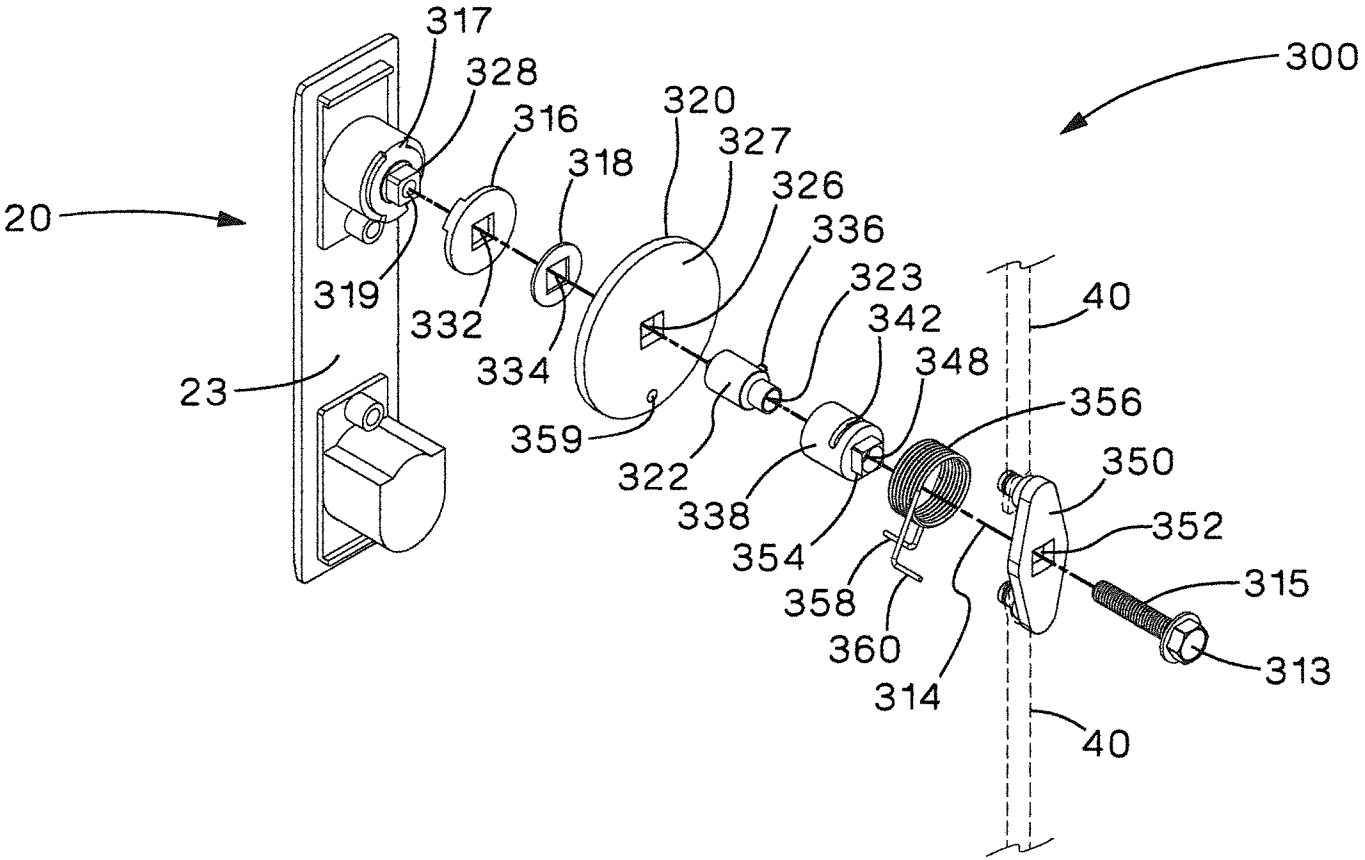
FIG. 32 is a top rear perspective exploded view of the handle assembly as shown in FIG. 31.

Now referring to FIGS. 31 and 32, handle assembly 300 is shown for right hand handle assembly 20' positioned on the right hand portion of door 12. Handle 20 is positioned, in this embodiment, in a first position, which is generally a vertical position and is mounted to door 12 with bracket 23. Handle 20 is positioned to rotate about an axis of rotation 314 which extends through a shaft of bolt 315 wherein a longitudinal axis of bolt 315 coincides with the axis of rotation 314. Bolt 315 secures together assembly 20' between head 313 at one end and handle 20 at the other end, wherein threads defined in bolt 315 engage threads not shown in receptacle 319 of handle 312.

In referring to FIGS. 31 and 32, in this embodiment, locking washer 316 engages a receptacle 317 configured to lock with locking washer 316 which is formed on handle 312. Washer 318 is interposed between locking washer 316 and one side 330 of plate 320. Plate 320 will be described below for receiving an arm of torsion spring 356. Plate 320 can be made in a variety of shapes and in this embodiment it takes on a circular configuration but can also be other shapes such as rectangular. Drive member 322 is positioned on opposing side 327 of plate 320. Drive member 322 defines a cylindrical shaped opening 323 which passes through a length of drive member 322 and provides a noncircular projection 324 extending from one end of drive member 322. In this embodiment, projection 324 is generally square in shape. Projection 324 engages a noncircular opening 326, in this embodiment is a square opening, defined in plate 320 on opposing side 327 of plate 320. Noncircular formation 328 defined by handle 302 engages noncircular opening 326 on one side 330 of plate 320. In this embodiment noncircular foil ration 328 is a square formation, formation 328 also engages and passes through noncircular opening 332 defined in locking washer 316 and engages and passes through noncircular opening 334 defined in washer 318. In this embodiment both openings 332 and 334 are also square in shape. With bolt 315 passing through openings 323, 326, 334 and 332 and being secured to handle 302 with threads within receptacle 319, defined in handle 20, handle 20, locking washer 316, washer 318, plate 320 and drive member 322 all rotate connected together about axis of rotation 314.

Figure 33:
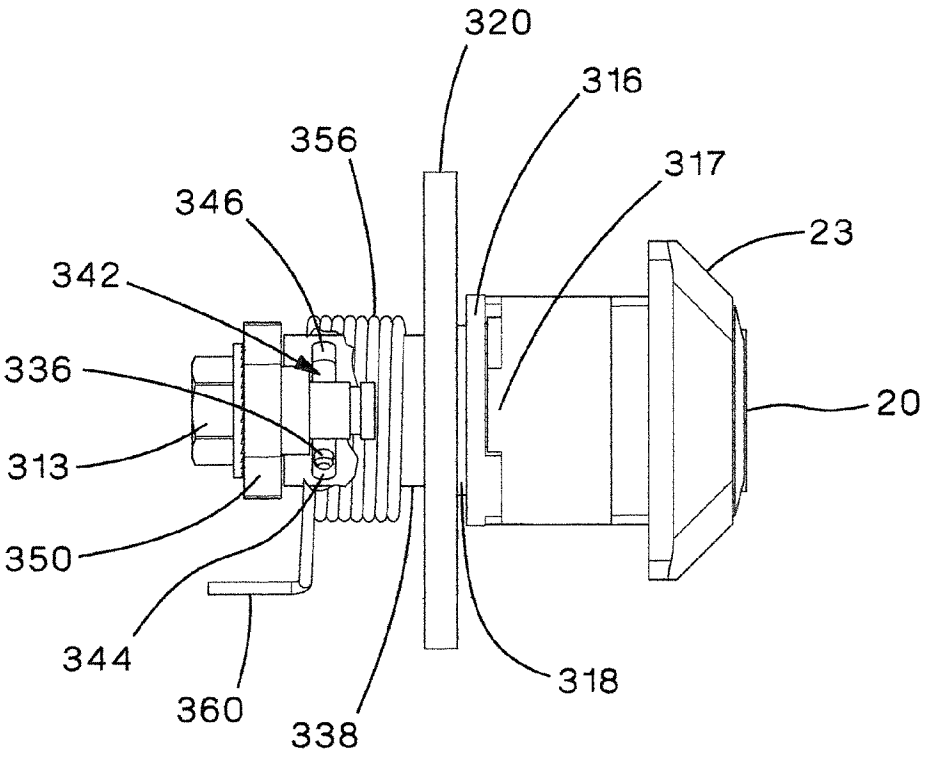
FIG. 33 is a top plan view of the torsion handle assembly shown in FIG. 31 assembled with a partial cutaway view of a portion of the torsion spring.

Drive pin 336 extends radially from drive member 322, as seen in FIGS. 31-33. Drive pin 336 define a threaded end (not shown) and is received by compatible threads (not shown) defined in drive member 322 to releasably engage drive pin 336 with drive member 332. Drive pin 336, in this embodiment, is not secured to drive member 322 until after drive member 322 has been inserted into drive receiving member 338. In this embodiment, drive member 322 defines a generally cylindrical external shape that can be received by a cylindrically shaped opening 340 defined by drive receiving member 338, wherein drive member 322 can rotate within cylindrical opening 340. Drive receiving member 338 further defines an opening 342 with first and second spaced apart opposing sidewalls 344 and 346, as seen in FIG. 33. In this embodiment, opening 342 is in the configuration of a slot. With drive member 322 positioned within drive receiving member 338, and threads defined within drive member 322 align with slot or opening 342, drive pin 336 can be secured to drive member 322 with respect to compatible threads through opening 342. With pin member 336 engaged to drive member 322, drive pin 336 is positioned within opening 342 and is movable within opening 342. Pin 336 within opening 342 is permitted to travel within opening or slot 342 between first and second sidewalls 344 and 346, as seen in FIG. 33.

Drive receiving member 338 defines an opening 348 which communicates with cylindrical opening 340 and allows bolt 315 to pass through drive receiving member 338 permitting drive receiving member 338 to rotate about axis of rotation 314. Cam 350 defines a noncircular opening 352, again in this embodiment opening 352 is square, which aligns with opening 348 of drive receiving member 338 which permits bolt 325 to pass through openings 348 and 352 such that drive receiving member 338 and cam 350. Cam 350 also abuts drive receiving member 338 such that with drive receiving member 338 defines a noncircular projection 354, in this embodiment projection 354 is square in shape, projection 354 engages opening 352 of cam 350. With cam 350 engaged to drive receiving member 338, cam 350 and drive receiving member 338 are permitted to rotate together about axis of rotation 314.

Torsion spring 356 is positioned about drive receiving member 338 and thereby bolt 315 also passes through opening 355 of spring 356, such that spring 356 is positioned about axis of rotation 314. First arm 358 of torsion spring 356 is connected to handle 20 through first arm 358 engaging arm receiving opening 359 defined in plate 320. Thus, as handle 20 moves or rotates, first arm 358 moves or rotates with handle 312. Second arm 360 is positioned in proximity to cam 350 such that arm 360 will move or rotate in the same direction as cam 350. In this embodiment, second arm 360 is positioned proximate to and spaced apart from cam 350, as seen in FIG. 34, such that second arm 360 and cam 350 can engage each other with arm 360 and cam 360 in a mutual path of rotation with one another. As will be appreciated in FIG. 38, second arm 360 of torsion spring 356 is in contact with cam 30 wherein second arm 360 is urging cam 350 to rotate in a downward direction.

In referring to FIGS. 31-33, handle assembly 300 for right side handle assembly 20' is shown in a first closed position with handle 20 in a first position. In this position, locking rods 40 are in an extended position, as seen in FIG. 34 and locking rods 40 lock latches 48 and 65 as seen in FIGS. 17 and 18. In referring to FIGS. 31 and 32, cam 350 is in a first position, in this embodiment cam 350 extends in a vertical direction. Torsion spring 356 is in a relaxed or unloaded position. Drive pin 336, as seen in FIG. 33, is positioned adjacent first sidewall 344 in slot or opening 342.

Thus, in moving handle 20 from its first closed position with a counterclockwise rotation, as seen in FIGS. 35 and 36, drive pin 336 exerts a force or pushes against first sidewall 344 as handle 20 is moved and causes drive receiving member 338 and cam 350 to also rotate in a counterclockwise direction as handle 20, until handle 20 reaches its second position as seen in FIG. 35. Handle assembly 20' is now in an open position with handle 312 in a second position. Cam 350 has been rotated to a second position by drive receiving member 338 which has been rotated by drive pin 336 caused by handle 20 being moved to the second position. Drive pin 336, as seen in FIGS. 34-36 remains against first sidewall 344 of slot or opening 342. Torsion spring 356 has also been moved or rotated with first arm 358 engaged to plate 320 to a second position. Second arm was free to rotate at the same time as first arm 358, torsion spring 356 remains unloaded and has stored no energy. As seen in FIG. 36, second arm 360 is still in a spaced apart relationship to cam 350 as seen in FIG. 34.

With handle 20 in the second position, as seen in FIGS. 35 and 36, locking rods 40 have been retracted and have been removed from openings 308 and 310 of bearing plate 306 and latch linkage arm 62. Door 12 can now be opened from the right side of door 12 and latches 48 and 65 will be permitted to rotate out of blocking relationship with their corresponding hinge pins 57 and 51 with pulling door 12 away from frame 16. As latch 48 rotates to an open position, as seen in FIG. 9, openings 308 and 310, as seen in FIGS. 26 and 27, are moved out of alignment with locking rod 40, as seen in FIGS. 26 and 27.

With door 12 in an open position on the right side of door 12, as seen in FIG. 3, handle 20 may, at the election of the user, be rotated back in a clockwise direction and returned to first position and assembly 20' is in a second closed position as seen in FIGS. 37 and 38 with door 12 not in a closed position. Cam 350 remains blocked in the second position and cannot move or rotate with rods 40 abutting bearing plate 306, as seen in FIGS. 26 and 27 and FIGS. 37 and 38. Drive pin 336 has moved away from first sidewall 344 of slot 342 and traveled within slot 342 to a position, in this embodiment, adjacent sidewall 346, as seen in FIG. 38 and thereby not moving drive receiving member 338. In the meantime, plate 320 and drive member 322 have rotated with handle 20 in a clockwise direction.

However, with door 12 not yet in fully closed position as seen in FIGS. 26 and 27, locking rod 40 is not in alignment with openings 308 and 310. Locking rods 40 remain abutting bearing plate 306 and as handle 20 moves clockwise, as set forth above, from second position to the first position, first arm 358 of torsion spring 356 is rotated in a clockwise direction as well. This causes second arm 360 to close its gap with cam 350 and it now pushes against cam 350 trying to urge cam 350 to rotate in a downward direction. Thus, with assembly 20' now in a second closed position, rods 40 remain in a retracted position and torsion spring 356 is now in a loaded position. In a loaded position, torsion spring 356 is urging locking rods 40 to be moved to an extended position but rods 40 as mentioned are blocked by and are abutting bearing plate 306. Rods 40 will be moved automatically by loaded torsion spring 356 to an extended locking position with respect to openings 308 and 310, when door 12 and movable latches 48 and 65 are closed. Because bearing plate 306 and latch linkage arm 62 are connected to movable latches 48 and 65, openings 308 and 310 are moved to align with locking rod 40 with door 12 moved to a closed position. With alignment of openings 308 and 310 with locking rods 40, second arm 360 of torsion spring 356 rotates cam 350 thereby automatically moving locking rods 40 to an extended position and into engagement with openings 308 and 310, as seen in FIGS. 9C, 17 and 18. With door 12 closed, latches 48 and 65 are closed and form hinges with hinge pins 57 and 51 respectively and with locking rods 40 in an extended position latches 48 and 65 are locked.

In referring to FIG. 39, handle assembly 18' is shown which is on the left side of doors 12 and 17. Handle 18 in assembly 18' rotates in a clockwise direction in moving from a first position as seen in FIG. 39 to a second position wherein handle 18 will be extending approximately perpendicular to the position handle 18 extended in the first position. Handle 18 is used to lock and unlock latches 50 and 67 on the left side of door 12 and door 17. In assembly 18' the components of the structure is similar to assembly 20'. However there are differences so as to accommodate the same results for handle assembly 20' but with moving handle 18 in a clockwise direction 357, as seen in FIG. 39, when moving handle 18 from a first position to a second position and moving handle 18 in a counterclockwise direction when moving handle 18 from the second position to the first position. With respect to second arm 360 of torsion spring 356, it is now positioned spaced apart from cam 350 on an opposite side of cam 350 as comparing FIG. 40 and FIG. 34. Drive pin 336 begins with assembly 18' in its first closed position in FIG. 39, being adjacent to and positioned on second sidewall 346 of slot 342. Thus, when handle 18 is first rotated in the clockwise direction 357 from its first position, as seen in FIG. 39, drive pin 336 immediately starts to rotate drive receiving member 338 in a clockwise direction as well. With handle in the second position, locking rods 40 are in a retracted position.

Thus with returning handle 18 from the second to the first position and locking rods 40 are blocked and cam 350 is therefore blocked, drive pin has traveled within slot 342 to the first sidewall 344. The returning of handle 18 to its first position from its second, has caused second arm 360 of torsion spring 356 to abut and push against cam 350. With door 12 moved to a closed position and latches 50 and 67 moved to a closed position locking rods 40 will be automatically extended by torsion spring 356 into engaged with openings 308 and 310 thereby locking latches 50 and 67.

The foregoing description of the various embodiments of the invention have been presented for purposes of illustration and description, and is not intended to be exhaustive or to limit the invention to the precise form disclosed. The description was selected to best explain the principles of the invention and its practical application to enable others skilled in the art to best utilize the invention in various embodiments and various modifications as are suited to the particular use contemplated. It is intended that the scope of the invention not be limited by the specification, but be defined by the claims set forth below.

The invention claimed is:

1. An interlocking assembly for a dual hinged door for a cabinet, comprising:

a first latch rotatably secured to the door at a first side of the door, the first latch rotatable between a closed position and an open position;

a second latch rotatably secured to the door at a second side of the door, opposite the first side, the second latch rotatable between a closed position and an open position;

a first interference member rotatably secured to the door;

a second interference member rotatably secured to the door, wherein the first interference and the second interference members are positioned adjacent one another;

a first latch linkage arm rotatably connected to the first latch at a first portion of the first latch linkage arm, wherein an axis of rotation between the first latch and the first portion of the first latch linkage arm is in a fixed position relative to the first latch and to the first portion of the first latch linkage arm and is moveable relative to the door, and rotatably connected to the first interference member at a second portion of the first latch linkage arm spaced apart from the first portion, such that rotation of the first latch from the closed position to the open position moves the first latch linkage arm and causes the first interference member to rotate; and a second latch linkage arm rotatably connected to the second latch at a first portion of the second latch linkage arm and rotatably connected to the second interference member at a second portion of the second latch linkage arm spaced apart from the first portion, such that rotation of the second latch from the closed position to the open position moves the second latch linkage arm and causes the second interference member to rotate;

wherein, the first interference member is positioned in a path of rotation of the second interference member, blocking rotation of the second interference member, with the first latch in the open position and the second latch in the closed position.

2. The interlocking assembly of claim 1 wherein the first latch comprises a base portion and two spaced apart arms extending from the base defining a space between the two arms for receiving a hinge pin and wherein an axis of rotation between the first latch and the door is in a fixed relationship to the door.

3. The interlocking assembly of claim 2 wherein the first latch further comprises a cam arm which extends from the first latch and is in fixed relationship with the first latch.

4. The interlocking assembly of claim 3 wherein an axis of rotation between the cam arm and the first latch linkage arm is spaced apart from the fixed axis of rotation between the first latch and the door.

5. The interlocking assembly of claim 4 further comprises a push rod rotatably connected to the cam arm.

6. The interlocking assembly of claim 5 wherein the push rod rotates about the axis of rotation between the cam arm and the first linkage arm.

7. The interlocking assembly of claim 5 wherein spaced apart from the rotational connection of the of the push rod and the cam arm the push rod is mounted to the door for rotational and translational movement relative to the door, wherein a pin is mounted to the door and positioned within a slot defined by the push rod such that the push rod is rotatable around the pin and the push rod is movable in a linear direction relative to the pin.

8. The interlocking assembly of claim 7 further includes a spring positioned along the push rod such that one end abuts the pin and the opposing end abuts a collar member positioned on the push rod such that the spring maintains a compression position as the cam arm rotates with the first latch between an open and closed positions, wherein with the first latch member in an opened position, the push rod exerts a force in a first direction on the cam a in maintaining the first latch in an open position and maintaining the first interference member in the path of rotation of the second interference member and with one of the arms of the first latch member engaging a hinge pin, connected to the cabinet, the first latch rotates to a closed position wherein the push rod exerts a force on the cam arm in a second direction maintaining the first latch in the closed position and maintaining the first interference member in a position out of the path of rotation of the second interference member.

9. The interlocking assembly of claim 1 wherein an axis of rotation between the second portion of the first linkage arm and the first interference member is movable relative to the door.

10. The interlocking assembly of claim 9 wherein an axis of rotation between the first interference member and the door is in fixed relationship to the door and spaced apart from the axis of rotation between the second portion of the first linkage arm and the first interference member.

11. The interlocking assembly of claim 1 wherein the first interference member comprises a convex surface and the second interference member comprises a concave surface such that the convex surface is positioned within the concave surface with the first interference member positioned within the path of rotation of the second interference member.

12. The interlocking assembly of claim 1 wherein the first interference member abuts the second interference member with the first interference member positioned within the path of rotation of the second interference member.

13. The interlocking assembly of claim 1 wherein the second interference member is positioned in a path of rotation of the first interference member, blocking rotation of the first interference member, with the second latch in the open position and the first latch in the closed position.

14. The interlocking assembly of claim 13 wherein the second latch comprises a second base portion and two spaced apart second arms extending from the second base defining a space between the two second arms for receiving another hinge pin, wherein an axis of rotation between the second member and the door is in a fixed relationship to the door and wherein a second cam arm extends from the second member and is fixed relationship with the second member.

15. The interlocking assembly of claim 14 wherein an axis of rotation between the second cam arm and the second latch linkage arm is movable relative to the door and is spaced apart from the fixed axis of rotation between the second member and the door.

16. The interlocking assembly of claim 1 wherein an axis of rotation between the second portion of the second linkage arm and the second interference member is movable relative to the door.

17. The interlocking assembly of claim 16 wherein an axis of rotation between the second interference member and the door is in fixed relationship to the door and spaced apart from the axis of rotation between the second portion of the second linkage arm and the second interference member.

18. The interlocking assembly of claim 1 wherein the second interference member comprises a convex surface and the first interference member comprises a concave surface such that the convex surface is positioned within the concave surface with the second interference member positioned within the path of rotation of the first interference member.

19. The interlocking assembly of claim 1 wherein the second interference member abuts the first interference member with the second interference member positioned within the path of rotation of the first interference member.

* * * * *